US006828087B2

(12) United States Patent
Nakamura

(10) Patent No.: US 6,828,087 B2
(45) Date of Patent: Dec. 7, 2004

(54) SILVER HALIDE PHOTOGRAPHIC MATERIAL

(75) Inventor: Tetsuo Nakamura, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/251,841

(22) Filed: Sep. 23, 2002

(65) Prior Publication Data

US 2004/0038159 A1 Feb. 26, 2004

(30) Foreign Application Priority Data

Sep. 26, 2001 (JP) ..... P.2001-293949

(51) Int. Cl.[7] ..... G03C 1/08; G03C 7/26; G03C 7/32

(52) U.S. Cl. ..... 430/558; 430/552; 430/553; 430/570; 430/590; 430/577; 430/578; 430/579; 430/581; 430/582; 430/583; 430/584; 430/585; 430/586; 430/587; 430/588; 430/589

(58) Field of Search ..... 430/550, 552–3, 430/570, 577–579, 581–590, 558

(56) References Cited

U.S. PATENT DOCUMENTS 5,057,406 A * 10/1991 Usagawa et al. ..... 430/581
5,061,618 A * 10/1991 Parton et al. ..... 430/584
5,457,022 A * 10/1995 Hioki et al. ..... 430/584
2002/0058216 A1 5/2002 Nakamura et al.

FOREIGN PATENT DOCUMENTS

JP 2000-63690 2/2000

* cited by examiner

*Primary Examiner*—Geraldine Letscher
(74) *Attorney, Agent, or Firm*—Sughrue Mion, PLLC

(57) ABSTRACT

A silver halide photographic material comprising at least one methine dye of formula (I) and at least one coupler of formula (X):

(I)

wherein $X^1$ and $X^2$ each represents O, S, Se, Te, N or C; $Y^1$ represents a furan, pyrrole or thiophene ring which may be condensed and substituted with the specific ring; $Y^2$ represents an atomic group necessary for forming a benzene ring or a 5- or 6-membered unsaturated heterocycle; $R^1$ and $R^2$ each represents a substituted or unsubstituted alkyl, aryl or heterocyclic group; $L^1$, $L^2$ and $L^3$ each represents a methine group; $n^1$ represents 0 or 1; $M^1$ represents a counter ion; and $m^1$ represents a number of 0 or more necessary for neutralizing a charge in a molecule;

(X)

wherein $Z^1$ and $Z^2$ each represents —C(Q3)═ or —N═; $Q^1$ and $Q^3$ each represents a hydrogen atom or a monovalent substituent group; $Q^2$ represents a hydrogen atom or a coupling release group.

5 Claims, No Drawings

SILVER HALIDE PHOTOGRAPHIC MATERIAL

FIELD OF THE INVENTION

The present invention relates to a silver halide photographic material, and particularly to a silver halide photographic material having high sensitivity, decreased residual colors after processing and minor fluctuations in photographic characteristics after continuous processing.

BACKGROUND OF THE INVENTION

Much effort has hitherto been made to enhance sensitivity of silver halide photographic materials and to decrease residual colors after processing. It has been known that sensitizing dyes used for spectral sensitization greatly affect properties of the silver halide photographic materials. In the sensitizing dyes, the slight difference in structure greatly affects the photographic properties such as sensitivity, fog, storage stability and residual coloration (residual colors), and the use of two or more of the sensitizing dyes in combination also greatly affects the photographic properties. However, it is difficult to predict its effect beforehand. Accordingly, many researchers have hitherto made effort to synthesize many sensitizing dyes and to study the use of many sensitizing dyes in combination, thereby examining their photographic properties. However, it is still impossible to predict the photographic properties in the present circumstances. For the above-mentioned reason, a technique for spectrally sensitizing the silver halide photographic materials at high sensitivity without adverse effects such as fog and residual colors has been desired.

When it is desired that the absorption maximum of the sensitizing dye is shifted to the long wavelength side, a naphthazole nucleus has hitherto been widely used in which a benzene ring is further condensed with a benzazole nucleus. However, a recent strong demand toward enhancement in sensitivity increases the amount of the dye added, while a reduction in a processing waste solution for complying with rapid photographic processing and environmental problems must be complied with. A highly hydrophobic dye such as the naphthazole nucleus-containing dye becomes difficult to meet such demands.

In Japanese Patent Application No. 124612/2000 (corresponding to U.S. Patent Application Publication No. 2002/0058216A1), the present inventors have disclosed that a sensitizing dye in which an azole nucleus having a specific heterocycle condensed is used in place of a naphthazole nucleus is higher in sensitivity and more decreased in residual colors than a naphthazole dye. However, such a dye is much accumulated in a processing solution after processing in principle, so that the problem has become clear that a fatigued processing solution is liable to fluctuate the photographic properties.

SUMMARY OF THE INVENTION

An object of the present invention is to provide a silver halide photographic material having high sensitivity, decreased residual colors after processing and minor fluctuations in photographic characteristics after continuous processing.

As a result of intensive investigation, the object of the present invention has been able to be attained by the following:

(1) A silver halide photographic material comprising at least one methine dye represented by the following general formula (I) and at least one coupler represented by the following general formula (X):

(I)

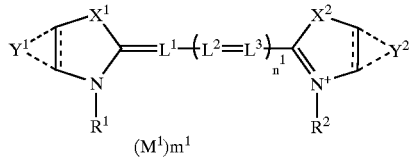

wherein $X^1$ and $X^2$ each represents an oxygen atom, a sulfur atom, a selenium atom, a tellurium atom, a nitrogen atom or a carbon atom; $Y^1$ represents a furan, pyrrole or thiophene ring which may be condensed with another 5- or 6-membered carbon ring or heterocycle or may have a substituent group; $Y^2$ represents an atomic group necessary for forming a benzene ring or a 5- or 6-membered unsaturated heterocycle, which may be further condensed with another 5- or 6-membered carbon ring or heterocycle or may have a substituent group; a bond between two carbon atoms by which $Y^1$ and $Y^2$ are each condensed with the carbon ring or the heterocycle may be a single bond or a double bond; $R^1$ and $R^2$ each represents a substituted or unsubstituted alkyl, aryl or heterocyclic group; $L^1$, $L^2$and $L^3$ each represents a methine group; $n^1$ represents 0 or 1; $M^1$ represents a counter ion; and $m^1$ represents a number of 0 or more necessary for neutralizing a charge in a molecule;

(X)

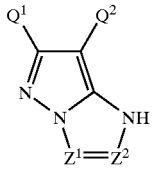

wherein $Z^1$ and $Z^2$ each represents —C(Q3)= or —N=; $Q^1$ and $Q^3$ each represents a hydrogen atom or a monovalent substituent group; $Q^2$ represents a hydrogen atom or a coupling release group; and $Q^1$, $Q^2$ or $Q^3$ may be a divalent group, and combine with a multimer, a dimer or more, or a polymer chain to form a homopolymer or a copolymer;

(2) A silver halide photographic material comprising a support having provided thereon at least one silver halide photographic emulsion layer, which contains at least one methine dye represented by the above-mentioned general formula (I) and at least one coupler represented by the following general formula (XX):

(XX)

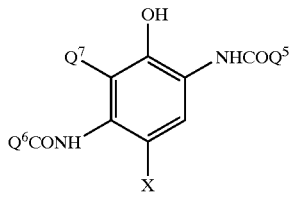

wherein $Q^5$ represents a substituted or unsubstituted aryl group; $Q^6$ represents a substituted or unsubstituted alkyl group; $Q^7$ represents a hydrogen atom, a halogen atom, an alkoxyl group or an alkyl group; and X represents a hydrogen atom or a group to be released by a reaction with an oxidant of a developing agent;

(3) The silver halide photographic material described in the above (1) or (2), wherein the methine dye represented by the above-mentioned general formula (I) in (1) or (2) is represented by the following general formula (II), (III), (IV) or (V):

(II)

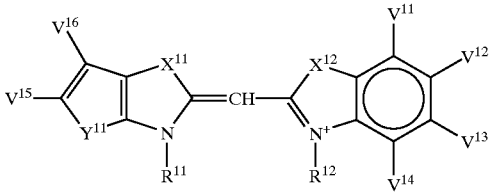

$(M^{11})m^{11}$ wherein $Y^{11}$ represents an oxygen atom, a sulfur atom or N—$R^{13}$, wherein $R^{13}$ represents a hydrogen atom or an alkyl group; $V^{15}$ and $V^{16}$ each represents a hydrogen atom or a monovalent substituent group; $X^{11}$ and $X^{12}$ each represents an oxygen atom or a sulfur atom; $R^{11}$ and $R^{12}$ each represents an alkyl group substituted by an acid group; $V^{11}$, $V^{12}$, $V^{13}$ and $V^{14}$ each represents a hydrogen atom or a monovalent substituent group; $M^{11}$ represents a counter ion; and $m^{11}$ represents a number of 0 or more necessary for neutralizing a charge in a molecule;

(III)

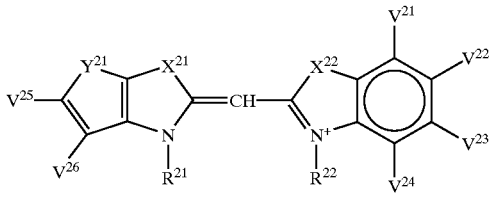

$(M^{21})m^{21}$ wherein $Y^{21}$ represents an oxygen atom, a sulfur atom or N—$R^{23}$ wherein $R^{23}$ represents a hydrogen atom or an alkyl group; $V^{25}$ and $V^{26}$ each represents a hydrogen atom or a monovalent substituent group; $X^{21}$ and $X^{22}$ each represents an oxygen atom or a sulfur atom; $R^{21}$ and $R^{22}$ each represents an alkyl group substituted by an acid group; $V^{21}$, $V^{22}$, $V^{23}$ and $V^{24}$ each represents a hydrogen atom or a monovalent substituent group; $M^{21}$ represents a counter ion; and $m^{21}$ represents a number of 0 or more necessary for neutralizing a charge in a molecule;

(IV)

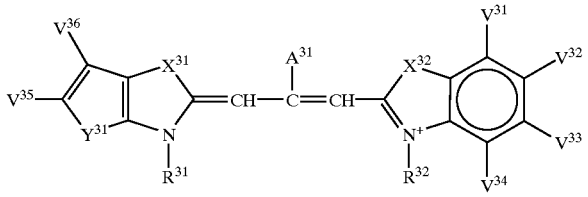

$(M^{31})m^{31}$ wherein $Y^{31}$ represents an oxygen atom, a sulfur atom or N—$R^{33}$, wherein $R^{33}$ represents a hydrogen atom or an alkyl group; $V^{35}$ and $V^{36}$ each represents a hydrogen atom or a monovalent substituent group; $X^{31}$ and $X^{32}$ each represents an oxygen atom or a sulfur atom; $R^{31}$ and $R^{32}$ each represents an alkyl group substituted by an acid group; $A^{31}$ represents a methyl group, an ethyl group or a propyl group; $V^{31}$, $V^{32}$, $V^{33}$ and $V^{34}$ each represents a hydrogen atom or a monovalent substituent group; $M^{31}$ represents a counter ion; and $m^{31}$ represents a number of 0 or more necessary for neutralizing a charge in a molecule;

(V)

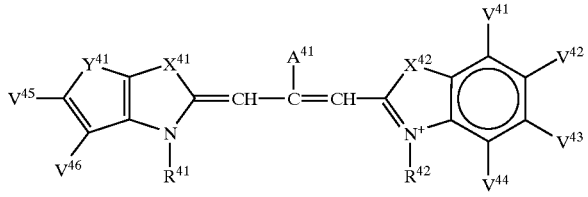

$(M^{41})m^{41}$ wherein $Y^{41}$ represents an oxygen atom, a sulfur atom or N—$R^{43}$, wherein $R^{43}$ represents a hydrogen atom or an alkyl group; $V^{45}$ and $V^{46}$ each represents a hydrogen atom or a monovalent substituent group; $X^{41}$ and $X^{42}$ each represents an oxygen atom or a sulfur atom; $R^{41}$ and $R^{42}$ each represents an alkyl group substituted by an acid group; $A^{41}$ represents a methyl group, an ethyl group or a propyl group; $V^{41}$, $V^{42}$, $V^{43}$ and $V^{44}$ each represents a hydrogen atom or a monovalent substituent group; $M^{41}$ represents a counter ion; and $m^{41}$ represents a number of 0 or more necessary for neutralizing a charge in a molecule;

(4) The silver halide photographic material described in the above (3), wherein one of $R^{11}$ and $R^{12}$ of the methine dye represented by the above-mentioned general formula (II) in (3) is an alkyl group substituted by a carboxyl group, a —$CONHSO_2$— group, an —$SO_2NHCO$— group, a —CONHCO— group or an —$SO_2NHSO_2$— group, and the other is an alkyl group substituted by a sulfo group;

(5) The silver halide photographic material described in the above (4), wherein $Y^{11}$ of the methine dye represented by the above-mentioned general formula (II) in (4) is a sulfur atom, $V^{15}$ is a halogen atom, and $V^{16}$ is a hydrogen atom;

(6) The silver halide photographic material described in the above (3), wherein one of $R^{21}$ and $R^{22}$ of the methine dye represented by the above-mentioned general formula (III) in (3) is an alkyl group substituted by a carboxyl group, a —$CONHSO_2$— group, an —$SO_2NHCO$— group, a —CONHCO— group or an —$SO_2NHSO_2$— group, and the other is an alkyl group substituted by a sulfo group;

(7) The silver halide photographic material described in the above (6), wherein $Y^{21}$ of the methine dye represented by the above-mentioned general formula (III) in (6) is a sulfur atom, $V^{25}$ is a halogen atom, and $V^{26}$ is a hydrogen atom;

(8) The silver halide photographic material described in the above (3), wherein one of $R^{31}$ and $R^{32}$ of the methine dye represented by the above-mentioned general formula (IV) in (3) is an alkyl group substituted by a carboxyl group, a —$CONHSO_2$— group, an —$SO_2NHCO$— group, a —CONHCO— group or an —$SO_2NHSO_2$— group, and the other is an alkyl group substituted by a sulfo group;

(9) The silver halide photographic material described in the above (8), wherein $Y^{31}$ of the methine dye represented by the above-mentioned general formula (IV) in (8) is a sulfur atom, $V^{35}$ is a halogen atom, and $V^{36}$ is a hydrogen atom;

(10) The silver halide photographic material described in the above (3), wherein one of $R^{41}$ and $R^{42}$ of the methine dye represented by the above-mentioned general formula (V) in (3) is an alkyl group substituted by a carboxyl group, a —$CONHSO_2$— group, an —$SO_2NHCO$— group, a —CONHCO— group or an —$SO_2NHSO_2$— group, and the other is an alkyl group substituted by a sulfo group;

(11) The silver halide photographic material described in the above (10), wherein $Y^{41}$ of the methine dye represented by the above-mentioned general formula (V) in (10) is a sulfur atom, $V^{45}$ is a halogen atom, and $V^{46}$ is a hydrogen atom;

(12) The silver halide photographic material described in the above (1), wherein the coupler represented by the above-mentioned general formula (X) in (1) is represented by the following general formula (XI) or (XII):

(XI)

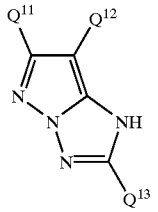

wherein $Q^{11}$ represents an alkyl group, $Q^{12}$ represents a hydrogen atom or a halogen atom, and $Q^{13}$ represents a substituent group containing —$SO_2$—;

(XII)

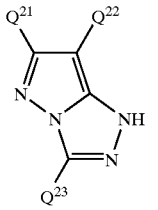

wherein $Q^{21}$ represents an alkyl group, $Q^{22}$ represents a hydrogen atom or a halogen atom, and $Q^{23}$ represents a substituent group containing —$SO_2$—;

(13) The silver halide photographic material described in the above (1) comprising a support having provided thereon at least one silver halide photographic emulsion layer, which contains at least one methine dye represented by the above-mentioned general formula (II), (III), (IV) or (V) and at least one coupler represented by the above-mentioned general formula (XII);

(14) The silver halide photographic material described in the above (13), wherein one of ($R^{11}$, $R^{21}$, $R^{31}$ or $R^{41}$) and ($R^{12}$, $R^{22}$, $R^{32}$ or $R^{42}$) of the methine dye represented by the above-mentioned general formula (II), (III), (IV) or (V) is an alkyl group substituted by a carboxyl group, a —$CONHSO_2$— group, an —$SO_2NHCO$— group, a —CONHCO— group or an —$SO_2NHSO_2$— group, and the other is an alkyl group substituted by a sulfo group;

(15) The silver halide photographic material described in the above (14), wherein ($Y^{11}$, $Y^{21}$, $Y^{31}$ or $Y^{41}$) of the methine dye represented by the above-mentioned general formula (II), (III), (IV) or (V) is a sulfur atom, ($V^{15}$, $V^{25}$, $V^{35}$ or $V^{45}$) is a halogen atom, and ($V^{16}$, $V^{26}$, $V^{36}$ or $V^{46}$) is a hydrogen atom;

(16) The silver halide photographic material described in the above (2) comprising a support having provided thereon at least one silver halide photographic emulsion layer, which contains at least one methine dye represented by the above-mentioned general formula (II), (III), (IV) or (V) and at least one coupler represented by the above-mentioned general formula (XX);

(17) The silver halide photographic material described in the above (16), wherein one of ($R^{11}$, $R^{21}$ $R^{31}$ or $R^{41}$) and ($R^{12}$, $R^{22}$, $R^{32}$ or $R^{42}$)of the methine dye represented by the above-mentioned general formula (II), (III), (IV) or (V) is an alkyl group substituted by a carboxyl group, a —$CONHSO_2$— group, an —$SO_2NHCO$— group, a —CONHCO— group or an —$SO_2NHSO_2$— group, and the other is an alkyl group substituted by a sulfo group; and

(18) The silver halide photographic material described in the above (17), wherein ($Y^{11}$, $Y^{21}$, $Y^{31}$ or $Y^{41}$) of the methine dye represented by the above-mentioned general formula (II), (III), (IV) or (V) is a sulfur atom, ($V^{15}$, $V^{25}$, $V^{35}$ or $V^{45}$) is a halogen atom, and ($V^{16}$, $V^{26}$, $V^{36}$ or $V^{46}$) is a hydrogen atom.

DETAILED DESCRIPTION OF THE INVENTION

The present invention will be described in detail below.

First, the groups used in the present invention will be described in detail.

In the present invention, when a specific moiety is referred to as a "group", it means that the moiety itself may not be substituted, or may be substituted by at least one substituent group (to the greatest number as possible). For example, an "alkyl group" means a substituted or unsubstituted alkyl group. The substituent group available in the present invention includes any substituent group, irrespective of the presence or absence of substitution.

Taking such a substituent group as W, the substituent group indicated by W may be any, and there is no particular limitation thereon. Examples thereof include a halogen atom, an alkyl group (including a cyclic alkyl group) also including an alkenyl group (including a cyclic alkenyl group) and an alkynyl group, an aryl group, a heterocyclic group, a cyano group, a hydroxyl group, a nitro group, a carboxyl group, an alkoxyl group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an ammonio group, an acylamino group, an aminocarbonylamino group, an alkoxycarbonylamino group, an aryloxycarbonylamino group, a sulfamoylamino group, an alkylsulfonylamino or arylsulfonylamino group, a mercapto group, an alkylthio group, an arylthio group, a heterocyclic thio group, a sulfamoyl group, a sulfo group, an alkylsulfinyl or arylsulfinyl group, an alkylsulfonyl or arylsulfonyl group, an acyl group, an aryloxycarbonyl group, an alkoxycarbonyl group, a carbamoyl group, an arylazo or heterocyclic azo group, an imido group, a phosphino group, a phosphinyl group, a phosphinyloxy group, a phosphinylamino group, a phospho group (also called a phosphono group), a silyl group, a hydrazino group, a ureido group, a boronic acid group, a phosphato group, a sulfato group and other known substituent groups.

More particularly, W represents a halogen atom (for example, fluorine, chlorine, bromine or iodine) or an alkyl group (a straight chain, branched or cyclic, substituted or unsubstituted alkyl group). The alkyl group includes an alkyl group (preferably an alkyl group having from 1 to 30 carbon atoms, for example, methyl, ethyl, n-propyl, isopropyl, t-butyl, n-octyl, eicosyl, 2-chloroethyl, 2-cyanoethyl or2-ethylhexyl), a cycloalkyl group (preferably a substituted or unsubstituted cycloalkyl group having from 3 to 30 carbon atoms, for example, cyclohexyl, cyclopentyl or 4-n-dodecylcyclohexyl), a bicycloalkyl group (preferably a substituted or unsubstituted bicycloalkyl group having from 5 to 30 carbon atoms, that is to say, a monovalent group obtained by removing one hydrogen atom from a bicycloalkane having from 5 to 30 carbon atoms, for example, bicyclo[1,2,2]heptane-2-yl or bicyclo-[2,2,2]octane-3-yl), and a tricyclo structure having more ring structures. An alkyl group in the substituent group described below (e.g., the alkyl group of alkylthio group) indicates an alkyl group having such a concept, and further includes an alkenyl group and an alkynyl group. The alkenyl group indicates a straight chain, branched or cyclic, substituted or unsubstituted alkenyl group, and include an alkenyl group (preferably a substituted or unsubstituted alkenyl group having from 2 to 30 carbon atoms, for example, vinyl, allyl, prenyl, geranyl or oleyl), a cycloalkenyl group (preferably a substituted or unsubstituted cycloalkenyl group having from 3 to 30 carbon atoms, that is to say, a monovalent group obtained by removing one hydrogen atom of a cycloalkene having from 3 to 30 carbon atoms, for example, 2-cyclopentene-1-yl or 2-cyclohexene-1-yl), a bicycloalkenyl group (a substituted or unsubstituted bicycloalkenyl group, preferably a substituted or unsubstituted bicycloalkenyl group having from 5 to 30 carbon atoms, that is to say, a monovalent group obtained by removing one hydrogen atom of a bicycloalkene having one double bond, for example, bicyclo[2,2,1]hepto-2-ene-1-yl or bicyclo[2,2,2]octo-2-ene-4-yl). The alkynyl group is preferably a substituted or unsubstituted alkynyl group having from 2 to 30 carbon atoms (for example, ethynyl, propargyl or trimethylsilylethynyl). W further represents an aryl group (preferably a substituted or unsubstituted aryl group having from 6 to 30 carbon atoms, for example, phenyl, p-tolyl, naphthyl, m-chlorophenyl or o-hexadecanoylaminophenyl), a heterocyclic group (preferably a monovalent group obtained by removing one hydrogen atom from a 5- or 6-membered, substituted or unsubstituted, aromatic or nonaromatic heterocyclic compound, and more preferably a 5- or 6-membered aromatic heterocyclic group having from 3 to 30 carbon atoms, for example, 2-furyl, 2-thienyl, 2-pyrimidinyl or 2-benzothiazolyl, allowing a cationic heterocyclic group such as 1-methyl-2-pyridinio or 1-methyl-2-quinolinio), a cyano group, a hydroxyl group, a nitro group, a carboxyl group, an alkoxyl group (preferably a substituted or unsubstituted alkoxyl group having from 1 to 30 carbon atoms, for example, methoxy, ethoxy, isopropoxy, t-butoxy, n-octyloxy or 2-methoxyethoxy), an aryloxy group (preferably a substituted or unsubstituted aryloxy group having from 6 to 30 carbon atoms, for example, phenoxy, 2-methylphenoxy, 4-t-butylphenoxy, 3-nitrophenoxy or 2-tetradecanoylaminophenoxy), a silyloxy group (preferably a silyloxy group having from 3 to 20 carbon atoms, for example, trimethylsilyloxy or t-butyldimethylsilyloxy), a heterocyclic oxy group (preferably a substituted or unsubstituted heterocyclic oxy group having from 2 to 30 carbon atoms, for example, 1-phenyltetrazole-5-oxy or 2-tetrahydropyranyloxy), an acyloxy group (preferably a formyloxy, an a substituted or unsubstituted alkylcarbonyloxy group having from 2 to 30 carbon atoms, or a substituted or unsubstituted arylcarbonyloxy group having from 6 to 30 carbon atoms, for example, formyloxy, acetyloxy, pivaloyloxy, stearoyloxy, benzoyloxy or p-methoxyphenylcarbonyloxy), a carbamoyloxy (preferably a substituted or unsubstituted carbamoyloxy group having from 1 to 30 carbon atoms, for example, N,N-dimethylcarbamoyloxy, N,N-diethylcarbamoyloxy, morpholinocarbonyloxy, N,N-di-n-octylaminocarbonyloxy or N-n-octylcarbamoyloxy), an alkoxycarbonyloxy group (preferably a substituted or unsubstituted alkoxylcarbonyloxy group having from 2 to 30 carbon atoms, for example, methoxycarbonyloxy, ethoxycarbonyloxy, t-butoxycarbonyloxy or n-octylcarbonyloxy), an aryloxycarbonyloxy group (preferably a substituted or unsubstituted aryloxycarbonyloxy group having from 7 to 30 carbon atoms, for example, phenoxycarbonyloxy, p-methoxyphenoxycarbonyloxy or p-n-hexadecyloxyphenoxycarbonyloxy), an amino group (preferably an amino group, a substituted or unsubstituted alkylamino group having from 1 to 30 carbon atoms or a substituted or unsubstituted anilino group having from 6 to 30 carbon atoms, for example, amino, methylamino, dimethylamino, anilino, N-methylanilino or diphenylamino), an ammonio group (preferably an ammonio group or an ammonio group substituted by a substituted or unsubstituted alkyl having from 1 to 30 carbon atoms, aryl or a heterocycle, for example, a trimethylammonio, triethylammonio or diphenylmethylammonio), an acylamino group (preferably a formylamino group, a substituted or unsubstituted alkylcarbonylamino group having from 1 to 30 or a substituted or unsubstituted arylcarbonylamino group having from 6 to 30, for example, formylamino, acetylamino, pivaloylamino, lauroylamino, benzoylamino or 3,4-5-tri-n-octyloxyphenylcarbonylamino), an aminocarbonylamino group (preferably a substituted or unsubstituted aminocarbonylamino group having from 1 to 30 carbon atoms, for example, carbamoylamino, N,N-dimethylaminocarbonylamino, N,N-diethylaminocarbonylamino or morpholinocarbonylamino), an alkoxycarbonylamino group (preferably a substituted or unsubstituted alkoxycarbonylamino group having from 2 to 30 carbon atoms, for example, methoxycarbonylamino, ethoxycarbonylamino, t-butoxycarbonylamino, n-octadecyloxycarbonylamino or N-methylmethoxycarbonylamino), an aryloxycarbonylamino group (preferably a substituted or unsubstituted aryloxycarbonylamino group having from 7 to 30 carbon atoms, for example, phenoxycarbonylamino, p-chlorophenoxycarbonylamio or m-(n-octyloxy) phenoxycarbonylamino), a sulfamoylamino group (preferably a substituted or unsubstituted sulfamoylamino group having from 0 to 30 carbon atoms, for example, sulfamoylamino, N,N-dimethylaminosulfonylamino or N-n-octylaminosulfonylamino), an alkylsulfonylamino or arylsulfonylamino group (preferably a substituted or unsubstituted alkanesulfonylamino group having from 1 to 30 carbon atoms or a substituted or unsubstituted arylsulfonylamino group having from 6 to 30 carbon atoms, for example, methylsulfonylamino, butylsulfonylamino, phenylsulfonylamino, 2,3,5-trichlorophenylsulfonylamino or p-methylphenylsulfonylamino), a mercapto group, an alkylthio group (preferably a substituted or unsubstituted alkylthio group having from 1 to 30 carbon atoms, for example, methylthio, ethylthio or n-hexadecylthio), an arylthio group (preferably a substituted or unsubstituted arylthio group having from 6 to 30 carbon atoms, for example, phenylthio, p-chlorophenylthio or m-methoxyphenylthio), a heterocyclic thio group (preferably a substituted or unsubstituted heterocyclic thio group having from 2 to 30 carbon atoms, for example, 2-benzothiazolylthio or 1-phenyltetrazole-5-ylthio), a sulfamoyl group (preferably a substituted or unsubstituted sulfamoyl group having from 0 to 30 carbon atoms, for example, N-ethylsulfamoyl, N-(3-dodecyloxypropyl) sulfamoyl, N,N-dimethylsulfamoyl, N-acetylsulfamoyl, N-benzoylsulfamoyl or N-(N'-phenylcarbamoyl)sulfamoyl), a sulfo group, an alkylsulfinyl or arylsulfinyl group (preferably a substituted or unsubstituted alkylsulfinyl group having from 1 to 30 carbon atoms or an arylsulfinyl group having from 6 to 30 carbon atoms, for example, methylsulfinyl, ethylsulfinyl, phenylsulfinyl or p-methylphenylsulfinyl, an alkylsulfonyl or arylsulfonyl group (preferably a substituted or unsubstituted alkanesulfonyl group having from 1 to 30 carbon atoms or a substituted or unsubstituted arylsulfonyl group having from 6 to 30 carbon atoms, for example, methylsulfonyl, ethylsulfonyl, phenylsulfonyl or p-methylphenylsulfonyl), an acyl group (preferably a formyl group, a substituted or unsubstituted alkylcarbonyl group having from 2 to 30 carbon atoms, a substituted or unsubstituted arylcarbonyl group having from 7 to 30 carbon atoms, or a substituted or unsubstituted heterocyclic carbonyl group having from 4 to 30 carbon atoms which is linked by a carbon atom to a carbonyl group, for example, acetyl, pivaloyl, 2-chloroacetyl, stearoyl, benzoyl, p-n-octyloxyphenylcarbonyl, 2-pyridylcarbonyl or 2-furylcarbonyl), an aryloxycarbonyl group (preferably a substituted or unsubstituted aryloxycarbonyl group having from 7 to 30 carbon atoms, for example, phenoxycarbonyl, o-chlorophenoxycarbonyl, m-nitrophenoxycarbonyl or p-t-butylphenoxycarbonyl), an alkoxycarbonyl group (preferably a substituted or unsubstituted alkoxycarbonyl group having from 2 to 30 carbon atoms, for example, methoxycarbonyl, ethoxycarbonyl, t-butoxycarbonyl or n-octadecyloxycarbonyl), a carbamoyl group (preferably a substituted or unsubstituted carbamoyl group having from 1 to 30 carbon atoms, for example, carbamoyl, N-methylcarbamoyl, N,N-dimethylcarbamoyl, N,N-di-n-octylcarbamoyl or N-(methylsulfonyl)carbamoyl), an arylazo or heterocyclic azo group (preferably a substituted or unsubstituted arylazo group having from 6 to 30 carbon atoms, or a substituted or unsubstituted heterocyclic azo group having from 3 to 30 carbon atoms, for example, phenylazo, p-chlorophenylazo or 5-ethylthio-1,3,4-thiadiazole-2-ylazo), an imido group (preferably N-succinimido or N-phthalimido), a phosphino group (preferably a substituted or unsubstituted phosphino group having from2 to 30 carbon atoms,for example, dimethylphosphino, diphenylphosphino or methylphenoxyphosphino), a phosphinyl group (preferably a substituted or unsubstituted phosphinyl group having from 2 to 30 carbon atoms, for example, phosphinyl, dioctyloxyphosphinyl or diethoxyphosphinyl), a phosphinyloxy group (preferably a substituted or unsubstituted phosphinyloxy group having from 2 to 30 carbon atoms, for example, diphenoxyphosphinyloxy or dioctyloxyphosphinyloxy), a phosphinylamino group (preferably a substituted or unsubstituted phosphinylamino group having from 2 to 30 carbon atoms, for example, dimethoxyphosphinylamino or dimethylaminophosphinylamino), a phospho group, a silyl group (preferably a substituted or unsubstituted silyl group having from 3 to 30 carbon atoms, for example, trimethylsilyl, t-butyldimethylsilyl or phenyldimethylsilyl), a hydrazino group (preferably a substituted or unsubstituted hydrazino group having from 0 to 30 carbon atoms, for example, trimethylhydrazino), or a ureido group (preferably a substituted or unsubstituted ureido group having from 0 to 30 carbon atoms, for example, N,N-dimethylureido).

Two W's can also cooperatively form a ring-condensed structure. The rings are aromatic or nonaromatic hydrocarbon rings or heterocycles, which can be further combined to form a polycyclic condensed ring. Examples of the rings include a benzene ring, a naphthalene ring, an anthracene ring, a quinoline ring, a phenanthrene ring, a fluorene ring, a triphenylene ring, a naphthacene ring, a biphenyl ring, a pyrrole ring, a furan ring, a thiophene ring, an imidazole ring, an oxazole ring, a thiazole ring, a pyridine ring, a pyradine ring, a pyrimidine ring, a pyridazine ring, an indolizine ring, an indole ring, a benzofuran ring, a benzothiophene ring, an isobenzofuran ring, a quinolizine ring, an isoquinoline ring, a phthalazine ring, a naphthyridine ring, a quinoxaline ring, a quinoxazoline ring, a carbazole ring, a phenanthridine ring, an acridine ring, a phenanthroline ring, a thianthrene ring, a chromene ring, a xanthene ring, a phenoxathiin ring, a phenothiazine ring and a phenazine ring.

As for a hydrogen atom-containing substituent group of the above-mentioned substituent groups W, the hydrogen atom may be removed and further substituted by the above-mentioned substituent group. Examples of such substituent groups include a —$CONHSO_2$— group (a sulfonylcarbamoyl or carbonylsulfamoyl group), a —CONHCO— group (a carbonylcarbamoyl group) and an —$SO_2NHSO_2$— group (a sulfonylsulfamoyl group). More specifically, the substituent groups include an alkylcarbonylaminosulfonyl group (for example, acetylaminosulfonyl), an arylcarbonylaminosulfonyl group (for example, benzoylaminosulfonyl), an alkanesulfonylaminocarbonyl group (for example, methylsulfonylaminocarbonyl) and an arylsulfonylaminocarbonyl group (for example, p-methylphenylsulfonylaminocarbonyl).

The methine dye represented by general formula (I) of the present invention will be described below.

$X^1$ and $X^2$ each represents an oxygen atom, a sulfur atom, a selenium atom, a tellurium atom, a nitrogen atom or a carbon atom. The nitrogen atom can be preferably represented by —N(Rx)—, and the carbon atom can be preferably represented by —C(Ry)(Rz)—. Rx, Ry and Rz are each a hydrogen atom or a monovalent substituent group (for example, W described above) preferably an alkyl group, an aryl group or a heterocyclic group, similar to the group represented by R, and more preferably an alkyl group. $X^1$ and $X^2$ are each preferably an oxygen atom, a sulfur atom or a nitrogen atom, and more preferably an oxygen atom or a sulfur atom.

$Y^1$ represents a furan, pyrrole or thiophene ring which may be condensed with another 5- or 6-membered carbon ring or heterocycle or may have a substituent group. Although a bond between two carbon atoms by which $Y^1$ is condensed may be a single bond or a double bond, it is preferably a double bond. $Y^1$ can further form a condensed ring together with another 5- or 6-membered carbon ring or heterocycle. However, it is preferred that the third condensed ring does not exist. $Y^1$ is preferably a thiophene ring. The substituent group for $Y^1$may be any, and includes W described above. The substituent group is preferably an alkyl group (for example, methyl), an aryl group (for example, phenyl), an aromatic heterocyclic group (for example, 1-pyrrolyl), an alkoxyl group (for example, methoxy), an alkylthio group (for example, methylthio),a cyano, an acyl group (for example, acetyl), an alkoxycarbonyl group (for example, methoxycarbonyl) or a halogen atom (for example, fluorine, chlorine, bromine or iodine), more preferably methyl, methoxy, cyano or a halogen atom, still more preferably a halogen atom, particularly preferably fluorine, chlorine or bromine, and most preferably chlorine. In particular, when $Y^1$ is a thiophene ring, it preferably has a halogen substituent group. The substituent group is preferably chlorine or bromine, and most preferably chlorine.

$Y^2$ represents an atomic group necessary for forming a benzene ring or a 5- or 6-membered unsaturated heterocycle, which may be further condensed with another 5- or 6-membered carbon ring or heterocycle or may have a substituent group. Although a bond between two carbon atoms by which $Y^2$ is condensed may be a single bond or a double bond, it is preferably a double bond. The 5-membered unsaturated heterocycles include a pyrrole ring, a pyrazole ring, an imidazole ring, a triazole ring, a furan ring, an oxazole ring, an isoxazole ring, a thiophene ring, a thiazole ring, an isothiazole ring, a thiadiazole ring, a selenophene ring, a selenazole ring, an isoselenazole ring, a tellurophene ring, a tellurazole ring and an isotellurazole ring, and the 6-membered unsaturated heterocycles include a pyridine ring, a pyridazine ring, a pyrimidine ring, a pyradine ring, a pyran ring and a thiopyran ring. $Y^2$ can be further condensed with another 5- or 6-membered carbon ring or heterocycle to form, for example, an indole ring, a benzofuran ring, a benzothiophene ring or a thienothiophene ring. However, it is preferred that the third condensed ring does not exist. $Y^2$ is preferably a benzene ring, a pyrrole ring, a furan ring or a thiophene ring, particularly preferably a benzene ring, a furan ring or a pyrrole ring, and most preferably a benzene ring. The substituent group for $Y^2$ may be any, and includes W described above. The substituent group is preferably an alkyl group (for example, methyl), an aryl group (for example, phenyl), an aromatic heterocyclic group (for example, 1-pyrrolyl), an alkoxyl group (for example, methoxy), an alkylthio group (for example, methylthio), a cyano, an acyl group (for example, acetyl), an alkoxycarbonyl group (for example, methoxycarbonyl) or a halogen atom (for example, fluorine, chlorine, bromine or iodine), more preferably methyl, methoxy, cyano or a halogen atom, still more preferably a halogen atom, particularly preferably fluorine, chlorine or bromine, and most preferably chlorine.

$R^1$ and $R^2$ each represents a substituted or unsubstituted alkyl, aryl or heterocyclic group. At least one of $R^1$ and $R^2$ is preferably an alkyl group substituted by an acid group. More preferably, both of $R^1$ and $R^2$ are alkyl groups each substituted by an acid group.

The acid group will be described herein. The term "acid group" means a group having a dissociative proton. Specific examples thereof include a group that dissociates a proton depending on the pKa and the surrounding pH, such as a sulfo group, a carboxyl group, a sulfato group, a —$CONHSO_2$— group (a sulfonylcarbamoyl or carbonylsulfamoyl group), a —CONHCO— group (a carbonylcarbamoyl group), an —$SO_2NHSO_2$— group (a sulfonylsulfamoyl group), a sulfonamido group, a sulfamoyl group, a phosphato group, a phosphono group, a boronic acid group or a phenolic hydroxyl group. For example, a proton-dissociative acidic group in which 90% or more dissociates between pH 5 and pH 11 is preferred.

Preferred one of the "alkyl group substituted by an acid group" represented by $R^1$ or $R^2$ in the methine dye represented by general formula (I) can be expressed in the form of a formula as follows:

Preferred Alkyl Group=Qa-$T^1$ $T^1$=—$SO_3^-$
—COOH
—$CONHSO_2Ra$
—$SO_2NHCORb$
—CONHCORc
—$SO_2NHSO_2Rd$ Qa represents a connecting group necessary for forming an alkyl group (preferably a divalent connecting group). Ra, Rb, Rc and Rd each represents an alkyl group, an aryl group, a heterocyclic group, an alkoxyl group, an aryloxy group, a heterocyclyloxy group or an amino group.

Qa may be any connecting group, as long as it meets the above-mentioned requirements. It is preferably an atom or an atomic group containing at least one of a carbon atom, a nitrogen atom, a sulfur atom and an oxygen atom. It preferably represents a connecting group having from 0 to 10 carbon atoms, preferably from 1 to 8 carbon atoms, more preferably from 1 to 5 carbon atoms which is constituted by a combination of one or more of an alkylene group (for example, methylene, ethylene, trimethylene, tetramethylene, pentamethylene or methyltrimethylene), an alkenylene group (for example, ethenylene or propenylene), an alkynylene group (for example, ethynylene or propynylene), an amido group, an ester group, a sulfoamido group, a sulfonic ester group, a ureido group, a sulfonyl group, a sulfinyl group, a thioether group, an ether group, a carbonyl group or an —N(Wa)— group (wherein Wa represents a hydrogen atom or a monovalent substituent group, and the monovalent substituent group includes W described above.

The above-mentioned connecting group may further have the substituent group represented by W described above, and may have a ring (an aromatic or nonaromatic hydrocarbon ring or a heterocycle).

However, it is more preferred that the connecting group contains no heteroatom. It is still more preferred that the connecting group is not substituted by the substituent group represented by W described above.

More preferably, Qa is a divalent connecting group having from 1 to 5 carbon atoms which is constituted by a combination of one or more of an alkylene group having from 1 to 5 carbon atoms (for example, methylene, ethylene, trimethylene, tetramethylene, pentamethylene or methyltrimethylene), an alkenylene group having from 2 to 5 carbon atoms (for example, ethenylene or propenylene) and an alkynylene group having from 2 to 5 carbon atoms (for example, ethynylene or propynylene). Particularly preferred is an alkylene group having from 1 to 5 carbon atoms (preferably methylene, ethylene, trimethylene or tetrametylene).

When $T^1$ is a sulfo group, Qa is more preferably ethylene, trimethylene, tetramethylene or methyltrimethylene, and particularly preferably trimethylene. When Xa is a carboxyl group, Qa is more preferably methylene, ethylene or trimethylene, and particularly preferably methylene. When $T^1$ is —$CONHSO_2Ra$, —$SO_2NHCORb$, —CONHCORc or $SO_2NHSO_2Rd$, Qa is more preferably methylene, ethylene or trimethylene, and particularly preferably methylene.

Ra, Rb, Rc and Rd each represents an alkyl group, an aryl group, a heterocyclic group, an alkoxyl group, an aryloxy group, a heterocyclyloxy group or an amino group.

Preferred examples thereof include an unsubstituted alkyl group having from 1 to 18 carbon atoms, preferably from 1 to 10 carbon atoms, more preferably from 1 to 5 carbon atoms (for example, methyl, ethyl, propyl or butyl), a substituted alkyl group having from 1 to 18 carbon atoms, preferably from 1 to 10 carbon atoms, more preferably from 1 to 5 carbon atoms (for example, hydroxymethyl, trifluoromethyl, benzyl, carboxyethyl, ethoxycarbonylmethyl or acetylaminomethyl, it shall be considered to include an unsaturated hydrocarbon group having preferably from 2 to 18,- more preferably from 3 to 10 carbon atoms, particularly preferably from 3 to 5 (for example, a vinyl group, an ethynyl group, a 1-cyclohexenyl group, a benzylidyne group or a benzylidene group)), a substituted or unsubstituted aryl group having from 6 to 20 carbon atoms, preferably from 6 to 15 carbon atoms, more preferably from 6 to 10 carbon atoms (for example, phenyl, naphthyl, p-carboxyphenyl, p-nitrophenyl, 3,5-dichlorophenyl, p-cyanophenyl, m-fluorophenyl or p-tolyl), a heterocyclic group, which may be substituted, having from 1 to 20 carbon atoms, preferably from 2 to 10 carbon atoms, more preferably from 4 to 6 carbon atoms (for example, pyridyl, 5-methylpyridyl, thienyl, furyl, morpholino or tetrahydrofurfuryl, an alkoxyl group having from 1 to 10 carbon atoms, preferably from 1 to 8 carbon atoms (for example, methoxy, ethoxy, 2-methoxyethoxy, 2-hydroxyethoxy or 2-phenylethoxy), an aryloxy group having from 6 to 20 carbon atoms, preferably from 6 to 12 carbon atoms, more preferably from 6 to 10 carbon atoms (for example, phenoxy, p-methylphenoxy, p-chlorophenoxy or naphthoxy), a heterocyclyloxy group (which means an oxy group substituted by a heterocyclic group) having from 1 to 20 carbon atoms, preferably from 3 to 12 carbon atoms, more preferably from 3 to 10 carbon atoms (for example, 2-thienyloxy or 2-morpholinoxy) and an amino group having from 0 to 20 carbon atoms, preferably from 0 to 12 carbon atoms, more preferably from 0 to 8 carbon atoms (for example, amino, methylamino, dimethylamino, ethylamino, diethylamino,-hydroxyethylamino, benzylamino, anilino, diphenylamino, ring-formed morpholino or pyrrolidino). These may be further substituted by W described above.

More preferred are methyl, ethyl and hydroxyethyl, and particularly preferred is methyl.

The acid group, for example, a carboxyl group or a dissociative nitrogen atom, may be showed either in the non-dissociated form (COOH or NH) or in the dissociated form ($COO^-$ or $N^-$). Actually, the acid group becomes either a dissociated state or a non-dissociated state, depending on the circumstances such as the pH under which a dye is placed.

When an anion exists as a counter ion, for example, it may be written as ($COO^-Na^+$) or ($N^-Na^+$). In the non-dissociated state, it is written as (COOH) or (NH). However, considering a cationic compound of the counter ion as a proton, it is also possible to write it as ($COO^-H^+$) or ($N^-H^+$).

In the methine dye represented by general formula (I), it is particularly preferred that at least one of $R^1$ and $R^2$ is an alkyl group substituted by an acid group other than a sulfo group. Most preferably, one of $R^1$ and $R^2$ is an alkyl group substituted by an acid group other than a sulfo group and the other is an alkyl group substituted by a sulfo group. In the above, the sulfo group-containing alkyl group is preferably a 3-sulfopropyl group, a 4-sulfobutyl group, a 3-sulfobutyl group or a 2-sulfoethyl group, and more preferably a 3-sulfopropyl group.

The alkyl group substituted by an acid group other than a sulfo group is preferably an alkyl group substituted by a carboxyl group, a —$CONHSO_2$— group, an —$SO_2NHCO$— group, a —CONHCO— group or an —$SO_2NHSO_2$— group, and particularly preferably a carboxymethyl group or a methane sulfonyl carbamoyl methyl group.

The combination of $R^1$ and $R^2$ is preferably a combination of a carboxymethyl group or a methanesulfonylcarbamoylmethyl group and a 3-sulfopropyl group, a 4-sulfobutyl group, a 3-sulfobutyl group or a 2-sulfoethyl group, and more preferably a combination of a carboxymethyl group or a methanesulfonylcarbamoylmethyl group and a 3-sulfopropyl group.

$L^1$, $L^2$ and $L^3$ each represents a methine group, and may be unsubstituted or substituted by a substituent group (for example, W described above). preferred examples of the substituent groups include an aryl group, an unsaturated hydrocarbon group, a carboxyl group, a sulfo group, a sulfato group, a cyano group, a halogen atom (for example, fluorine, chlorine, bromine or iodine), a hydroxyl group, a mercapto group, an alkoxyl group, an aryloxy group, an alkylthio group, an arylthio group, an acyl group, an alkoxycarbonyl group, an aryloxycarbonyl group, an acyloxy group, a carbamoyl group, a sulfamoyl group, a heterocyclic group, an alkanesulfonylcarbamoyl group, an acylcarbamoyl group, an acylsulfamoyl group and an alkanesulfonylsulfamoyl group. $n^1$ represents 0 or 1. When $n^1$ is 0, $L^1$ is preferably an unsubstituted methine group. When $n^1$ is 1, $L^1$ and $L^3$ are each preferably an unsubstituted methine group, and $L^2$ is preferably a methine group substituted by an unsubstituted alkyl group (for example, methyl, ethyl or propyl), more preferably a methine group substituted by ethyl.

$M^1$ represents a counter ion. When necessary for neutralizing an ionic charge of a dye, $M^1$ is contained in the formula for indicating the presence of a cation or an anion. It depends on the substituent group and the circumstances in a solution (such as the pH) whether a certain dye is a cation or an anion, or whether it has a net ionic charge or not. Typical examples of the cations include inorganic cations such as a hydrogen ion ($H^+$), an alkali metal ion (for example, a sodium ion, a potassium ion or a lithium ion) and an alkali earth metal ion (for example, a calcium ion), and organic cations such as an ammonium ion (for example, an ammonium ion, a tetraalkylammonium ion, a triethylammonium ion, a pyridinium ion, an ethylpyridinium ion or a 1,8-diazabicyclo[5.4.0]-7-undecenium ion). The anions, which may be either inorganic anions or organic anions, include a halide anion (for example, a fluoride ion, a chloride ion, a bromide ion or an iodide ion), a substituted arylsulfonate ion (for example, a p-toluenesulfonate ion or a p-chlorobenzenesulfonate ion), an aryldisulfonate ion (for example, a 1,3-benzenedisulfonate ion, a 1,5-naphthalenedisulfonate ion or a 2,6-naphthalenedisulfonate ion) an alkylsulfate ion (for example, methylsulfate ion), a sulfate ion, a thiocyanate ion, a perchlorate ion, a tetrafluoroborate ion, a picrate ion, an acetate ion and a trifluoromethanesulfonate ion. Further, an ionic polymer or another dye having the charge reverse to that of the dye may also be used. The cation is preferably a sodium ion, a potassium ion, a triethylammonium ion, a tetraethylammonium ion, a pyridinium ion, an ethylpyridinium ion or a methylpyridinium ion. The anion is preferably a perchlorate ion, an iodide ion, a bromide ion or a substituted arylsulfonate ion (for example, p-toluenesulfonate ion).

$m^1$ represents a number of 0 or more necessary for balancing a charge, and when an internal salt is formed, it is 0. It is preferably a number of from 0 to 4.

The methine dye represented by the above-mentioned general formula (I) is more preferably represented by general formula (II), (III), (IV) or (V).

In general formula (II), $Y^{11}$ represents an oxygen atom, a sulfur atom or N—$R^{13}$, wherein $R^{13}$ represents a hydrogen atom, an unsubstituted alkyl group or a substituted alkyl group (for example, an alkyl group substituted by W described above). The substituent group of the substituted alkyl group is preferably a substituent group higher in hydrophilicity than an iodine atom, more preferably a substituent group having hydrophilicity equal to or higher than that of a chlorine atom, and particularly preferably a substituent group having hydrophilicity equal to or higher than that of a fluorine atom. $R^{13}$ is more preferably a hydrogen atom or an unsubstituted alkyl group, and particularly preferably a hydrogen atom or a methyl group. It is particularly preferred that $Y^{11}$ is a sulfur atom.

$X^{11}$ and $X^{12}$ each represents an oxygen atom or a sulfur atom. At least one thereof is preferably a sulfur atom, and both are preferably sulfur atoms.

$V^{11}$, $V^{12}$, $V^{13}$, $V^{14}$, $V^{15}$ and $V^{16}$ each represents a hydrogen atom or a monovalent substituent group. Two adjacent substituent groups of $V^{11}$, $V^{12}$, $V^{13}$ and $V^{14}$, or $V^{15}$ and $V^{16}$ may combine with each other to form a saturated or unsaturated condensed ring. However, it is better that no condensed ring is formed. Although the monovalent substituent groups include W described above, preferred is an alkyl group (for example, methyl), an aryl group (for example, phenyl), an aromatic heterocyclic group (for example, 1-pyrrolyl), an alkoxyl group (for example, methoxy), an alkylthio group (for example, methylthio), a cyano group, an acyl group (for example, acetyl), an alkoxycarbonyl group (for example, methoxycarbonyl) or a halogen atom (for example, fluorine, chlorine, bromine or iodine), more preferred is a methyl group, a methoxy group, a cyano group or a halogen atom, still more preferred is a halogen atom, particularly preferred is fluorine, chlorine or bromine, and most preferred is chlorine. $V^{11}$, $V^{12}$ and $V^{14}$ are each preferably a hydrogen atom.

When $Y^{11}$ is a sulfur atom, at least one of $V^{15}$ and $V^{16}$ is preferably a halogen atom (for example, fluorine, chlorine, bromine or iodine). More preferably, $V^{16}$ is a hydrogen atom, and $V^{15}$ is fluorine, chlorine or bromine, particularly preferably chlorine.

Although $R^{11}$ and $R^{12}$ each represents an alkyl group substituted by an acid group, at least one of $R^{11}$ and $R^{12}$, which are alkyl groups each substituted by an acid group as with $R^1$ described above, is preferably an alkyl group substituted by an acid group other than a sulfo group. More preferably, one of $R^{11}$ and $R^{12}$ is an alkyl group substituted by an acid group other than a sulfo group (preferably a carboxyl group or an alkanesulfonylcarbamoyl group) and the other is an alkyl group substituted by a sulfo group. Specific examples and preferred combinations of these alkyl groups each substituted by an acid group are the same as with $R^1$ described above. Still more preferably, one of $R^{11}$ and $R^{12}$ is a carboxymethyl group or a methanesulfonylcarbamoylmethyl group. Particularly preferably, $R^{11}$ is a carboxymethyl group or a methanesulfonylcarbamoylmethyl group, and $R^{12}$ is a 3-sulfopropyl group.

$M^{11}$ represents a counter ion, and $m^{11}$ represents a number of 0 or more necessary for neutralizing a charge in a molecule. $M^{11}$ and $m^{11}$ are the same as with $M^1$ and $m^1$ described above. $M^{11}$ is particularly preferably a cation, and preferred examples of the cations include sodium, potassium, triethylammonium, pyridinium and N-ethylpyridinium.

In general formula (III), $Y^{21}$ represents an oxygen atom, a sulfur atom or N—$R^{23}$, wherein $R^{23}$ represents a hydrogen atom, an unsubstituted alkyl group or a substituted alkyl group (for example, an alkyl group substituted by W described above). The substituent group of the substituted alkyl group is preferably a substituent group higher in hydrophilicity than an iodine atom, more preferably a substituent group having hydrophilicity equal to or higher than that of a chlorine atom, and particularly preferably a substituent group having hydrophilicity equal to or higher than that of a fluorine atom. $R^{23}$ is more preferably a hydrogen atom or an unsubstituted alkyl group, and particularly preferably a hydrogen atom or a methyl group. It is particularly preferred that $Y^{21}$ is a sulfur atom.

$X^{21}$ and $X^{22}$ each represents an oxygen atom or a sulfur atom. At least one thereof is preferably a sulfur atom, and both are preferably sulfur atoms.

$V^{21}$, $V^{22}$, $V^{23}$, $V^{24}$, $V^{25}$ and $V^{26}$ each represents a hydrogen atom or a monovalent substituent group. Two adjacent substituent groups of $V^{21}$, $V^{22}$, $V^{23}$ and $V^{24}$, or $V^{25}$ and $V^{26}$ may combine with each other to form a saturated or unsaturated condensed ring. However, it is better that no condensed ring is formed. Although the monovalent substituent groups include W described above, preferred is an alkyl group (for example, methyl), an aryl group (for example, phenyl), an aromatic heterocyclic group (for example, 1-pyrrolyl), an alkoxyl group (for example, methoxy), an alkylthio group (for example, methylthio), a cyano group, an acyl group (for example, acetyl), an alkoxycarbonyl group (for example, methoxycarbonyl) or a halogen atom (for example, fluorine, chlorine, bromine or iodine), more preferred is a methyl group, a methoxy group, a cyano group or a halogen atom, still more preferred is a halogen atom, particularly preferred is fluorine, chlorine or bromine, and most preferred is chlorine. $V^{21}$, $V^{22}$ and $V^{24}$ are each preferably a hydrogen atom.

When $Y^{21}$ is a sulfur atom, at least one of $V^{25}$ and $V^{26}$ is preferably a halogen atom (for example, fluorine, chlorine, bromine or iodine). More preferably, $V^{26}$ is a hydrogen atom, and $V^{25}$ is fluorine, chlorine or bromine, particularly preferably chlorine.

Although $R^{21}$ and $R^{22}$ each represents an alkyl group substituted by an acid group, at least one of $R^{21}$ and $R^{22}$, which are alkyl groups each substituted by an acid group as with $R^1$ described above, is preferably an alkyl group substituted by an acid group other than a sulfo group. More preferably, one of $R^{21}$ and $R^{22}$ is an alkyl group substituted by an acid group other than a sulfo group (preferably a carboxyl group or an alkanesulfonylcarbamoyl group) and the other is an alkyl group substituted by a sulfo group. Specific examples and preferred combinations of these alkyl groups each substituted by an acid group are the same as with $R^1$ described above. Still more preferably, one of $R^{21}$ and $R^{22}$ is a carboxymethyl group or a methanesulfonylcarbamoylmethyl group. Particularly preferably, $R^{21}$ is a carboxymethyl group or a methanesulfonylcarbamoylmethyl group, and $R^{22}$ is a 3-sulfopropyl group.

$M^{21}$ represents a counter ion, and $m^{21}$ represents a number of 0 or more necessary for neutralizing a charge in a molecule. $M^{21}$ and $m^{21}$ are the same as with $M^1$ and $m^1$ described above. $M^{21}$ is particularly preferably a cation, and preferred examples of the cations include sodium, potassium, triethylammonium, pyridinium and N-ethylpyridinium.

In general formula (IV), $Y^{31}$ represents an oxygen atom, a sulfur atom or N—$R^{33}$, wherein $R^{33}$ represents a hydrogen atom, an unsubstituted alkyl group or a substituted alkyl group (for example, an alkyl group substituted by W described above). The substituent group of the substituted alkyl group is preferably a substituent group higher in hydrophilicity than an iodine atom, more preferably a substituent group having hydrophilicity equal to or higher than that of a chlorine atom, and particularly preferably a substituent group having hydrophilicity equal to or higher than that of a fluorine atom. $R^{33}$ is more preferably a hydrogen atom or an unsubstituted alkyl group, and particularly preferably a hydrogen atom or a methyl group. It is particularly preferred that $Y^{31}$ is a sulfur atom.

$X^{31}$ and $X^{32}$ each represents an oxygen atom or a sulfur atom. At least one thereof is preferably a sulfur atom, and both are preferably sulfur atoms.

$V^{31}$, $V^{32}$, $V^{33}$, $V^{34}$, $V^{35}$ and $V^{36}$ each represents a hydrogen atom or a monovalent substituent group. Two adjacent substituent groups of $V^{31}$, $V^{32}$, $V^{33}$ and $V^{34}$, or $V^{35}$ and $V^{36}$ may combine with each other to form a saturated or unsaturated condensed ring. However, it is better that no condensed ring is formed. Although the monovalent substituent groups include W described above, preferred is an alkyl group (for example, methyl), an aryl group (for example, phenyl), an aromatic heterocyclic group (for example, 1-pyrrolyl), an alkoxyl group (for example, methoxy), an alkylthio group (for example, methylthio), a cyano group, an acyl group (for example, acetyl), an alkoxycarbonyl group (for example, methoxycarbonyl) or a halogen atom (for example, fluorine, chlorine, bromine or iodine), more preferred is a methyl group, a methoxy group, a cyano group or a halogen atom, still more preferred is a halogen atom, particularly preferred is fluorine, chlorine or bromine, and most preferred is chlorine. $V^{21}$, $V^{22}$ and $V^{24}$ are each preferably a hydrogen atom.

When $Y^{31}$ is a sulfur atom, at least one of $V^{35}$ and $V^{36}$ is preferably a halogen atom (for example, fluorine, chlorine, bromine or iodine). More preferably, $V^{36}$ is a hydrogen atom, and $V^{35}$ is fluorine, chlorine or bromine, particularly preferably chlorine.

Although $R^{31}$ and $R^{32}$ each represents an alkyl group substituted by an acid group, at least one of $R^{31}$ and $R^{32}$, which are alkyl groups each substituted by an acid group as with $R^1$ described above, is preferably an alkyl group substituted by an acid group other than a sulfo group. More preferably, one of $R^{31}$ and $R^{32}$ is an alkyl group substituted by an acid group other than a sulfo group (preferably a carboxyl group or an alkanesulfonylcarbamoyl group) and the other is an alkyl group substituted by a sulfo group. Specific examples and preferred combinations of these alkyl groups each substituted by an acid group are the same as with $R^1$ described above. Still more preferably, one of $R^{31}$ and $R^{32}$ is a carboxymethyl group or a methanesulfonylcarbamoylmethyl group. Particularly preferably, $R^{31}$ is a carboxymethyl group or a methanesulfonylcarbamoylmethyl group, and $R^{32}$ is a 3-sulfopropyl group.

$M^{31}$ represents a counter ion, and $m^{31}$ represents a number of 0 or more necessary for neutralizing a charge in a molecule. $M^{31}$ and $m^{31}$ are the same as with $M^1$ and $m^1$ described above. $M^{31}$ is particularly preferably a cation, and preferred examples of the cations include sodium, potassium, triethylammonium, pyridinium and N-ethylpyridinium.

In general formula (V), $Y^{41}$ represents an oxygen atom, a sulfur atom or N—$R^{43}$, wherein $R^{43}$ represents a hydrogen atom, an unsubstituted alkyl group or a substituted alkyl group (for example, an alkyl group substituted by W described above). The substituent group of the substituted alkyl group is preferably a substituent group higher in hydrophilicity than an iodine atom, more preferably a substituent group having hydrophilicity equal to or higher than that of a chlorine atom, and particularly preferably a substituent group having hydrophilicity equal to or higher than that of a fluorine atom. $R^{43}$ is more preferably a hydrogen atom or an unsubstituted alkyl group, and particularly preferably a hydrogen atom or a methyl group. It is particularly preferred that $Y^{41}$ is a sulfur atom.

$X^{41}$ and $X^{42}$ each represents an oxygen atom or a sulfur atom. At least one thereof is preferably a sulfur atom, and both are preferably sulfur atoms.

$V^{41}$, $V^{42}$, $V^{43}$, $V^{44}$, $V^{45}$ and $V^{46}$ each represents a hydrogen atom or a monovalent substituent group. Two adjacent substituent groups of $V^{41}$, $V^{42}$, $V^{43}$ and $V^{44}$, or $V^{45}$ and $V^{46}$ may combine with each other to form a saturated or unsaturated condensed ring. However, it is better that no condensed ring is formed. Although the monovalent substituent groups include W described above, preferred is an alkyl group (for example, methyl), an aryl group (for example, phenyl), an aromatic heterocyclic group (for example, 1-pyrrolyl), an alkoxyl group (for example, methoxy), an alkylthio group (for example, methylthio), a cyano group, an acyl group (for example, acetyl), an alkoxycarbonyl group (for example, methoxycarbonyl) or a halogen atom (for example, fluorine, chlorine, bromine or iodine), more preferred is a methyl group, a methoxy group, a cyano group or a halogen atom, still more preferred is a halogen atom, particularly preferred is fluorine, chlorine or bromine, and most preferred is chlorine. $V^{41}$, $V^{42}$ and $V^{44}$ are each preferably a hydrogen atom.

When $Y^{41}$ is a sulfur atom, at least one of $V^{45}$ and $V^{46}$ is preferably a halogen atom (for example, fluorine, chlorine, bromine or iodine). More preferably, $V^{46}$ is a hydrogen atom, and $V^{45}$ is fluorine, chlorine or bromine, particularly preferably chlorine.

Although $R^{41}$ and $R^{42}$ each represents an alkyl group substituted by an acid group, at least one of $R^{41}$ and $R^{42}$, which are alkyl groups each substituted by an acid group as with $R^1$ described above, is preferably an alkyl group substituted by an acid group other than a sulfo group. More preferably, one of $R^{41}$ and $R^{42}$ is an alkyl group substituted by an acid group other than a sulfo group (preferably a carboxyl group or an alkanesulfonylcarbamoyl group) and the other is an alkyl group substituted by a sulfo group. Specific examples and preferred combinations of these alkyl groups each substituted by an acid group are the same as with $R^1$ described above. Still more preferably, one of $R^{41}$ and $R^{42}$ is a carboxymethyl group or a methanesulfonylcarbamoylmethyl group. Particularly preferably, $R^{41}$ is a carboxymethyl group or a methanesulfonylcarbamoylmethyl group, and $R^{42}$ is a 3-sulfopropyl group.

$M^{41}$ represents a counter ion, and $m^{41}$ represents a number of 0 or more necessary for neutralizing a charge in a molecule. $M^{41}$ and $m^{41}$ are the same as with $M^1$ and $m^1$ described above. $M^{41}$ is particularly preferably a cation, and preferred examples of the cations include sodium, potassium, triethylammonium, pyridinium and N-ethylpyridinium.

When the dye represented by general formula (I) is used in a blue-sensitive emulsion layer, the dye represented by general formula (II) or (III) is selected, and the dye represented by general formula (II) is more preferred.

$X^{11}$, $X^{12}$ and $Y^{13}$ ($X^{21}$, $X^{22}$ and $Y^{21}$) are all preferably sulfur atoms. $V^{15}$ ($V^{25}$) is preferably a chlorine atom or a bromine atom, and $V^{16}$ ($V^{26}$) is preferably a hydrogen atom. $V^{11}$, $V^{12}$ and $V^{14}$ ($V^{21}$, $V^{22}$ and $V^{24}$) are each preferably a hydrogen atom, and $V^{13}$ ($V^{23}$) is an alkyl group (for example, methyl), an alkoxyl group (for example, methoxy), an alkylthio group (for example, methylthio), a cyano group, an acyl group (for example, acetyl), an alkoxycarbonyl group (for example, methoxycarbonyl) or a halogen atom (for example, fluorine, chlorine, bromine or iodine), more preferably a methyl group, a methoxy group, a cyano group, an acetyl group, a methoxycarbonyl group or a halogen atom, particularly preferably a halogen atom, and most preferably fluorine or chlorine.

It is preferred that one of $R^{11}$ and $R^{12}$ ($R^{21}$ and $R^{22}$) is a carboxymethyl group or a methanesulfonylcarbamoylmethyl group, and that the other is a 3-sulfopropyl group. Particularly preferably, $R^{11}$ ($R^{21}$) is a carboxymethyl group or a methanesulfonylcarbamoylmethyl group, and $R^{12}$ ($R^{22}$) is a 3-sulfopropyl group.

$M^{11}$ ($M^{21}$) is preferably an organic or inorganic monovalent cation, and $m^{11}$ ($m^{21}$) is preferably 0 or 1.

When the dye represented by general formula (I) is used in a green-sensitive emulsion layer, the dye represented by general formula (IV) or (V) ($A^{31}$($A^{41}$) is preferably an ethyl group) is selected, and the dye represented by general formula (IV) is more preferred.

$Y^{31}$ ($Y^{41}$) is preferably a sulfur atom, $X^{31}$ and $X^{32}$ ($X^{41}$ and $X^{42}$) are both preferably oxygen atoms. $V^{35}$ ($V^{45}$) is preferably a chlorine atom or a bromine atom, and $V^{36}$ ($V^{46}$) is preferably a hydrogen atom. $V^{31}$, $V^{32}$ and $V^{34}$ ($V^{41}$, $V^{42}$ and $V^{44}$ ) are each preferably a hydrogen atom, and $V^{33}$ ($V^{43}$) is an alkyl group (for example, methyl), an alkoxyl group (for example, methoxy), an alkylthio group (for example, methylthio), a cyano group, an acyl group (for example, acetyl), an alkoxycarbonyl group (for example, methoxycarbonyl) or a halogen atom (for example, fluorine, chlorine, bromine or iodine), more preferably a methyl group, a methoxy group, a cyano group, an acetyl group, a methoxycarbonyl group or a halogen atom, particularly preferably a halogen atom, and most preferably fluorine or chlorine.

It is preferred that one of $R^{31}$ and $R^{32}$ ($R^{41}$ and $R^{42}$) is a carboxymethyl group or a methanesulfonylcarbamoylmethyl group, and that the other is a 3-sulfopropyl group. Particularly preferably, $R^{31}$ ($R^{41}$) is a carboxymethyl group or a methanesulfonylcarbamoylmethyl group, and $R^{32}$ ($R^{42}$) is a 3-sulfopropyl group.

$M^{31}$ ($M^{41}$) is preferably an organic or inorganic monovalent cation, and $m^{31}$ ($m^{41}$) is preferably 0 or 1.

When the dye represented by general formula (I) is used in a red-sensitive emulsion layer, the dye represented by general formula (IV) or (V) ($A^{31}$ ($A^{41}$) is preferably an ethyl group) is selected, and the dye represented by general formula (IV) is more preferred.

$Y^{31}$ ($Y^{41}$) is preferably a sulfur atom, one of $X^{31}$ and $X^{32}$ ($X^{41}$ and $X^{42}$) is preferably an oxygen atom and the other is preferably a sulfur atom. $V^{35}$ ($V^{45}$) is preferably a chlorine atom or a bromine atom, and $V^{36}$ ($V^{46}$) is preferably a hydrogen atom. $V^{31}$, $V^{32}$ and $V^{34}$ ($V^{41}$, $V^{42}$ and $V^{44}$) are each preferably a hydrogen atom, and $V^{33}$ ($V^{43}$) is an alkyl group (for example, methyl), an alkoxyl group (for example, methoxy), an alkylthio group (for example, methylthio), a cyano group, an acyl group (for example, acetyl), an alkoxycarbonyl group (for example, methoxycarbonyl) or a halogen atom (for example, fluorine, chlorine, bromine or iodine), more preferably a methyl group, a methoxy group, a cyano group, an acetyl group, a methoxycarbonyl group or a halogen atom, particularly preferably a halogen atom, and most preferably fluorine or chlorine.

It is preferred that one of $R^{31}$ and $R^{32}$ ($R^{41}$ and $R^{42}$) is a carboxymethyl group or a methanesulfonylcarbamoylmethyl group, and that the other is a 3-sulfopropyl group. Particularly preferably, $R^{31}$ ($R^{41}$) is a carboxymethyl group or a methanesulfonylcarbamoylmethyl group, and $R^{32}$ ($R^{42}$) is a 3-sulfopropyl group.

$M^{31}$ ($M^{41}$) is preferably an organic or inorganic monovalent cation, and $m^{31}$ ($m^{41}$) is preferably 0 or 1.

Specific examples of the methine dyes represented by general formulas (I), (II), (III), (IV) and (V) of the present invention are shown below, but the scope of the present invention is not limited thereby.

S-1

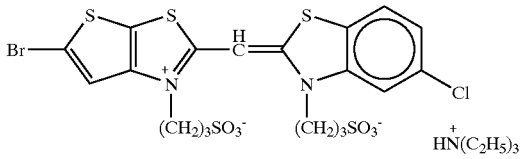

S-2

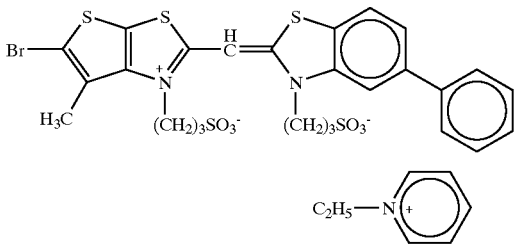

S-3

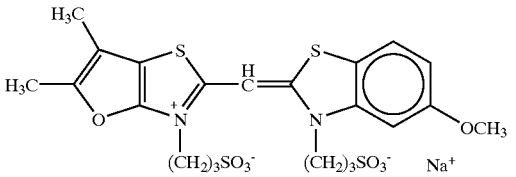

S-4

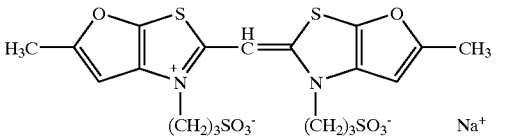

S-5

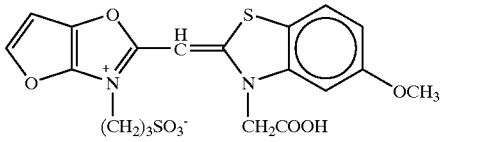

-continued

S-6

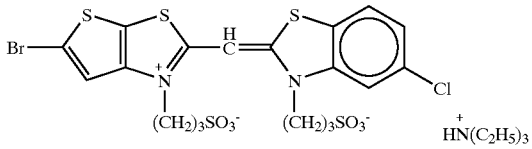

S-7

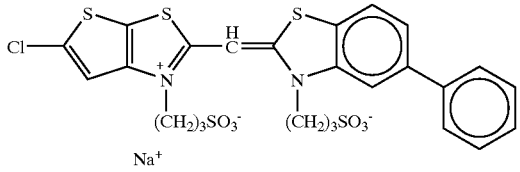

S-8

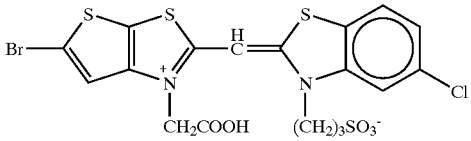

S-9

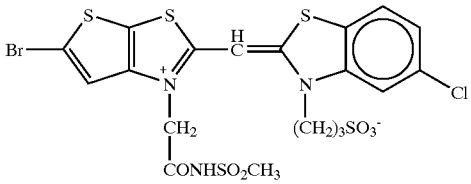

S-10

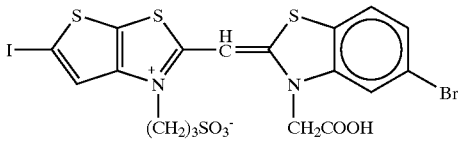

S-11

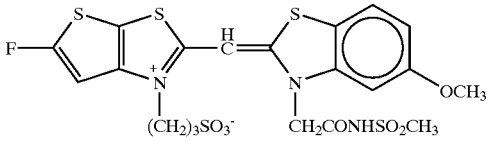

S-12

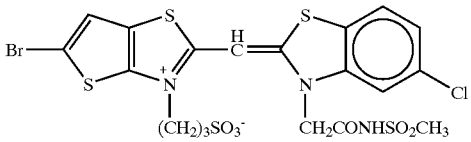

S-13

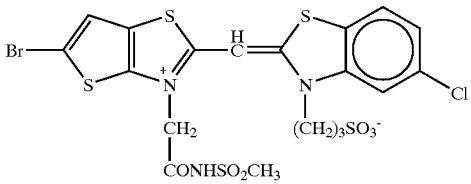

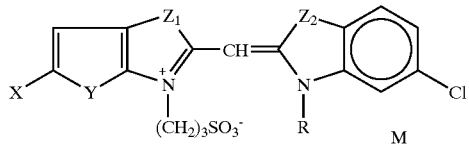

| | X | Y | $Z_1$ | $Z_2$ | R | M |
|---|---|---|---|---|---|---|
| S-14 | Cl | O | S | S | $CH_2CO_2H$ | — |
| S-15 | Cl | NH | S | S | $CH_2CONHSO_2CH_3$ | — |

-continued
| | | | | | | |
|---|---|---|---|---|---|---|
| S-16 | Br | S | O | S | $(CH_2)_3SO^-_3$ | $\overset{+}{H}N(C_2H_5)_3$ |
| S-17 | Br | O | S | S | $CH_2CO_2H$ | — |
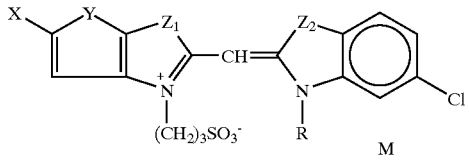
M
| | X | Y | $Z_1$ | $Z_2$ | R | M |
|---|---|---|---|---|---|---|
| S-18 | Cl | S | O | S | $CH_2CO_2H$ | — |
| S-19 | H | NH | S | S | $(CH_2)_3SO^-_3$ | $\overset{+}{H}N(C_2H_5)_3$ |
| S-20 | Cl | NH | S | S | $CH_2SO_2NHCOCH_3$ | — |
| S-21 | Br | O | S | S | $CH_2CO_2H$ | — |
| S-22 | Cl | N—$CH_3$ | S | O | $(CH_2)_4SO^-_3$ | $\overset{+}{H}N(C_2H_5)_3$ |
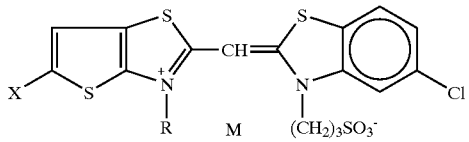
M
| | X | R | M |
|---|---|---|---|
| S-23 | Cl | $(CH_2)_3SO^-_3$ | $\overset{+}{H}N(C_2H_5)_3$ |
| S-24 | Cl | $CH_2CONHSO_2CH_3$ | — |
| S-25 | Cl | $CH_2CO_2H$ | — |
| S-26 | Br | $CH_2CO_2H$ | — |
S-27
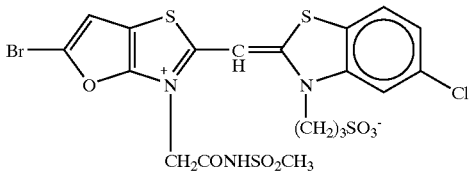
S-28
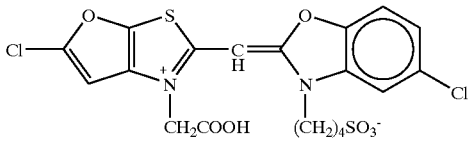
S-29
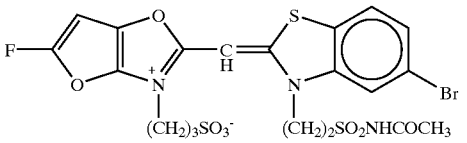
S-30
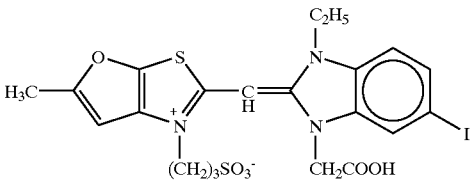
-continued
S-31
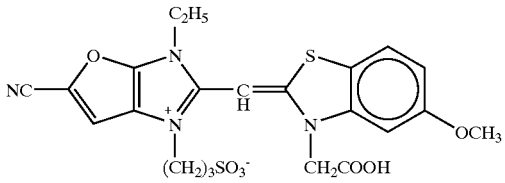
S-32
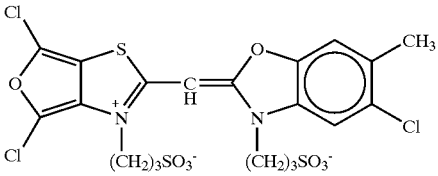
$K^+$
S-33
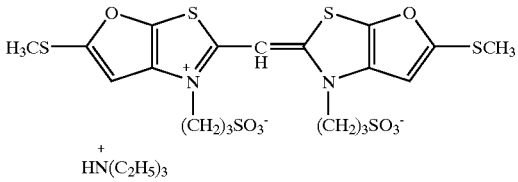
S-34
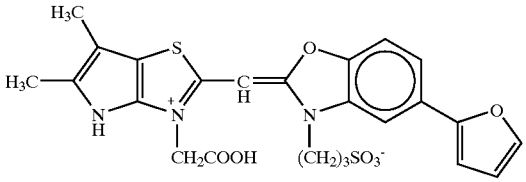
S-35
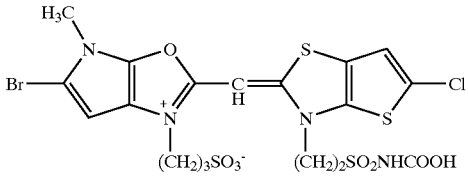
S-36
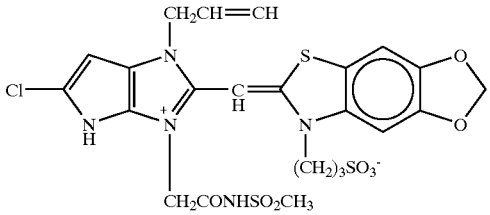
S-37
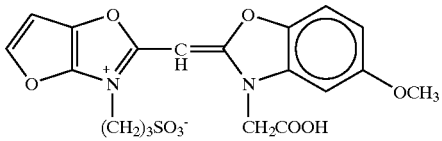
S-38
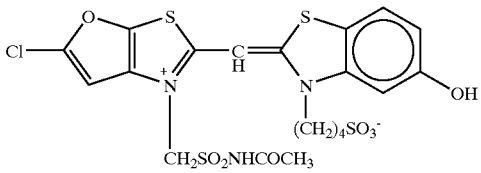

-continued

S-39

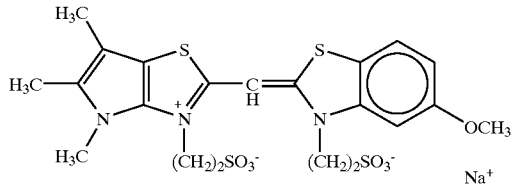

S-40

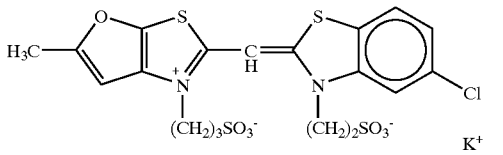

S-41

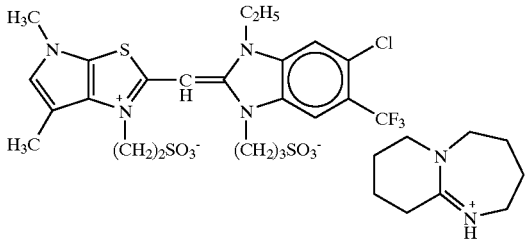

S-42

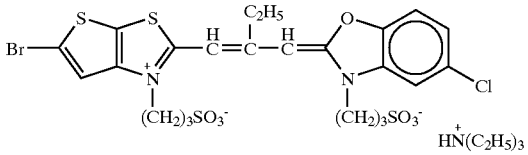

S-43

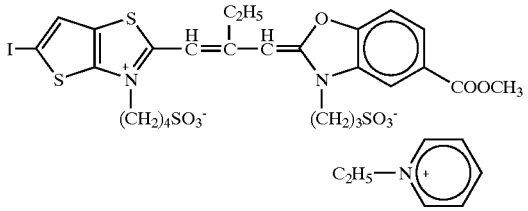

S-44

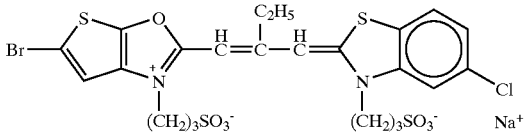

S-45

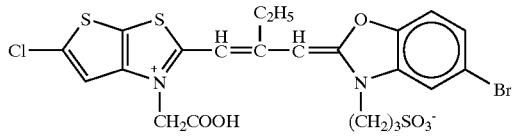

S-46

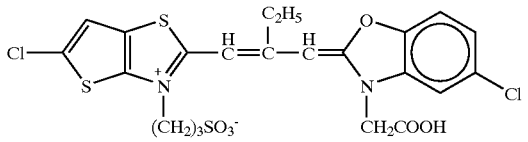

-continued

S-47

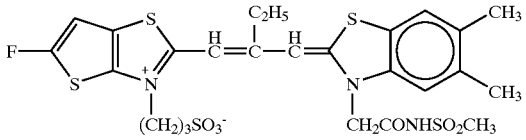

S-48

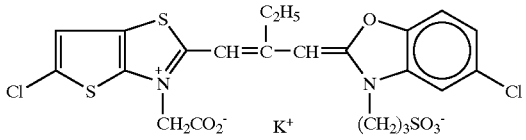

S-49

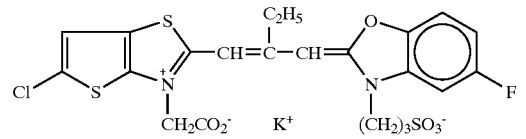

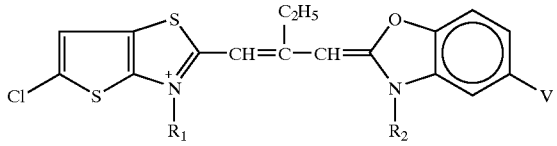

| | $R_1$ | $R_2$ | V |
|---|---|---|---|
| S-50 | $CH_2CONHSO_2CH_3$ | $(CH_2)_3SO_3^-$ | Br |
| S-51 | " | " | Cl |
| S-52 | " | " | F |
| S-53 | $(CH_2)_3SO_3^-$ | $CH_2CO_2H$ | Cl |
| S-54 | " | " | Br |
| S-55 | " | " | F |
| S-56 | $CH_2CO_2H$ | $(CH_2)_3SO_3^-$ | Br |

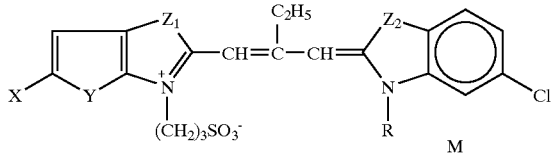

| | X | Y | $Z_1$ | $Z_2$ | R | M |
|---|---|---|---|---|---|---|
| S-57 | F | Y | S | S | $CH_2CO_2H$ | — |
| S-58 | Br | O | O | S | $(CH_2)_3SO^-_3$ | $\overset{+}{H}N(C_2H_5)_3$ |
| S-59 | Cl | S | O | S | $CH_2CONHSO_2CH_3$ | — |
| S-60 | Cl | NH | O | O | $CH_2CO_2H$ | — |
| S-61 | Cl | S | S | O | $(CH_2)_3SO^-_3$ | $K^+$ |
| S-62 | Br | S | S | O | $(CH_2)_3SO^-_3$ | $K^+$ |
| S-63 | Cl | S | O | O | $(CH_2)_3SO^-_3$ | $Na^+$ |

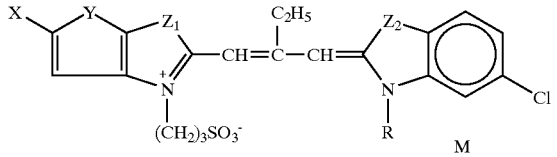

| | X | Y | $Z_1$ | $Z_2$ | R | M |
|---|---|---|---|---|---|---|
| S-64 | Cl | O | S | O | $CH_2CO_2H$ | — |
| S-65 | Br | O | S | S | $(CH_2)_3SO^-_3$ | $K^+$ |
| S-66 | H | NH | S | O | $CH_2CO_2H$ | — |
| S-67 | Cl | NH | S | O | $CH_2CONHSO_2CH_3$ | — |
| S-68 | Cl | N—$CH_3$ | O | S | $CH_2CO_2H$ | — |

-continued

S-69

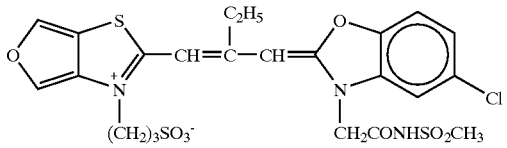

S-70

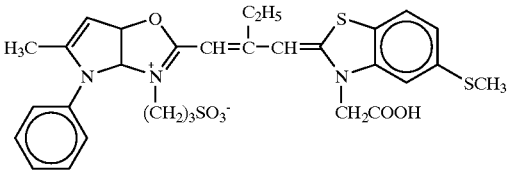

S-71

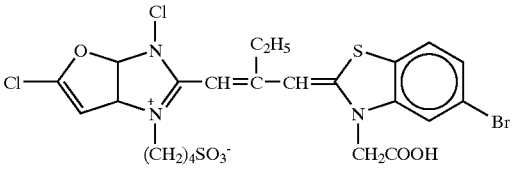

S-72

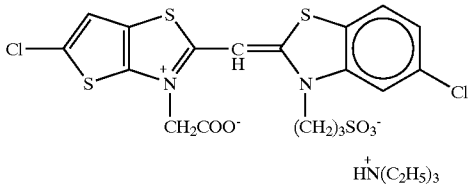

S-73

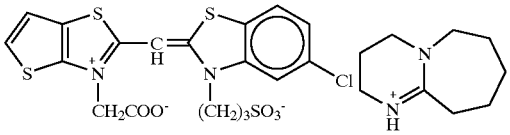

S-74

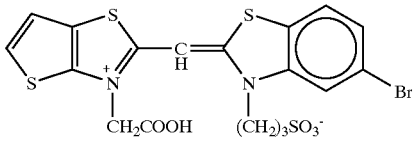

S-75

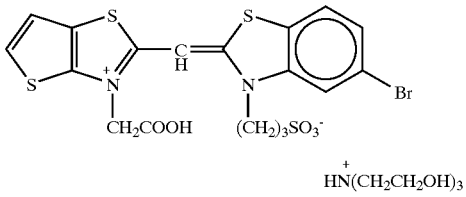

S-76

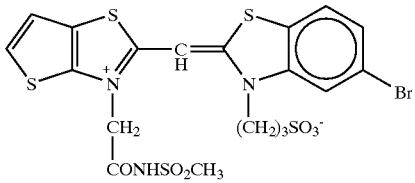

S-77

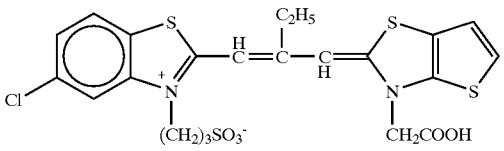

-continued

S-78

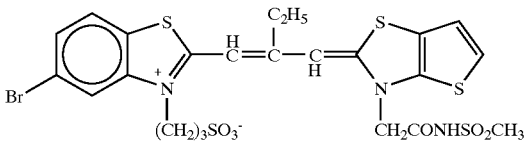

S-79

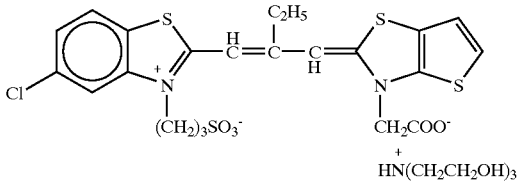

S-80

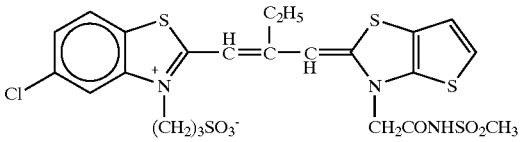

The methine dyes of general formulas (I), (II), (III), (IV) and (V) used in the present invention can be synthesized based on methods described in the following literatures:

a) F. M. Hamer, "Heterocyclic Compounds-Cyan dyes and related compounds" (John Wiley & Sons, New York, London, 1964);

b) D. M. Sturmer, "Heterocyclic Compounds-Special topics in heterocyclic chemistry" chapter 8, section 4, pages 482 to 515 (John Wiley & Sons, New York, London, 1977); and c) "Rodd's Chemistry of Carbon Compounds", the second edition, volume 4, part B, chapter 15, pages 369 to 422 (Elsevier Science Publishing Company Inc., New York, 1997).

Heterocycles, raw materials for the methine dyes represented by general formulas (I), (II), (III), (IV) and (V) of the present invention, can be synthesized with reference to, for example, descriptions of literatures such as *Bulletin de la Societe Chimique de France*, pages 11 to 150 (1980) and *Journal of Heterocyclic Chemistry,* 16, 1563 (1979).

In adding the methine dyes represented by general formulas (I), (II), (III), (IV) and (V) of the present invention to the silver halide emulsions of the present invention, they may be directly dispersed in the emulsions, or may be added to the emulsions as solutions in which they are dissolved in sole or mixed solvents of solvents such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide.

Further, it is also possible to use a method of dissolving a dye in a volatile organic solvent, dispersing the resulting solution in water or a hydrophilic colloid, and adding the resulting dispersion to an emulsion as described in U.S. Pat. No. 3,469,987, a method of dispersing a water-insoluble dye in an aqueous solvent without dissolution, and adding the resulting dispersion to an emulsion as described in Japanese Patent Publication No. 46-24185, a method of dissolving a dye in an acid, and adding the resulting solution to an emulsion or adding it to an emulsion as an aqueous solution in which an acid or a base is allowed to coexist as described in Japanese Patent Publication Nos. 23389/1969, 27555/1969 and 22091/1982, a method of adding to an emulsion an aqueous solution or a colloidal dispersion in which a surfactant is allowed to coexist as described in U.S. Pat. Nos. 3,822,135 and 4,006,026, a method of directly dispersing a dye in a hydrophilic colloid, and adding the resulting dispersion to an emulsion as described in Japanese Patent Laid-Open Nos. 102733/1978 and 105141/1983, and a method of dissolving a dye using a compound allowing a red shift, and adding the resulting solution to an emulsion as described in Japanese Patent (Application) Laid-Open No. 74624/1976. It is also possible to use an ultrasonic wave for dissolving a dye.

The methine dyes represented by general formulas (I), (II), (III), (IV) and (V) of the present invention may be added to the silver halide emulsions of the present invention at any time or during any process of emulsion preparation which has hitherto been recognized to be useful. The methine dyes may be added at any time or during any process before coating of the emulsions from chemical ripening to coating, for example, in the grain formation process of silver halide and/or before desalting, during the desalting process and/or in the time from after desalting to initiation of chemical ripening, as disclosed in U.S. Pat. Nos. 2,735,766, 3,628,960, 4,183,756 and 4,225,666, Japanese Patent Laid-Open Nos. 184142/1983 and 196749/1985, and just before chemical ripening or during the chemical ripening process as disclosed in Japanese Patent Laid-Open No. 113920/1983. The same compound may be added alone or in combination with a compound different in structure, for example, in parts during the grain formation process and during the chemical ripening process or after the completion of chemical ripening, or before chemical ripening or during the chemical ripening process and after the completion of chemical ripening, as disclosed in U.S. Pat. No. 4,225,666 and Japanese Patent Laid-Open No. 7629/1983. The kind of compound added in parts and the combination of compounds may be changed.

Although the amount added of the methine dyes represented by general formulas (I), (II), (III), (IV) and (V) of the present invention varies depending on the form and size of silver halide grains, it is preferably from 0.1 to 4 mmol, and more preferably from 0.2 to 2.5 mmol, per mol of silver halide. Further, the methine dye may be used in combination with another sensitizing dye.

In the present invention, other sensitizing dyes may be used, in addition to the methine dyes represented by general formulas (I), (II), (III), (IV) and (V) of the present invention. The combination of sensitizing dyes is frequently used particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301,3,814,609, 3,837,862 and 4,026,707, British Patents 1,344,281 and 1,507,803, Japanese Patent Publication Nos. 4936/1968 and 12375/1978, Japanese Patent Laid-Open Nos. 110618/1977 and 109925/1977.

The coupler represented by general formula (X) will be described in detail below.

In general formula (X), the term "multimer" means a compound having two or more groups represented by general formula (X) in one molecule, and includes a bis form and a polymer coupler. The polymer coupler used herein may be a homopolymer composed of a monomer having a moiety represented by general formula (X) (preferably having a vinyl group), or may form a copolymer with a non-color forming ethylenic monomer which does not conduct coupling with an oxidant of an aromatic primary amine developing agent.

Although $Z^1$ and $Z^2$ each represents —C($Q^3$)═ or —N═, it is preferred that one is —N═, and that the other is —C($Q^3$)═. More preferably, $Z^2$ is —N═, and $Z^1$ is —C($Q^3$)═.

$Q^1$ and $Q^3$ each represents an alkyl group (preferably a straight chain or branched alkyl group having from 1 to 32 carbon atoms, for example, methyl, ethyl, propyl, isopropyl, butyl, t-butyl, 1-octyl or dodecyl), a cycloalkyl group (preferably a cycloalkyl group having from 3 to 32 carbon atoms, for example, cyclopropyl, cyclopentyl or cyclohexyl), an alkenyl group (preferably an alkenyl group having from 2 to 32 carbon atoms, for example, vinyl, allyl or 3-butene-1-yl), an aryl group (preferably an aryl group having from 6 to 32 carbon atoms, for example, phenyl, 1-naphthyl or 2-naphthyl), a heterocyclic group (preferably a 5- to 8-membered heterocyclic compound having from 1 to 32 carbon atoms, for example, 2-thienyl, 4-pyridyl, 2-furyl, 2-pyrimidinyl, 1-pyridyl, 2-benzothiazolyl, 1-imidazolyl, 1-pyrazolyl or benzothiazole-2-yl), a cyano group, a halogen atom (for example, fluorine, chlorine or bromine), a hydroxyl group, a nitro group, a carboxyl group, an alkoxyl group (preferably an alkoxyl group having from 1 to 32 carbon atoms, for example, methoxy, ethoxy, 1-butoxy, 2-butoxy, isopropoxy, t-butoxy or dodecyloxy), a cycloalkyloxy group (preferably a cycloalkyloxy group having from 3 to 32 carbon atoms, for example, cyclopentyloxy or cyclohexyloxy), an aryloxy group (preferably an aryloxy group having from 6 to 32 carbon atoms, for example, phenoxy or 2-naphthoxy), a heterocyclic oxy group (preferably a heterocyclic oxy group having from 1 to 32 carbon atoms, for example, 1-phenyltetrazole-5-oxy, 2-tetrahydropyranyloxy or 2-furyloxy), a silyloxy group (preferably a silyloxy group having from 1 to 32 carbon atoms, for example, trimethylsilyloxy, t-butyldimethylsilyloxy or diphenylmethyloxy), an acyloxy group (preferably an acyloxy group having from 2 to 32 carbon atoms, for example, acetoxy, pivaloyloxy, benzoyloxy or dodecanoyloxy), an alkoxycarbonyloxy group (preferably an alkoxylcarbonyloxy group having from 2 to 32 carbon atoms, for example, ethoxycarbonyloxy or t-butoxycarbonyloxy), a cycloalkylcarbonyloxy group (preferably a cycloalkylcarbonyloxy group having form 4 to 32 carbon atoms, for example, cyclohexylcarbonyloxy), an aryloxycarbonyloxy group (preferably an aryloxycarbonyloxy group having from 7 to 32 carbon atoms, for example, phenoxycarbonyloxy), a carbamoyloxy (preferably a carbamoyloxy group having from 1 to 32 carbon atoms, for example, N,N-dimethylcarbamoyloxy or N-butylcarbamoyloxy), a sulfamoyloxy group (preferably a sulfamoyloxy group having from 1 to 32 carbon atoms, for example, N,N-diethylsulfamoyloxy or N-propylsulfamoyloxy), an alkanesulfonyloxy group (preferably an alkanesulfonyloxy group having from 1 to 32 carbon atoms, for example, methanesulfonyloxy or hexadecanesulfonyloxy), an arenesulfonyloxy group (preferably an arenesulfonyloxy group having from 6 to 32 carbon atoms, for example, benzenesulfonyloxy), an acyl group (preferably an acyl group having from 1 to 32 carbon atoms, for example, formyl, acetyl, pivaloyl, benzoyl or tetradecanoyl), an alkoxycarbonyl group (preferably an alkoxycarbonyl group having from 2 to 32 carbon atoms, for example, methoxycarbonyl, ethoxycarbonyl or octadecyloxycarbonyl), a cycloalkyloxycarbonyl group (preferably a cycloalkyloxycarbonyl group having from 4 to 32 carbon atoms, for example, cyclohexyloxycarbonyl), an aryloxycarbonyl group (preferably an aryloxycarbonyl group having from 7 to 32 carbon atoms, for example, phenoxycarbonyl), a carbamoyl group (preferably a carbamoyl group having from 1 to 32 carbon atoms, for example, carbamoyl, N,N-dibutylcarbamoyl, N-ethyl-N-octylcarbamoyl or N-propylcarbamoyl), an amino group (preferably an amino group having 32 or less carbon atoms, for example, amino, methylamino, N,N-dioctylamino, tetradecylamino or octadecylamino), an anilino group (preferably an anilino group having from 6 to 32 carbon atoms, for example, anilino or N-methylanilino), a heterocyclic amino group (preferably a heterocyclic amino group having from 1 to 32 carbon atoms, for example, 4-pyridylamino), a carboxylic amido group (preferably a carboxylic amido group having from 2 to 32 carbon atoms, for example, acetamido, benzamido or tetradecaneamido), a ureido group (preferably a ureido group having from 1 to 32 carbon atoms, for example, ureido, N,N-dimethylureido or N-phenylureido), an imido group (preferably an imido group having 10 or less carbon atoms, for example, N-succinimido or N-phthalimido), an alkoxylcarbonylamino group (preferably an alkoxycarbonylamino group having from 2 to 32 carbon atoms, for example, methoxycarbonylamino, ethoxycarbonylamino, t-butoxycarbonylamino or octadecyloxycarbonylamino), an aryloxycarbonylamino group (preferably an aryloxycarbonylamino group having from 7 to 32 carbon atoms, for example, phenoxycarbonylamino), a sulfonamido group (preferably a sulfonamido group having from 1 to 32 carbon atoms, for example, methanesulfonamido, butanesulfonamido, benzenesulfonamido or hexadecanesulfonamido), a sulfamoylamino group (preferably a sulfamoylamino group having from 1 to 32 carbon atoms, for example, N,N-dipropylsulfamoylamino or N-ethyl-N-dodecylsulfamoylamino), an azo group (preferably an azo group having from 1 to 32 carbon atoms, for example, phenylazo), an alkylthio group (preferably an alkylthio group having from 1 to 32 carbon atoms, for example, ethylthio or octylthio), an arylthio group (preferably an arylthio group having from 6 to 32 carbon atoms, for example, phenylthio), a heterocyclic thio group (preferably a heterocyclic thio group having from 1 to 32 carbon atoms, for example, 2-benzothiazolylthio, 2-pyridylthio or 1-phenyltetrazolylthio), an alkanesulfinyl group (preferably an alkylsulfinyl group having from 1 to 32 carbon atoms, for example, dodecanesulfinyl), an arenesulfinyl group (preferably an arenesulfinyl group having from 6 to 32 carbon atoms, for example, benzenesulfinyl), an alkanesulfonyl group (preferably an alkylsulfonyl group having from 1 to 32 carbon atoms, for example, methanesulfonyl or octanesulfonyl), an arenesulfonyl group (preferably an arenesulfonyl group having from 6 to 32 carbon atoms, for example, benzenesulfonyl or 1-naphthalenesulfonyl), a sulfamoyl group (preferably a sulfamoyl group having 32 or less carbon atoms, for example, sulfamoyl, N,N-dipropylsulfamoyl or N-ethyl-N-dodecylsulfamoyl, a sulfo group or a phosphonyl group (preferably a phosphonyl group having from 1 to 32 carbon atoms, for example, phenoxyphosphonyl, octyloxyphosphonyl or phenylphosphonyl).

$Q^2$ represents a hydrogen atom or a group releasable by a reaction with an oxidant of a developing agent. Specifically, the releasable group is a halogen atom, an alkoxyl group, an aryloxy group, an acyloxy group, a carbamoyloxy group, a sulfonyloxy group, a carboxylic amido group, a sulfonamido group, a carbamoylamino group, a heterocyclic group, an arylazo group, an alkylthio group, an arylthio group or a heterocyclic group. Preferred ranges and specific examples of these groups are the same as described for the groups represented by $Q^1$ and $Q^3$. In addition to these, $Q^2$ is a bis type coupler in which two molecules of 4-equivalent coupler are linked by an aldehyde or a ketone, in some cases. Further, $Q^2$ may be a photographic useful group such as a development accelerator, a development inhibitor, a desilvering accelerator or a leuco dye, or a precursor thereof.

The groups represented by $Q^1$, $Q^2$ and $Q^3$ may further have substituent groups. Preferred examples of the substituent groups include a halogen atom, an alkyl group, a cycloalkyl group, an alkenyl group, an aryl group, a heterocyclic group, a cyano group, a hydroxyl group, a nitro group, an alkoxyl group, an aryloxy group, a heterocyclic oxy group, a silyloxy group, an acyloxy group, an alkoxycarbonyloxy group, a cycloalkyloxycarbonyloxy group, aryloxycarbonyloxy group, a carbamoyloxy group, a sulfamoyloxy group, an alkanesulfonyloxy group, an arenesulfonyloxy group, a carboxyl group, an acyl group, an alkoxycarbonyl group, a cycloalkyloxycarbonyl group, an aryloxycarbonyl group, a carbamoyl group, an amino group, an anilino group, a heterocyclic amino group, a carboxylic amido group, an alkoxycarbonylamino group, an aryloxycarbonylamino group, a ureido group, a sulfonamido group, a sulfamoylamino group, an imido group, an alkylthio group, an arylthio group, a heterocyclic thio group, a sulfinyl group, a sulfo group, an alkanesulfonyl group, an arenesulfonyl group, a sulfamoyl group and phosphonyl group.

The coupler represented by general formula (X) may form a multimer of a dimer or more, or a polymer by substituent groups $Q^1$, $Q^2$ or $Q^3$.

$Q^1$ is preferably a secondary or tertiary alkyl group (for example, isopropyl, cyclopropyl, t-butyl or 1-methylcyclopropyl), more preferably a tertiary alkyl group, and particularly preferably a t-butyl group.

$Q^3$ is preferably an alkyl group having from 1 to 32 carbon atoms or an aryl group having from 6 to 32 carbon atoms, and further preferably has a substituent group (for example, a halogen atom, an alkyl group, an aryl group, a heterocyclic group, a cyano group, a hydroxyl group, a nitro group, an alkoxyl group, an aryloxy group, a carboxyl group, an acyl group, an alkoxycarbonyl group, a cycloalkyloxycarbonyl group, an aryloxycarbonyl group, a carbamoyl group, an amino group, an anilino group, a carboxylic amido group, an alkoxycarbonylamino group, an aryloxycarbonylamino group, a ureido group, a sulfonamido group, a sulfamoylamino group, an imido group, an alkylthio group, an arylthio group, a heterocyclic thio group, a sulfinyl group, a sulfo group, an alkanesulfonyl group, an arenesulfonyl group, a sulfamoyl group or phosphonyl group). in particular, it is preferred that the substituent group contains as a substituent group a sulfonamido group, a sulfamoylamino group, a sulfo group, an alkanesulfonyl group or an arenesulfonyl group, containing —$SO_2$—.

$Q^2$ is a hydrogen atom or a coupling release group. The releasing group is preferably a chlorine atom, a bromine atom, an aryloxy group, an alkylthio group, an arylthio group, a heterocyclic thio group or heterocyclic group, more preferably a chlorine atom or an aryloxy group, and most preferably a chlorine atom.

A more preferred form of the coupler represented by general formula (X) is represented by general formula (XI) or (XII).

In formula (XI), $Q^{11}$ represents an alkyl group, which is preferably a secondary or tertiary alkyl group (for example, an isopropyl group, a cyclopropyl group, a t-butyl group or a 1-methylcyclopropyl group), more preferably a tertiary alkyl group, and particularly preferably a t-butyl group. $Q^{12}$ represents a hydrogen atom or a halogen atom. The halogen atom is preferably a chlorine atom or a bromine atom, and most preferably a chlorine atom.

$Q^{13}$ represents a substituent group containing —$SO_2$—, preferably an alkyl group having from 1 to 32 carbon atoms or an aryl group having from 6 to 32 carbon atoms, containing a sulfonamido group, a sulfamoylamino group, an alkanesulfonyl group or an arenesulfonyl group as a substituent group.

In formula (XII), $Q^{21}$ represents an alkyl group, which is preferably a secondary or tertiary alkyl group (for example, an isopropyl group, a cyclopropyl group, a t-butyl group or a 1-methylcyclopropyl), more preferably a tertiary alkyl group, and particularly preferably a t-butyl group.

$Q^{22}$ represents a hydrogen atom or a halogen atom. The halogen atom is preferably a chlorine atom or a bromine atom, and most preferably a chlorine atom.

$Q^{23}$ represents a substituent group containing —$SO_2$—, preferably an alkyl group having from 1 to 32 carbon atoms or an aryl group having from 6 to 32 carbon atoms, containing a sulfonamido group, a sulfamoylamino group, an alkanesulfonyl group or an arenesulfonyl group as a substituent group. The coupler of general formula (X) is most preferably a coupler represented by general formula (XII).

Specific examples of the couplers represented by general formula (X), (XI) or (XII), which can be used in the present invention, are shown below, but the scope of the present invention is not limited thereby. The coupler can also be selected from magenta couplers M-1 to M-30 described in Japanese Patent (Application) Laid-Open No. 109334/1996 and magenta couplers M-1 to M-40 described in Japanese Patent Laid-Open No. 185156/1997, in addition to the following.

M-1

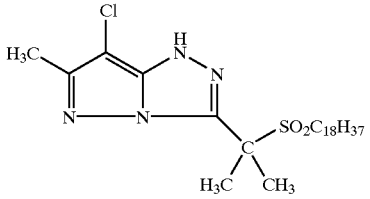

M-2

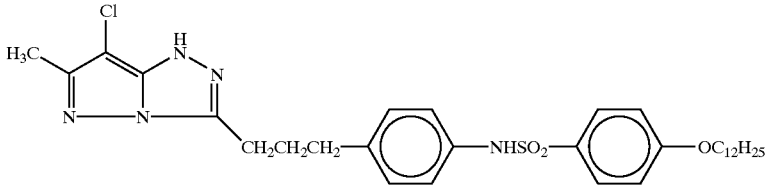

M-3

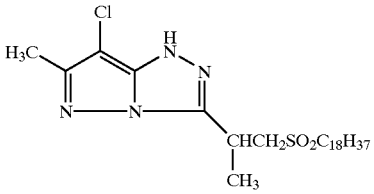

M-4

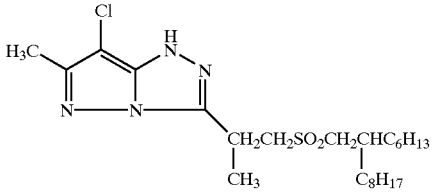

M-5

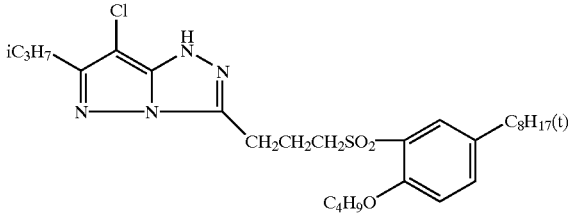

M-6

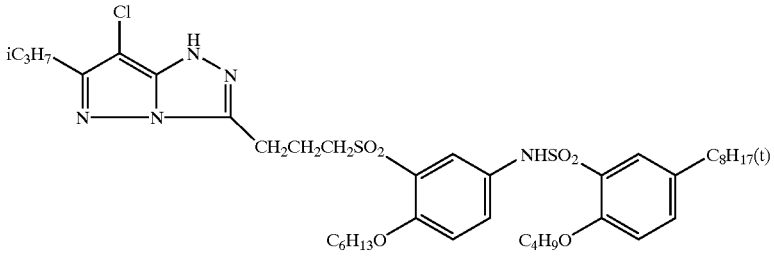

M-7

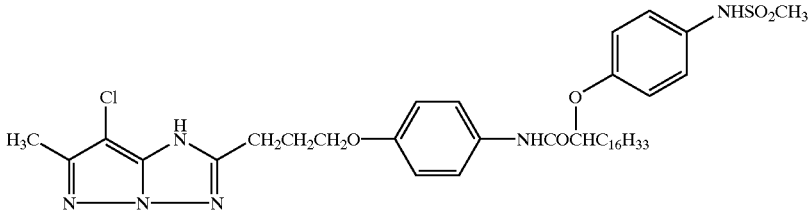

-continued
M-8
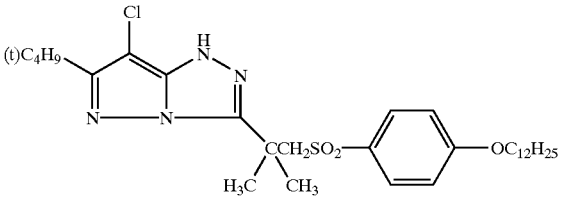
M-9
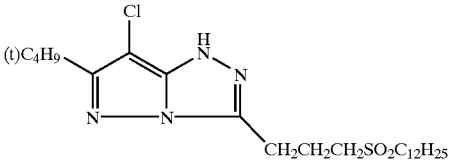
M-10
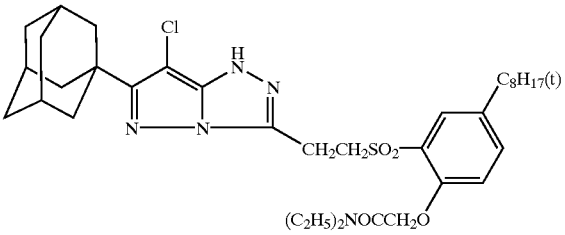
M-11
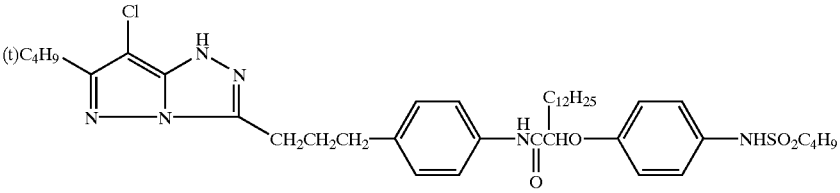
M-12
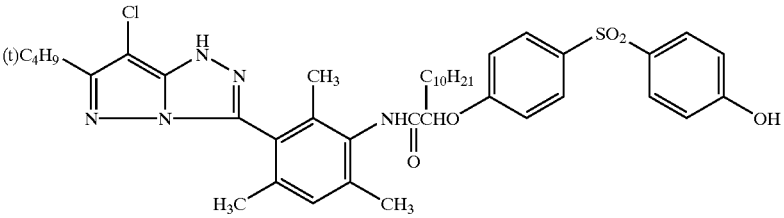
M-13
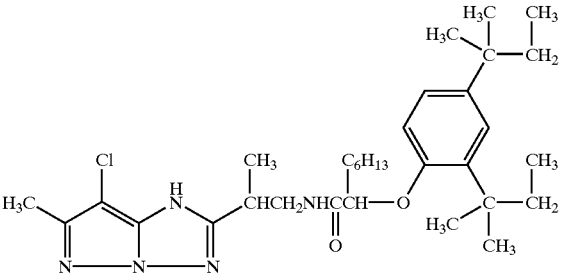
M-14
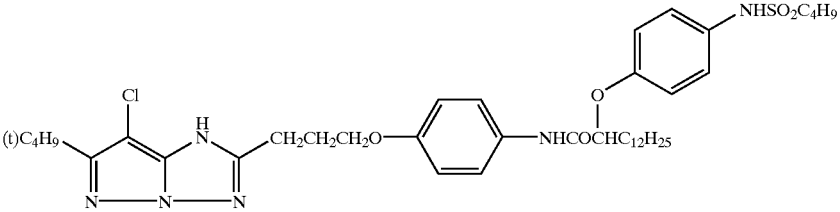
M-15
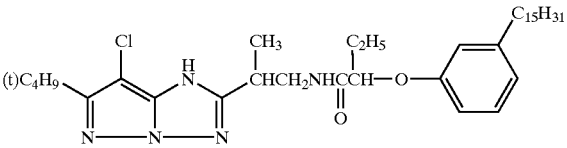

-continued
M-16
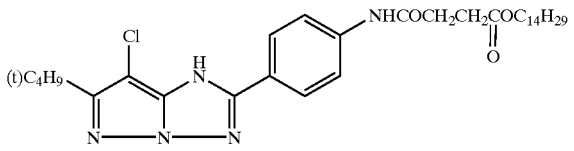
M-17
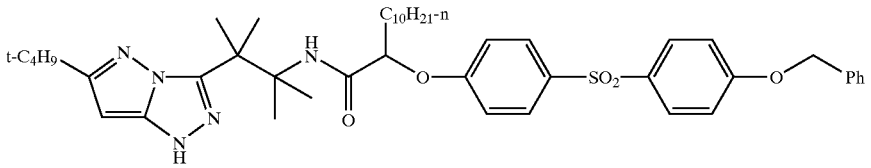
M-18
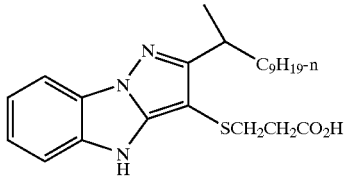
M-19
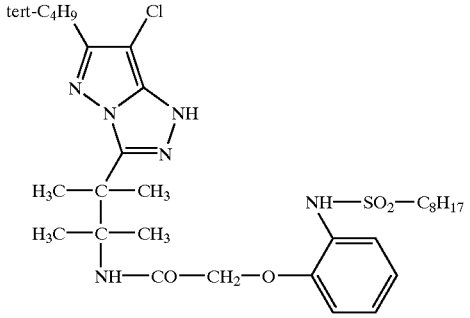
M-20
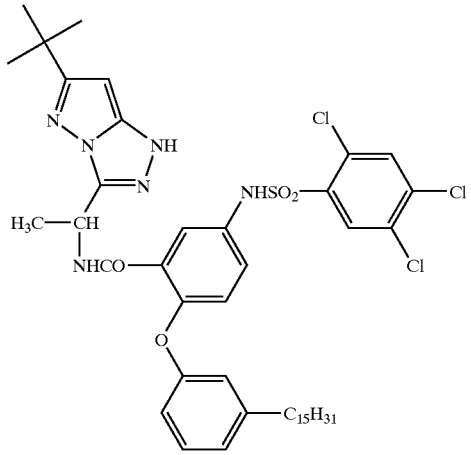
M-21
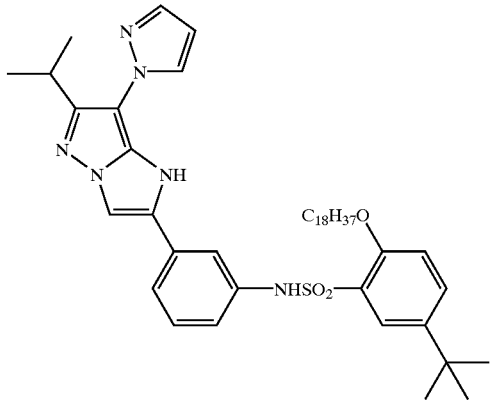
M-22
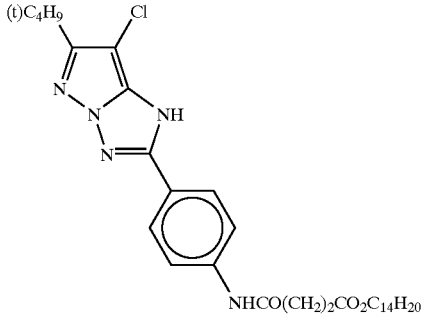
M-23
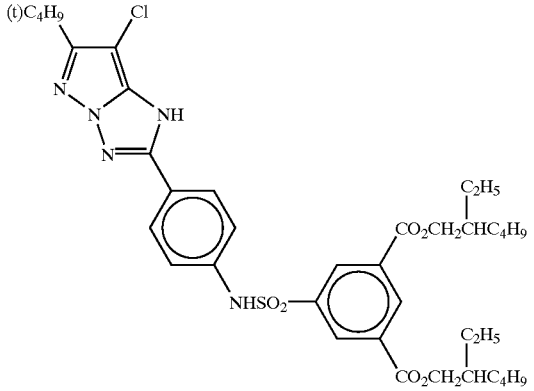

-continued
M-24
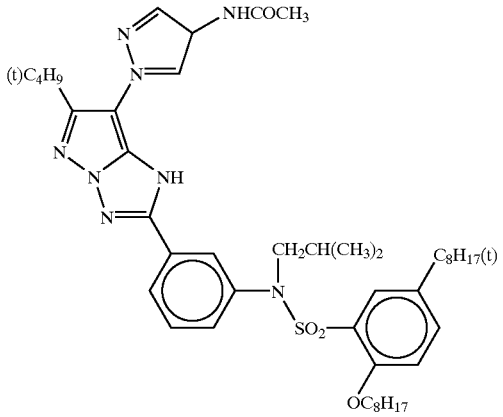
M-25
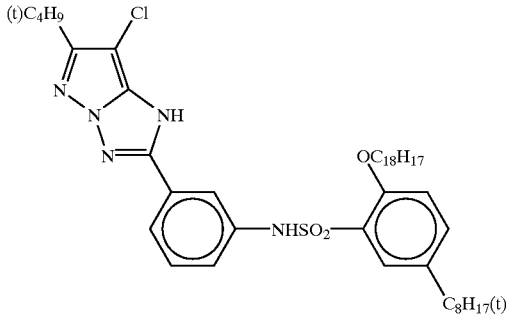
M-26
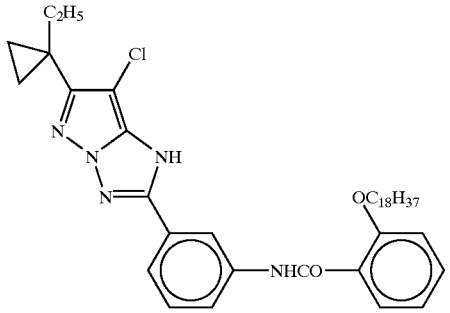
M-27
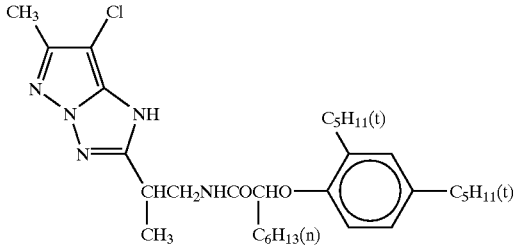
M-28
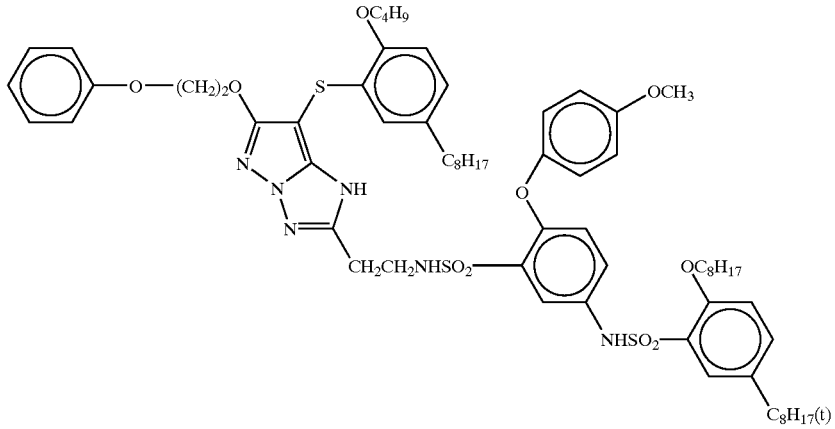
M-29
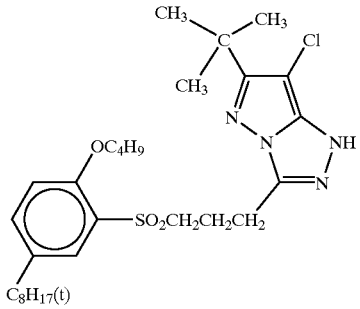

-continued

M-30

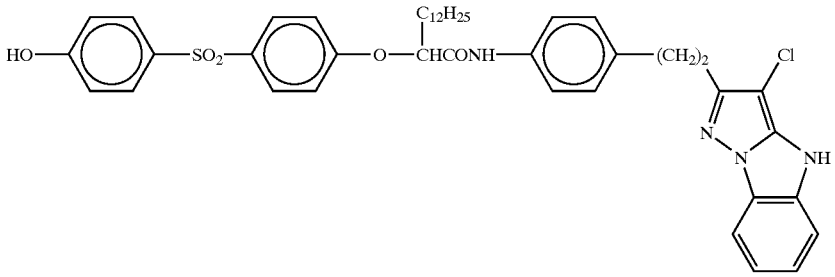

M-31

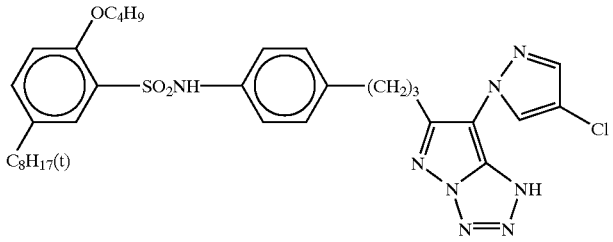

The amount added of the coupler represented by general formula (X), (XI) or (XII) is suitably from $3\times10^{-5}$ to $3\times10^{-3}$ mol/m$^2$, and preferably from $3\times10^{-4}$ to $2\times10^{-3}$ mol/m$^2$.

The coupler represented by general formula (X), (XI) or (XII) is used as a magenta coupler. Although 5-pyrazolone magenta couplers described in known literatures shown in a table given later are also used, the coupler represented by general formula (X), (XI) or (XII) is preferably used among others in respect to processing dependency.

The coupler represented by general formula (XX) will be described in detail below.

In the coupler represented by general formula (XX), $Q^5$ represents a substituted or unsubstituted aryl group, and preferably a substituted aryl group. The substituent groups at this time include the above-mentioned substituent groups W, and preferred are a chlorine atom, a methoxy group and a t-butyl group. Above all, a phenyl group substituted by one or two chlorine atoms is particularly preferred as $Q^5$.

$Q^6$ represents a substituted or unsubstituted alkyl group, and preferably a substituted alkyl group. The substituent groups at this time include the above-mentioned substituent groups W. In particular, $Q^6$ is preferably a 1-substituted alkyl group, and an aryloxy group or an arylsulfonyl group is most preferably used as the substituent group at the 1-position.

$Q^7$ represents a hydrogen atom, a halogen atom, an alkoxyl group or an alkyl group, and preferred is a hydrogen atom.

X represents a hydrogen atom or a group to be released by a reaction with an oxidant of a developing agent. The groups include a halogen atom (for example, fluorine, chlorine or bromine), an alkoxyl group (for example, ethoxy, methoxycarbonylmethoxy, carboxypropyloxy, methanesulfonylethoxy or perfluoropropoxy), an aryloxy group (for example, 4-carboxyphenoxy, 4-(4-hydroxyphenylsulfonyl) phenoxy, 4-methanesulfonyl-3-carboxyphenoxy or 2-methanesulfonyl-4-acetylsulfamoylphenoxy), an acyloxy group (acetoxy or benzoyloxy), a sulfonyloxy group (for example, methanesulfonyloxy or benzenesulfonyloxy), an acylamino group (for example, heptafluorobutyrylamino), a sulfonamido group (for example, methanesulfonamido), an alkoxycarbonyloxy group (for example, ethoxycarbonyloxy), a carbamoyloxy group (for example, diethylcarbamoyloxy, piperidinocarbonyloxy, morpholinocarbonyloxy, diallylcarbamoyloxy or bisdicyanoethylcarbamoyloxy), an alkylthio group (for example, 2-carboxyethylthio), an arylthio group (for example, 2-octyloxy-5-t-octylphenylthio or 2-(2,4-di-t-amylphenoxy)butyrylaminophenylthio), a heterocyclic thio group (for example, 1-phenyltetrazolylthio or2-benzimidazolylthio), a heterocyclic oxy group (for example, 2-pyridyloxy or 5-nitro-2-pyridyloxy), a 5-membered or 6-membered nitrogen-containing heterocyclic group (for example, 1-triazolyl, 1-imidazolyl, 1-pyrazolyl, 5-chloro-1-tetrazolyl, 1-benzotriazolyl, 2-phenylcarbamoyl-1-imidazolyl, 5,5-dimethylhydantoin-3-yl, 1-benzylhydantoin-3-yl, 5,5-dimethyloxazolidine-2,4-dione-3-yl or purine) and an azo group (for example, 4-methoxyphenylazo or 4-pivaloylaminophenylazo).

In general formula (XX), substituent group X is preferably a halogen atom, an alkoxyl group, an aryloxy group, an alkoxylcarbonyloxy group or a carbamoyloxy group, particularly preferably a halogen atom, and most preferably a chlorine atom.

The coupler represented by the above-mentioned general formula (XX) may form a multimer of a dimer or more, with the interposition of $Q^5$, $Q^5$ or $Q^6$, or may combine with a polymer chain.

Specific examples of the couplers represented by general formula (XX), which can be preferably used in the present invention, are shown below, but the scope of the present invention is not limited thereby.

C-1

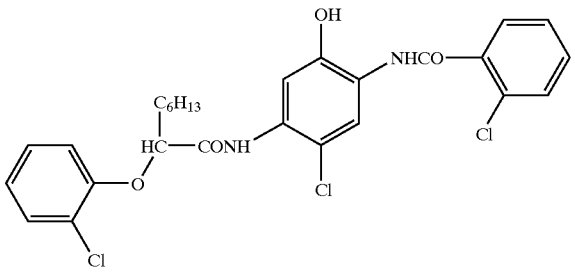

-continued

C-2

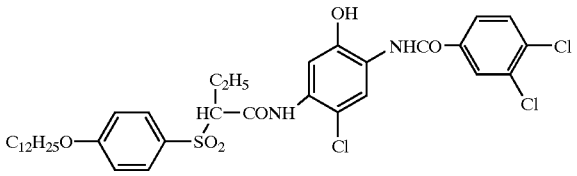

C-3

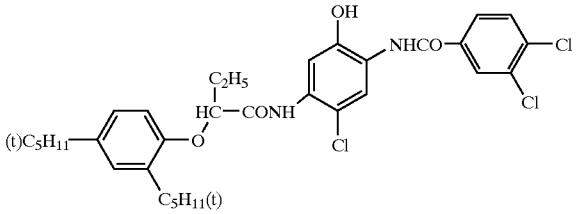

C-4

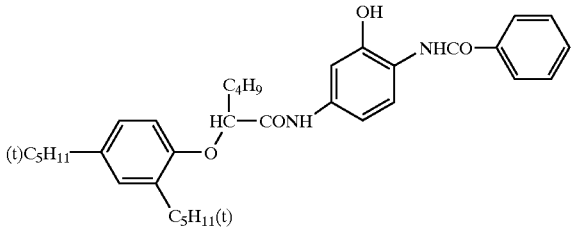

C-5

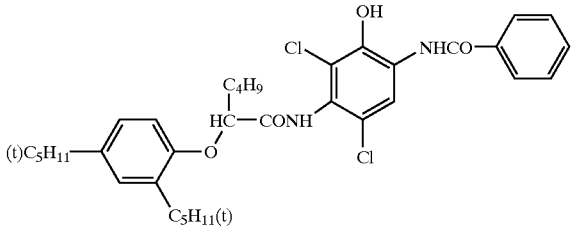

C-6

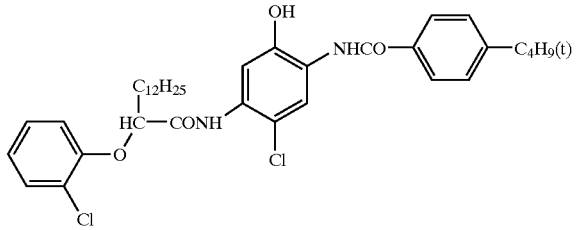

C-7

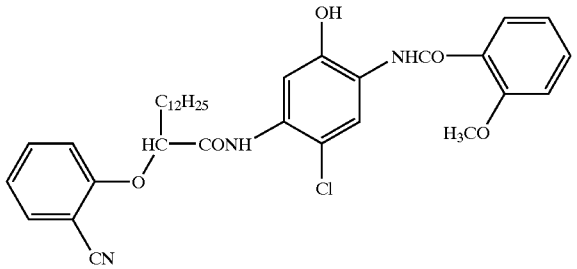

-continued

C-8

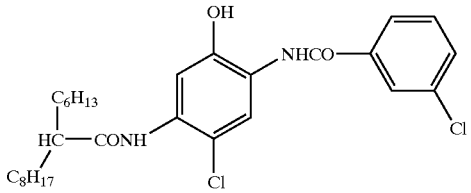

C-9

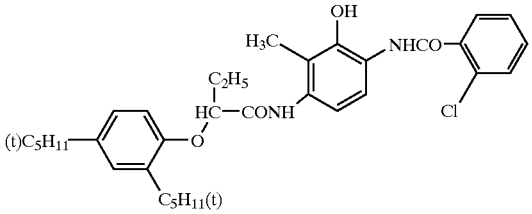

C-10

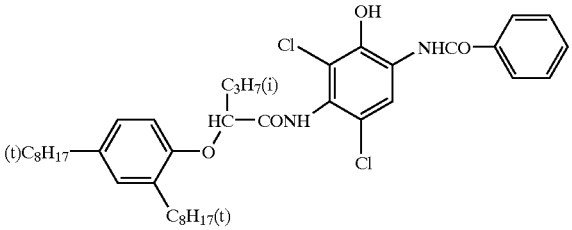

The amount added of the coupler represented by general formula (XX) is suitably from $2\times10^{-5}$ to $5\times10^{-3}$ mol/m$^2$, and preferably from $2\times10^{-4}$ to $3\times10^{-3}$ mol/m$^2$.

The coupler represented by general formula (XX) is used as a cyan coupler. Beside, the other cyan couplers which can be used together with the cyan coupler or can be used in the magenta coupler-containing light-sensitive photographic material include diphenylimidazole cyan couplers described in Japanese Patent Laid-Open No. 33144/1990, 3-hydroxypyridine cyan couplers (above all, a coupler rendered 2-equivalent by giving a chlorine releasing group to a 4-equivalent coupler of coupler (42) enumerated as a specific example, or coupler (6) or (9) is particularly preferred) described in EP-A-0333185, cyclic active methylene cyan couplers (above all, coupler examples 3, 8 and 34 enumerated as specific examples are particularly preferred) described in Japanese Patent -Laid-Open No. 32260/1989, pyrrolopyrazole cyan couplers described in EP-A-0456226, and pyrroloimidazole cyan couplers described in EP-A-0484904. above all, the pyrroloimidazole cyan couplers are preferably used in terms of color development, color reproduction and rapid processing.

As yellow couplers, in addition to compounds described in a table given later, there are preferably used acylacetamide yellow couplers acyl groups of which have 3- to 5-membered cyclic structures described in EP-A-0447969, malondianilide yellow couplers having cyclic structures described in EP-A-0482552, and acylacetamide yellow couplers having dioxane structures described in U.S. Pat. No. 5,118,599. Of these, an acylacetamide yellow coupler in which the acyl group is a 1-alkylcyclopropane-1-carbonyl group and a malondianilide yellow coupler in which one anilide constitutes an indoline ring are particularly preferably used. These couplers may be used either alone or in combination.

It is preferred that the cyan, magenta or yellow coupler is impregnated with a loadable latex polymer (for example, described in U.S. Pat. No. 4,203,716) in the presence (or absence) of a high boiling organic solvent described in a table given later, or that the coupler is dissolved together with a water-insoluble and organic solvent-soluble polymer, and then dispersed in an aqueous solution of a hydrophilic colloid in an emulsified state.

The water-insoluble and organic solvent-soluble polymers which can be preferably used include homopolymers and copolymers described in U.S. Pat. No. 4,857,449, pages 12 to 30. A methacrylate or acrylamide polymer is more preferred, and the use of an acrylamide polymer is preferred in respect to color image stability.

In the photographic material of the present invention, it is preferred that a compound for improving color image keeping quality as described in EP-A-0277589 is used. In particular, it is preferably used in combination with a pyrazoloazole coupler or a pyrrolotriazole coupler.

That is to say, for example, from the viewpoint of preventing the development of stains due to the formation of a developed color dye caused by a reaction of a color developing agent remaining in a film during storage after processing or an oxidant thereof with the coupler or other side effects, it is preferred that the compound described in the above-mentioned patent specification which is chemically bound to the aromatic amine developing agent remaining after color development processing to form a chemically inactive and substantially colorless compound and the compound described in the above-mentioned patent specification which is chemically bound to the oxidant of the aromatic amine developing agent remaining after color development processing to form a chemically inactive and substantially colorless compound are used either alone or at the same time.

In the silver halide photographic material of the present invention, any of silver chloride, silver bromide, silver chlorobromide, silver iodobromide, silver iodochloride, and silver chloroiodobromide can be used as silver halide grains. For color photographic printing paper application, a silver chlorobromide emulsion is preferred for the purposes of rapid processing and simplification. In the silver chlorobromide emulsion, silver chloride, silver chlorobromide or silver chloroiodobromide having a silver chloride content of 95 mol % or more can be preferably used.

The average grain size (the number average value of the diameters of circles equivalent to projected areas of grains taken as grain sizes) of silver halide grains contained in the silver halide emulsion used in the present invention is preferably from 0.1 to 2 $\mu$m.

As for the grain size distribution thereof, a so-called monodisperse emulsion having a coefficient of variation of 20% or less, preferably 15% or less, more preferably 10% or less is preferred. The coefficient of variation is obtained by dividing the standard deviation of the grain size distribution by the average grain size. At this time, for obtaining wide latitude, the above-mentioned monodisperse emulsion is preferably used in the same layer by blending, or coated in multiple layers.

The silver halide grains contained in the photographic emulsion may have a regular crystal form such as a cubic, an octahedral or a tetradecahedral form, an irregular crystal form such as a spherical or a tabular form, or a combined form thereof. In the present invention, of these, grains having the above-mentioned regular crystal form are preferably contained 50% or more, preferably 70% or more, more preferably 90% or more.

In addition to this, an emulsion can also be preferably used in which tabular grains having an average aspect ratio (circle-converted diameter/thickness) of 5 or more, preferably 8 or more exceed 50% of the total grains as the projected area.

The emulsions used in the present invention can be prepared by using methods described in P. Glafkides, "Chimie et Phisique Photographique" (Paul Montel, 1967), G. F. Duffin, "Photographic Emulsion Chemistry" (Focal Press, 1966) and V. L. Zelikman et al., "Making and Coating Photographic Emulsion" (Focal Press, 1964). That is to say, any of an acid process, a neutral process and an ammonia process may be used. A soluble silver salt and a soluble halogen salt may be reacted with each other by using any of a single jet process, a double jet process and a combination thereof. A process in which grains are formed in the presence of excess silver ions (so-called reverse jet process) can also be used. As a type of double jet process, a process of maintaining the pAg in a liquid phase constant in which a silver halide is formed, that is to say, a so-called controlled double jet process, can also be used. According to this process, a silver halide emulsion having a regular crystal form and an approximately uniform grain size is obtained.

The silver halide emulsion used in the present invention is generally chemically sensitized. With respect to chemical sensitization, chemical sensitization using a chalcogen sensitizer (specifically, sulfur sensitization represented by addition of a labile sulfur compound, selenium sensitization with a selenium compound or tellurium sensitization with a tellurium compound), noble metal sensitization represented by gold sensitization and reduction sensitization can be conducted either alone or in combination. Compounds described in Japanese Patent Laid-Open No. 215272/1987, page 18, lower right column to page 22, upper right column are preferably used in chemical sensitization.

The silver halide emulsions used in the present invention can contain various compounds or their precursors for preventing fog in the production process, storage or photographic processing of the photographic materials, or for stabilizing photographic properties. Specific examples of these compounds are described in Japanese Patent Laid-Open No. 215272/1987, pages 39 to 72, described above, and preferably used. A 5-arylamino-1,2,3,4-thiatriazole compound (the aryl residue has at least one electron attractive group) described in EP-0447647 is also preferably used.

The silver halide emulsions prepared according to the present invention can be used for both the color photographic materials and the black and white photographic materials. The color photographic materials include color paper, a film for color photographing and a color reversal film, and the black and white photographic materials include an X-ray film, a film for general photographing and a film for a grafic art printing sensitive material.

Various techniques and inorganic and organic materials generally described in *Research Disclosure* No. 308119 (1989) and ibid. No. 37038 (1995) can be used in the silver halide photographic materials of the present invention.

In addition, more specifically, techniques and inorganic and organic materials available for the silver halide photographic materials to which the silver halide emulsions of the present invention are applicable are described in the following parts of EP-A-436938 and the following cited patents.

| Item | Corresponding Part |
|---|---|
| 1) Layer Constitution: | page 146, line 34 to page 147, line 25 |
| 2) Silver Halide Emulsion: | page 147, line 26 to page 148, line 12 |
| 3) Yellow Coupler: | page 137, line 35 to page 146, line 33, page 149, lines 21 to 23 |
| 4) Magenta Coupler: | page 149, lines 24 to 28; EP-A-421453, page 3, line 5 to page 25, line 55 |

-continued

| Item | Corresponding Part |
|---|---|
| 5) Cyan Coupler: | page 149, lines 29 to 33; EP-A-432804, page 3, line 28 to page 40, line 2 |
| 6) Polymer Coupler: | page 149, lines 34 to 38; EP-A-435334, page 113, line 39 to page 123, line 37 |
| 7) Colored Coupler: | page 53, line 42 to page 137, line 34, page 149, lines 39 to 45 |
| 8) Other Functional Couplers: | page 7, line 1 to page 53, line 41, page 149, line 46 to page 150, line 3; EP-A-435334, page 3, line 1 to page 29, line 50 |
| 9) Preservative: | page 150, lines 25 to 28 |
| 10) Formalin Scavenger: | page 149, lines 15 to 17 |
| 11) Other Additives: | page 153, lines 38 to 47; EP-A-421453, page 75, line 21 to page 84, line 56 |
| 12) Dispersing Method: | page 150, lines 4 to 24 |
| 13) Support: | page 150, lines 4 to 24 |
| 14) Film Thickness, Film Properties: | page 150, lines 35 to 49 |
| 15) Color Development Process: | page 150, line 50 to page 151, line 47 |
| 16) Desilvering Process: | page 151, line 48 to page 152, line 53 |
| 17) Automatic Processor: | page 152, line 54 to page 153, line 2 |
| 18) Washing/Stabilization Process: | page 153, lines 3 to 37 |

In the photographic material of the present invention, a hydrophilic colloidal layer is also preferably colored for preventing irradiation or halation, or for improving safelight safety. Water-soluble dyes which can be used as such coloring materials include dyes decolorizeable by processing (oxonol dyes and cyanine dyes among others) described in EP-A-0337490, pages 27 to 76.

In such coloring, the coloring material diffuses into the whole constituent layers of the photographic material, regardless of the position to which the coloring material is added.

EXAMPLES

The present invention will be further illustrated in greater detail with reference to the following examples, which are, however, not to be construed as limiting the present invention.

Example 1

Preparation of Sample

Both faces of a support comprising paper coated with a polyethylene resin on both faces thereof was subjected to corona discharge treatment, and then, a gelatin undercoat layer containing sodium dodecylbenzenesulfonate was provided thereon. Further, first to seventh photographic constituent layers were in turn provided to form sample 101 of a silver halide color photographic material having the following layer constitution. Coating solutions for the respective photographic constituent layers were prepared as described below.

Preparation of Coating Solution for Fifth Layer:

A cyan coupler (ExC) (300 g), 250 g of a color image stabilizer (Cpd-1), 10 g of a color image stabilizer (Cpd-9), 10 g of a color image stabilizer (Cpd-10), 20 g of a color image stabilizer (Cpd-12), 14 g of an ultraviolet absorber (UV-1), 50 g of an ultraviolet absorber (UV-2), 40 g of an ultraviolet absorber (UV-3) and 60 g of an ultraviolet absorber (UV-4) were dissolved in 230 g of a solvent (Solv-6) and 350 ml of ethyl acetate, and the resulting solution was dispersed in 6,500 g of a 10% aqueous solution of gelatin containing 200 ml of sodium dodecylbenzenesulfonate in an emulsified state to prepare emulsified dispersion C.

On the other hand, silver chlorobromide emulsion C (cubic, a 1:1 (silver molar ratio) mixture of large grain size emulsion C having an average grain size of 0.50 $\mu$m and small grain size emulsion C having an average grain size of 0.41 $\mu$m, which have coefficients of variation of grain size distribution of 0.09 and 0.11, respectively, each size emulsion contained 0.5 mol % of silver bromide localized on a part of a grain surface whose base material was silver chloride) was prepared.

Red-sensitive sensitizing dyes G and H shown below were each added to large grain size emulsion C in an amount of $6.0\times10^{-5}$ mol per mol of silver, and to small grain size emulsion C in an amount of $9.0\times10^{-5}$ mol per mol of silver. Further, chemical ripening was optimally conducted by adding a sulfur sensitizer and a gold sensitizer.

The above-mentioned emulsified dispersion C and this silver chlorobromide C were mixed and dissolved to a composition described later to prepare a coating solution for a fifth layer.

The amount of an emulsion coated indicates the amount coated converted to the silver amount.

Coating solutions for first to fourth and sixth and seventh layers were also prepared in the same manner as with the coating solution for the fifth layer. 1-Oxy-3,5-dichloro-s-triazine sodium salt was used as a gelatin hardener in each layer.

Further, Ab-1, Ab-2, Ab-3 and Ab-4 were added to each layer in amounts of 15.0 mg/m$^2$, 60.0 mg/m$^2$, 5.0 mg/m$^2$ and 10.0 g/m$^2$, respectively.

Preservative (Ab-1)

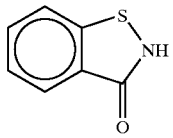

Preservative (Ab-2)

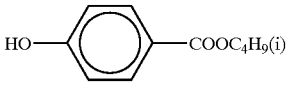

Preservative (Ab-3)

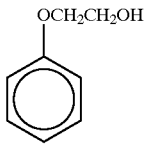

Preservative (Ab-4)

-continued

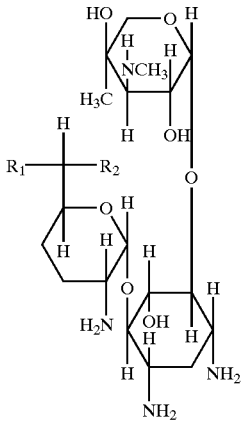

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A 1:1:1:1 mixture of a, b, c and d

The following spectral sensitizing dyes were each used in the silver chlorobromide emulsion of each light-sensitive emulsion layer.

Blue-Sensitive Emulsion Layer:

(Sensitizing Dye A)

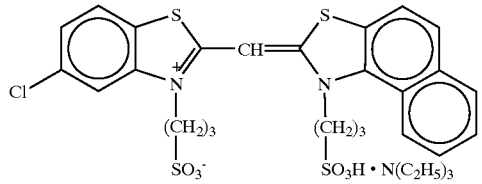

(Sensitizing Dye B)

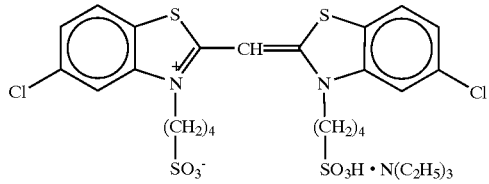

(Sensitizing Dye C)

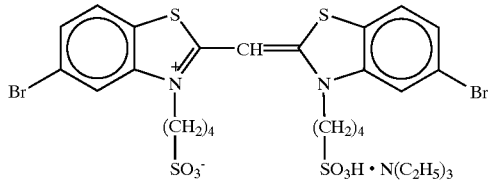

(Comparative Dye J)

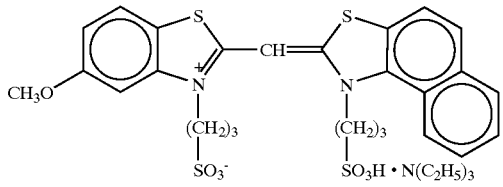

(Sensitizing dyes A, B and C were each added to the large grain size emulsion in an amount of $1.4\times10^{-4}$ mol per mol of silver halide, and to the small grain size emulsion in an amount of $1.7\times10^{-4}$ mol per mol of silver halide.)

Green-Sensitive Emulsion Layer:

(Sensitizing Dye D)

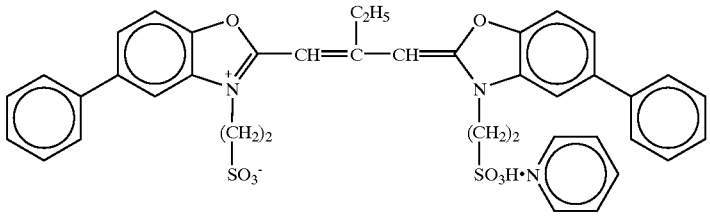

(Sensitizing Dye E)

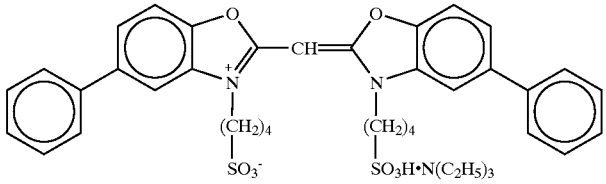

-continued (Sensitizing Dye F)

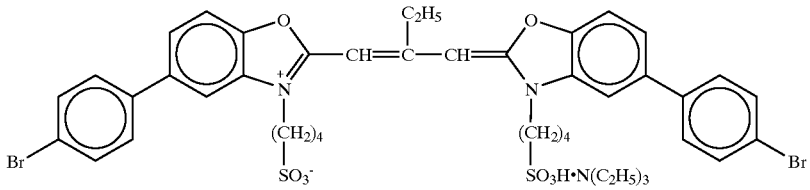

(Sensitizing dye D was added to the large grain size emulsion in an amount of $3.0\times10^{-4}$ mol per Mol of silver halide, and to the small grain size emulsion in an amount of $3.6\times10^{-4}$ mol per mol of silver halide, sensitizing dye E was added to the large grain size emulsion in an amount of $4.0\times10^{-5}$ mol per mol of silver halide, and to the small grain size emulsion in an amount of $7.0\times10^{-5}$ mol per mol of silver halide, and sensitizing dye F was added to the large grain size emulsion in an amount of $2.0\times10^{-4}$ mol per mol of silver halide, and to the small grain size emulsion in an amount of $2.8\times10^{-4}$ mol per mol of silver halide.)

Red-Sensitive Emulsion Layer.

Red-Sensitive Emulsion Layer:

(Sensitizing Dye G)

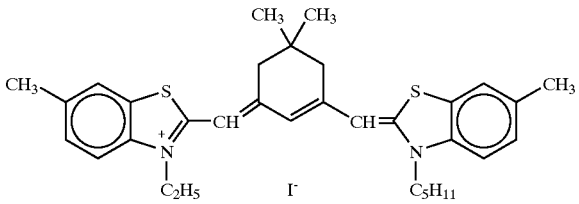

(Sensitizing Dye H)

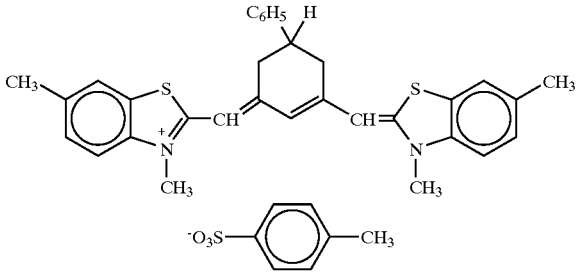

(Sensitizing dyes G and H were each added to the large grain size emulsion in an amount of $6.0\times10^{-5}$ mol per mol of silver halide, and to the small grain size emulsion in an amount of $9.0\times10^{-5}$ mol per mol of silver halide.)

Further, the following compound I was added to the red-sensitive emulsion layer in an amount of $2.6\times10^{-3}$ mol per mol of silver halide.

(Compound I)

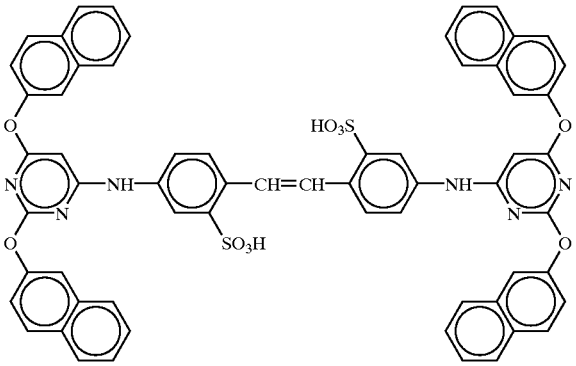

Further, 1-(3-methylureidophenyl)-5-mercaptotetrazole was added to the blue-sensitive emulsion layer, the green-sensitive emulsion layer and the red-sensitive emulsion layer in amounts of $3.3\times10^{-4}$ mol, $1.0\times10^{-3}$ mol, and$5.9\times10^{-4}$ mol, per mol of silver halide, respectively.

Still further, it was also added to the second, fourth, sixth and seventh layers so as to be contained in amounts of 0.2 mg/m$^2$, 0.2 mg/m$^2$, 0.6 mg/m$^2$ and 0.1 mg/m$^2$, respectively.

Furthermore, 4-hydroxy-6-methyl-1,3,3a,7-tetraazaindene was added to the blue-sensitive emulsion layer and the green-sensitive emulsion layer in amounts of $1\times10^{-4}$ mol and $2\times10^{-4}$ mol, per mol of silver halide, respectively.

A copolymer of methacrylic acid and butyl acrylate (weight ratio: 1:1, average molecular weight: 200,000 to 400,000) was added to the red-sensitive emulsion layer in an amount of 0.05 g/m$^2$.

In addition, disodium catechol-3,5-disulfonate was added to the second, fourth and sixth layers so as to be contained in amounts of 6 mg/m$^2$, 6 mg/m$^2$ and 6 mg/m$^2$, respectively.

For preventing irradiation, the following dyes (the numerical value in parentheses indicates the amount added) were added to the emulsion layers.

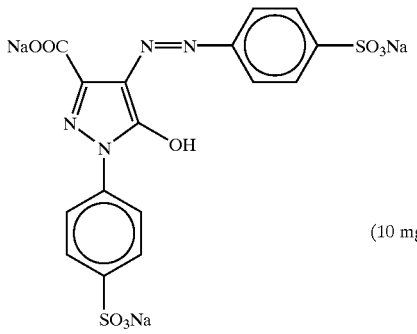

(10 mg/m$^2$)

-continued

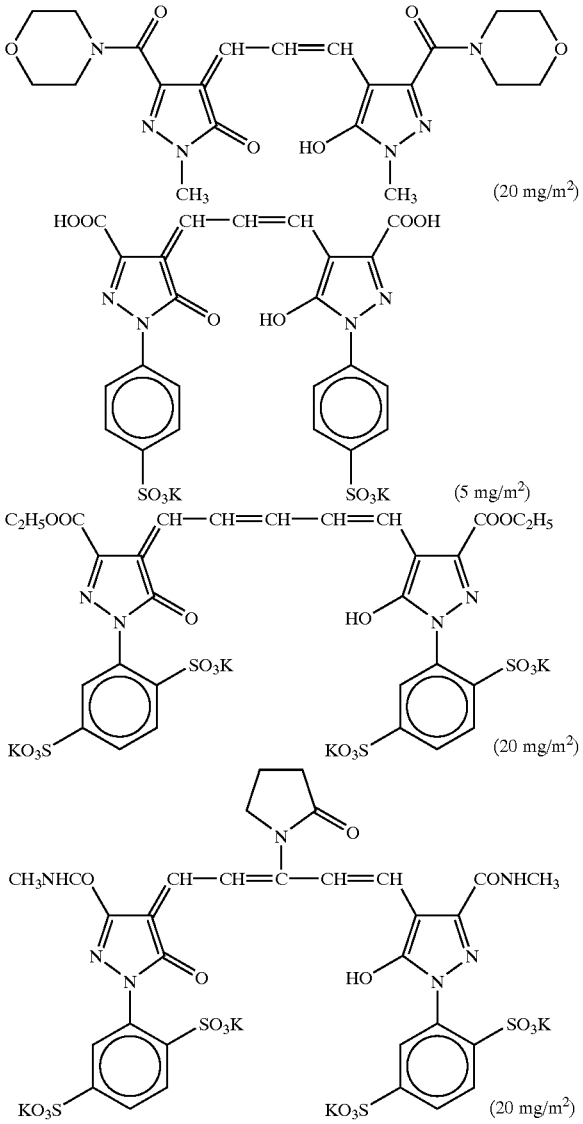

Layer Constitution

The constitution of each layer is shown below. The numeral indicates the amount coated (g/m$^2$). For the silver halide emulsions, it indicates the amount coated in terms of silver.

Support:

Polyethylene resin-laminated paper (a white pigment ($TiO_2$ content: 16% by weight. ZnO content: 4% by weight) and a fluorescent brightening agent (a 8:2 mixture of 4,4-bis-(benzoxazolyl)stilbene and 4,4-bis(5-methylbenzoxazolyl)-stilbene, content: 0.05% by weight) and a bluish dye (ultramarine) were added to the polyethylene resin on the first layer side).

| First Layer (Blue-Sensitive Emulsion Layer): | |
|---|---|
| Silver chlorobromide A (cubic, a 3:7 (silver molar ratio) mixture of large grain size emulsion A having an average grain size of 0.72 μm and small grain size emulsion A having an average grain size of 0.60 μm, which have coefficients of variation of grain size distribution of 0.08 and 0.10, respectively, each size emulsion contained 0.3 mol % of silver bromide localized on a part of a grain surface whose base material was silver chloride) | 0.26 |
| Gelatin | 1.35 |
| Yellow Coupler (ExY) | 0.62 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-1) | 0.23 |
| Second Layer (Color Stain Preventing Layer): | |
| Gelatin | 0.99 |
| Color Stain Preventing Agent (Cpd-4) | 0.09 |
| Color Image Stabilizer (Cpd-5) | 0.018 |
| Color Image Stabilizer (Cpd-6) | 0.13 |
| Color Image Stabilizer (Cpd-7) | 0.01 |
| Solvent (Solv-1) | 0.06 |
| Solvent (Solv-2) | 0.22 |
| Third Layer (Green-Sensitive Emulsion Layer): | |
| Silver chlorobromide B (cubic, a 1:3 (silver molar ratio) mixture of large grain size emulsion B having an average grain size of 0.45 μm and small grain size emulsion B having an average grain size of 0.35 μm, which have coefficients of variation of grain size distribution of 0.10 and 0.08, respectively, each size emulsion contained 0.4 mol % of silver bromide localized on a part of a grain surface whose base material was silver chloride) | 0.14 |
| Gelatin | 1.36 |
| Magenta Coupler (ExM) | 0.15 |
| Ultraviolet Absorber (UV-1) | 0.05 |
| Ultraviolet Absorber (UV-2) | 0.03 |
| Ultraviolet Absorber (UV-3) | 0.02 |
| Ultraviolet Absorber (UV-4) | 0.04 |
| Color Image Stabilizer (Cpd-2) | 0.02 |
| Color Image Stabilizer (Cpd-4) | 0.002 |
| Color Image Stabilizer (Cpd-6) | 0.09 |
| Color Image Stabilizer (Cpd-8) | 0.02 |
| Color Image Stabilizer (Cpd-9) | 0.03 |
| Color Image Stabilizer (Cpd-10) | 0.01 |
| Color Image Stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (Color Stain Preventing Layer): | |
| Gelatin | 0.71 |
| Color Stain Preventing Agent (Cpd-4) | 0.06 |
| Color Image Stabilizer (Cpd-5) | 0.013 |
| Color Image Stabilizer (Cpd-6) | 0.13 |
| Color Image Stabilizer (Cpd-7) | 0.01 |
| Solvent (Solv-1) | 0.06 |
| Solvent (Solv-2) | 0.22 |
| Fifth Layer (Red-Sensitive Emulsion Layer): | |
| Silver chlorobromide C (cubic, a 1:4 (silver molar ratio) mixture of large grain size emulsion C having an average grain size of 0.50 μm and small grain size emulsion C having an average grain size of 0.41 μm, which have coefficients of variation of grain size distribution of 0.09 and 0.11, respectively, each size emulsion contained 0.5 mol % of silver bromide localized on a part of a grain surface whose base material was silver chloride) | 0.20 |
| Gelatin | 1.11 |
| Cyan Coupler (ExC) | 0.30 |
| Ultraviolet Absorber (UV-1) | 0.14 |
| Ultraviolet Absorber (UV-2) | 0.05 |
| Ultraviolet Absorber (UV-3) | 0.04 |
| Ultraviolet Absorber (UV-4) | 0.06 |
| Color Image Stabilizer (Cpd-1) | 0.25 |
| Color Image Stabilizer (Cpd-9) | 0.01 |
| Color Image Stabilizer (Cpd-10) | 0.01 |
| Color Image Stabilizer (Cpd-12) | 0.02 |
| Solvent (Solv-6) | 0.23 |
| Sixth Layer (Ultraviolet Absorbing Layer): | |
| Gelatin | 0.66 |
| Ultraviolet Absorber (UV-1) | 0.19 |
| Ultraviolet Absorber (UV-2) | 0.06 |

-continued

| | |
|---|---|
| Ultraviolet Absorber (UV-3) | 0.06 |
| Ultraviolet Absorber (UV-4) | 0.05 |
| Ultraviolet Absorber (UV-5) | 0.09 |
| Solvent (Solv-7) | 0.25 |
| Seventh Layer (Protective Layer): | |
| Gelatin | 1.00 |
| Acryl-Modified Copolymer of Polyvinyl Alcohol (degree of modification: 17%) | 0.04 |
| Liquid Paraffin | 0.02 |
| Surfactant (Cpd-13) | 0.01 |

Yellow Coupler (ExY):
A 60:40 mixture of

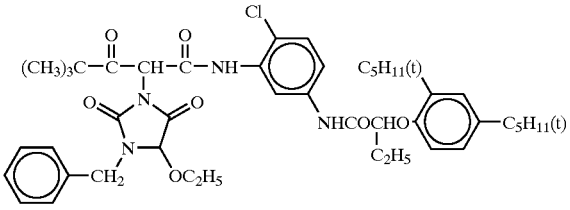

and

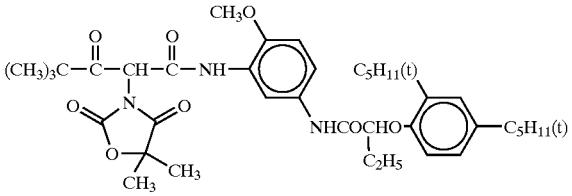

Magenta Coupler (ExM):

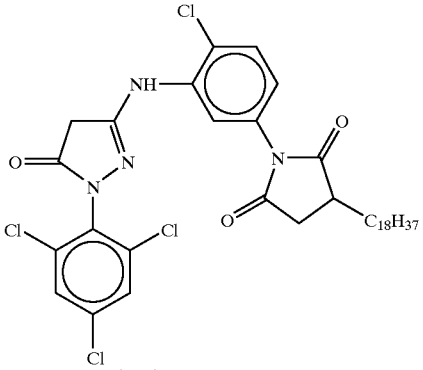

Cyan Coupler (ExC):
A 15:85 mixture of

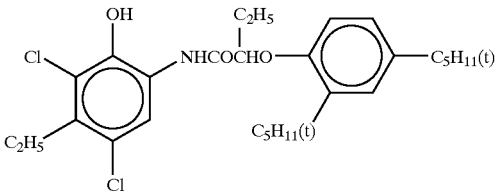

and

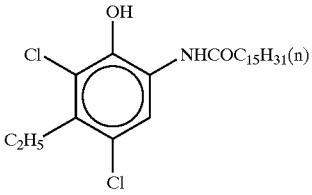

Color Image Stabilizer (Cpd-1):

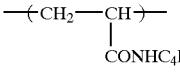

number average molecular weight: 60,000

-continued

Color Image Stabilizer (Cpd-2):

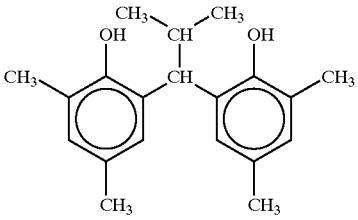

Color Image Stabilizer (Cpd-3):

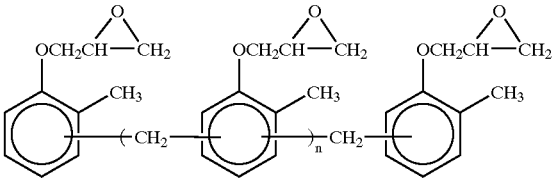

n = 7 to 8 (average)

Color Stain Preventing Agent (Cpd-4):
A 1:1:1 mixture of

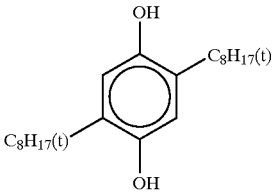

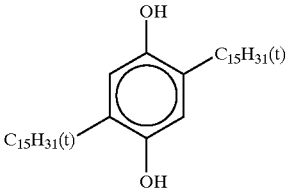

and

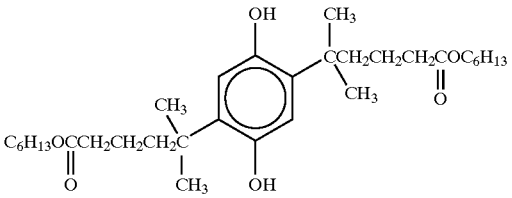

Color Stain Preventing Agent (Cpd-5):

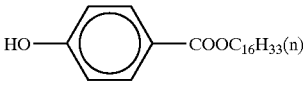

Color Image Stabilizer (Cpd-6)

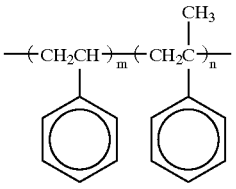

number average molecular weight: 600 m/n = 10/90

Color Image Stabilizer (Cpd-7):

-continued

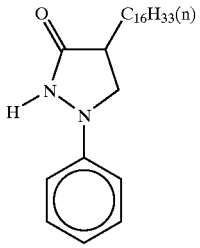

Color Image Stabilizer (Cpd-8):

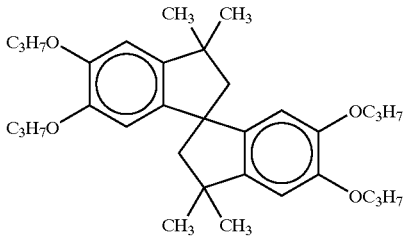

Color Image Stabilizer (Cpd-9):

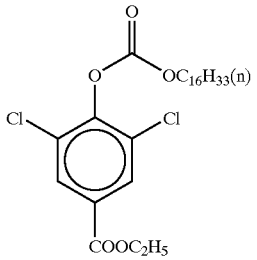

Color Image Stabilizer (Cpd-10):

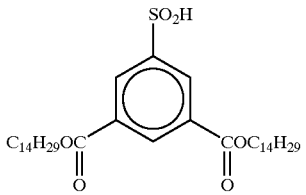

Color Image Stabilizer (Cpd-11):

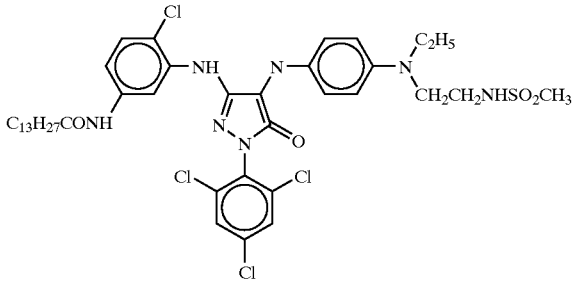

Color Image Stabilizer (Cpd-12):

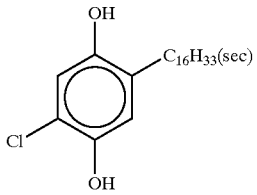

Surfactant (Cpd-13):

A 7:3 mixture of

-continued

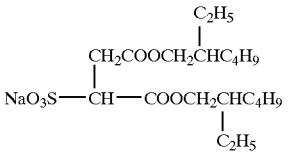

and

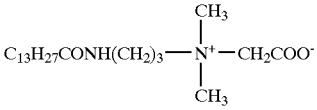

Ultraviolet Absorber (UV-1):

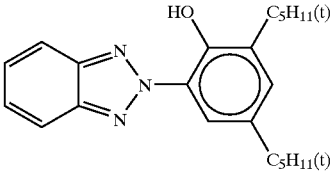

Ultraviolet Absorber (UV-2):

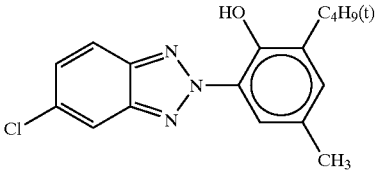

Ultraviolet Absorber (UV-3):

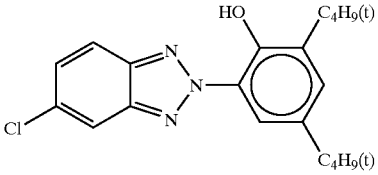

Ultraviolet Absorber (UV-4):

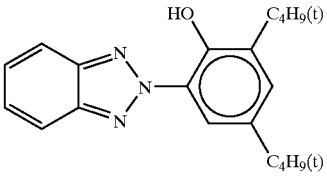

Ultraviolet Absorber (UV-5):

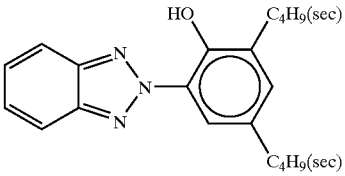

Solvent (Solv-1):

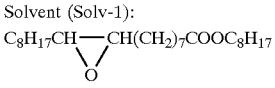

Solvent (Solv-2):

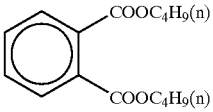

Solvent (Solv-3):

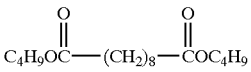

Solvent (Solv-4):

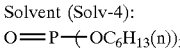

Solvent (Solv-5):

-continued

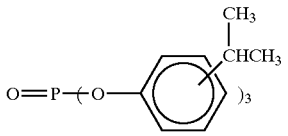

Solvent (Solv-6):

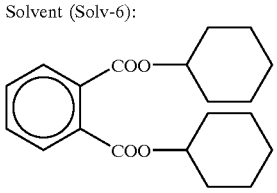

Solvent (Solv-7):

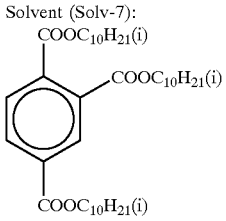

Further, samples 102 to 109 were prepared in the same manner as with silver halide color photographic material 101 prepared as described above with the exception that sensitizing dye A used in the first layer (blue-sensitive emulsion layer) was replaced with equivalents of sensitizing dyes shown in Table 1, respectively, and sample 100 to which sensitizing dye A was not added was prepared. Furthermore, samples 201 to 209, 301 to 309 and 401 to 409 were each prepared in the same manner as with samples 101 to 109, respectively, with the exception that magenta coupler ExM used in the third layer was replaced with couplers shown in Table 1, respectively, so as to give the same maximum color formation density. Each sample was processed to a roll form having a width of 127 mm.

(Evaluation of Residual Color of Dye)

For samples 100 to 109, 201 to 209, 301 to 309 and 401 to 409, continuous processing (running test) was conducted by the following processing steps until a replenisher was replenished twice the amount of a color developing tank, at a ratio of 25%/75% of a sample fogged by white light/an unexposed sample, using respective color developing solutions (running processing solutions 100 to 109, 201 to 209, 301 to 309 and 401 to 409).

| Processing Step | Temperature | Time | Replenishment Rate* |
|---|---|---|---|
| Color Development | 38.5° C. | 45 sec | 45 ml |
| Bleaching - Fixing | 38.0° C. | 45 sec | 35 ml |
| Rinsing (1) | 38.0° C. | 20 sec | — |
| Rinsing (2) | 38.0° C. | 20 sec | — |
| Rinsing (3)** | 38.0° C. | 20 sec | — |
| Rinsing (4)** | 38.0° C. | 30 sec | 121 ml |

*Replenishment rate per $m^2$ of photographic material

**An RC50D rinse cleaning system manufactured by Fuji Photo Film Co., Ltd. was installed in rinsing (3). A rinsing solution was taken out of rinsing (3), and supplied to a reverse osmosis membrane module (RC50D) with a pump. A permeated solution obtained from this tank was supplied to rinsing (4), and a concentrated solution was returned back to rinsing (3). The pump pressure was adjusted so that the amount of the permeated solution to the reverse osmosis membrane module was maintained at 50 to 300 ml/min, and the solution was circulated under temperature-controlled conditions for 10 hours a day.

(Rinsing was carried out as a tank counter current system from (1) to (4).

The composition of each processing solution was as shown below.

| | Tank Solution | Replenisher |
|---|---|---|
| Color Developing Solution | | |
| Water | 800 ml | 800 ml |
| Dimethylpolysiloxane Surfactant (Silicone KF351A manufactured by Shin-Etsu Chemical Co., Ltd.) | 0.1 g | 0.1 g |
| Triethanolamine | 11.6 g | 11.6 g |
| Ethylenediaminetetraacetic Acid | 4.0 g | 4.0 g |
| Sodium 4, 5-Dihydroxybenzene-1, 3-dislulfonate | 0.5 g | 0.5 g |
| Potassium Chloride | 10.0 g | — |
| Potassium Bromide | 0.040 g | 0.010 g |
| Triazinylaminostilbene Fluorescent Brightening Agent (Hakkol FWA-SF manufactured by Showa Chemical Industry Co., Ltd.) | 2.5 g | 5.0 g |
| Sodium Sulfite | 0.1 g | 0.1 g |
| Disodium-N, N-bis(sulfonatoethyl) hydroxylamine | 8.5 g | 11.1 g |
| N-Ethyl-N-(β-methanesulfonamidoethyl)-3-methyl-4-amino-4-aminoaniline.3/2 Sulfate.Monohydrate | 5.0 g | 15.7 g |
| Potassium Carbonate | 26.3 g | 26.3 g |
| Water to make | 1000 ml | 1000 ml |
| pH (25° C., adjusted with potassium hydroxide and sulfuric acid) | 10.15 | 12.50 |
| Bleaching-Fixing Solution | | |
| Water | 800 ml | 800 ml |
| Ammonium Ethylenediaminetetraacetato Ferrate (III) | 47.0 g | 94.0 g |
| Ethylenediaminetetraacetic Acid | 1.4 g | 2.8 g |
| m-Carboxymethylbenzenesulfinic Acid | 8.3 g | 16.5 g |
| Nitric Acid (67%) | 16.5 g | 33.0 g |
| Imidazole | 14.6 g | 29.2 g |
| Ammonium Thiosulfate (750 g/liter) | 107.0 ml | 214.0 ml |
| Ammonium Sulfite | 16.0 g | 32.0 g |
| Potassium Bisulfite | 23.1 g | 46.2 g |
| Water to make | 1000 ml | 1000 ml |
| pH (25° C., adjusted with acetic acid and ammonia) | 6.0 6.0 | |
| Rinsing Solution | | |
| Sodium Chlorinated Isocyanurate | 0.02 g | 0.02 g |
| Deionized Water (conductivity: 5 μs/cm or less) | 1000 ml | 1000 ml |
| pH | 6.5 | 6.5 |

Using a sensitometer, samples 100 to 109, 201 to 209, 301 to 309 and 401 to 409 were exposed through a color separation filter and a gradation wedge for 1/100 sec. Then, each sample was developed with each corresponding running solution and subjected to sensitometry. Further, the yellow density (Dy) of an unexposed area of the resulting sample was measured. The difference in the yellow density from the yellow density ($DY^0$) of sample 100 is the residual color of the sensitizing dye used. The smaller density difference means that the residual color is more decreased.

TABLE 1

(Evaluation of Sensitivity, Residual Color and Fluctuation of Photographic Properties after Continuous Processing)

| Sample No. | First Layer Replacement of Sensitizing Dye A | Third Layer Replacement of Magenta Coupler ExM | Blue-Sensitive Layer Relative Sensitivity | Yellow Residual Color Density $Dy - Dy^0$ | Fluctuation of Magenta Density by Continuous Processing $\Delta Dm = Dm - 2.0$ |
|---|---|---|---|---|---|
| 100 (Blank) | Not added | ExM | — | 0 (standard) | — |
| 101 (Comparison) | Sensitizing dye A | ExM | 100 (standard) | 0.075 | −0.20 |
| 102 (Comparison) | Comparative dye J | ExM | 89 | 0.066 | −0.19 |
| 103 (Comparison) | S-8 | ExM | 130 | 0.044 | −0.30 |
| 104 (Comparison) | S-9 | ExM | 128 | 0.046 | −0.31 |
| 105 (Comparison) | S-13 | ExM | 140 | 0.039 | −0.29 |
| 106 (Comparison) | S-15 | ExM | 135 | 0.035 | −0.27 |
| 107 (Comparison) | S-23 | ExM | 138 | 0.055 | −0.30 |
| 108 (Comparison) | S-25 | ExM | 145 | 0.036 | −0.33 |
| 109 (Comparison) | S-74 | ExM | 150 | 0.033 | −0.43 |
| 201 (Comparison) | Sensitizing dye A | M-9 | 102 | 0.073 | −0.15 |
| 202 (Comparison) | Comparative dye J | M-9 | 93 | 0.065 | −0.13 |
| 203 (invention) | S-8 | M-9 | 134 | 0.042 | −0.10 |
| 204 (invention) | S-9 | M-9 | 133 | 0.043 | −0.12 |
| 205 (invention) | S-13 | M-9 | 143 | 0.037 | −0.09 |
| 206 (invention) | S-15 | M-9 | 139 | 0.033 | −0.08 |
| 207 (invention) | S-23 | M-9 | 142 | 0.050 | −0.10 |
| 208 (invention) | S-25 | M-9 | 150 | 0.033 | −0.11 |
| 209 (invention) | S-74 | M-9 | 153 | 0.031 | −0.22 |
| 301 (Comparison) | Sensitizing dye A | M-19 | 99 | 0.071 | −0.18 |
| 302 (Comparison) | Comparative dye J | M-19 | 90 | 0.064 | −0.16 |
| 303 (invention) | S-8 | M-19 | 129 | 0.035 | −0.12 |
| 304 (invention) | S-9 | M-19 | 126 | 0.038 | −0.13 |
| 305 (invention) | S-13 | M-19 | 137 | 0.031 | −0.11 |
| 306 (invention) | S-15 | M-19 | 134 | 0.029 | −0.10 |
| 307 (invention) | S-23 | M-19 | 136 | 0.044 | −0.12 |
| 308 (invention) | S-25 | M-19 | 144 | 0.027 | −0.13 |
| 309 (invention) | S-74 | M-19 | 148 | 0.025 | −0.23 |
| 401 (Comparison) | Sensitizing dye A | M-22/M-27 (3:2) | 101 | 0.075 | −0.19 |
| 402 (Comparison) | Comparative dye J | M-22/M-27 (3:2) | 88 | 0.055 | −0.17 |
| 403 (invention) | S-8 | M-22/M-27 (3:2) | 130 | 0.030 | −0.15 |
| 404 (invention) | S-9 | M-22/M-27 (3:2) | 129 | 0.032 | −0.18 |
| 405 (invention) | S-13 | M-22/M-27 (3:2) | 141 | 0.027 | −0.16 |
| 406 (invention) | S-15 | M-22/M-27 (3:2) | 137 | 0.025 | −0.15 |
| 407 (invention) | S-23 | M-22/M-27 (3:2) | 140 | 0.035 | −0.18 |
| 408 (invention) | S-25 | M-22/M-27 (3:2) | 147 | 0.022 | −0.19 |
| 409 (invention) | S-74 | M-22/M-27 (3:2) | 152 | 0.020 | −0.30 |

As is apparent from Table 1, the samples of the present invention in which the methine dyes of general formula (I) are used in combination with the couplers of general formula (X) have high sensitivity. Moreover, the residual colors after processing are restrained to a low level.

(Evaluation of Processing Dependency)

For each of samples 101 to 109, 201 to 209, 301 to 309 and 401 to 409 prepared, continuous processing was conducted under the same conditions as those of the residual color evaluation, at a ratio of 25%/75% of a sample fogged by white light/an unexposed sample, using respective color developing solutions, to obtain each running processing solution.

Before and after the continuous processing, the following sensitometry was conducted using a sample having the same number as the sample used in each continuous processing. Using a sensitometer, each sample was exposed through a color separation filter and a gradation wedge for 1/100 sec. Then, each sample was developed with a fresh developing solution and each corresponding running solution.

At an exposure giving a magenta density of each sample of 2.0 at the time when the sample was processed using a fresh developing solution before the continuous processing, the magenta density (Dm) at the time when the sample was developed using each running processing solution was measured. This change in density ($\Delta Dm = Dm - 2.0$)was determined. The negatively larger value means the larger change in photographic fluctuation by the continuous processing.

As apparent from Table 1, the photographic fluctuation of the magenta color formation density after the continuous processing at the time when the methine dyes of general formula (I) of the present invention is used is restrained by the use in combination with the magenta couplers of general formula (X) of the present invention. Especially, the use of the couplers of general formula (XII) restrains the photographic fluctuation to a minimum.

Example 2

Preparation of Sample 501

(1) Preparation of Triacetyl Cellulose Film

Triacetyl cellulose was dissolved in a 92/8 (weight ratio) mixed solvent of dichloromethane/methanol (in an amount of 13% by weight), and triphenyl phosphate and biphenyldiphenyl phosphate (weight ratio: 2:1) were added thereto as plasticizers in a total amount of 14% based on triacetyl cellulose. The resulting product was formed to a film by a band method according to a solvent casting process. The thickness of the support after drying was 97 $\mu$m.

(2) Contents of Undercoat Layer

The following undercoat solution was applied onto both faces of the above-mentioned triacetyl cellulose film. The numerals indicate the weight contained per liter of undercoat solution.

The both faces were subjected to corona discharge treatment before application of the undercoat solution.

| | |
|---|---|
| Gelatin | 10.0 g |
| Salicylic Acid | 0.5 g |
| Glycerol | 4.0 g |
| Acetone | 700 ml |
| Methanol | 200 ml |
| Dichloromethane | 80 ml |
| Formaldehyde | 0.1 mg |
| Water to make | 1.0 liter |

(3) Coating of Back Layers

The following back layers were provided on one face of the support undercoated.

| | |
|---|---|
| First Layer: | |
| Binder: Acid-Treated Gelatin (isoelectric point: 9.0) | 1.00 g |
| Polymer Latex P-2 (average grain size: 0.1 μm) | 0.13 g |
| Polymer Latex P-3 (average grain size: 0.2 μm) | 0.23 g |
| Ultraviolet Absorber U-1 | 0.030 g |
| Ultraviolet Absorber U-3 | 0.010 g |
| Ultraviolet Absorber U-4 | 0.020 g |
| High Boiling Organic Solvent Oil-2 | 0.030 g |
| Surfactant W-3 | 0.010 g |
| Surfactant W-6 | 3.0 mg |
| Second Layer: | |
| Binder: Acid - Treated Gelatin (isoelectric point: 9.0) | 3.10 g |
| Polymer Latex P-3 (average grain size: 0.2 μm) | 0.11 g |
| Ultraviolet Absorber U-1 | 0.030 g |
| Ultraviolet Absorber U-3 | 0.010 g |
| Ultraviolet Absorber U-4 | 0.020 g |
| High Boiling Organic Solvent Oil-2 | 0.030 g |
| Surfactant W-3 | 0.010 g |
| Surfactant W-6 | 3.0 mg |
| Dye D-2 | 0.10 g |
| Dye D-10 | 0.12 g |
| Potassium Sulfate | 0.25 g |
| Calcium Chloride | 0.5 mg |
| Sodium Hydroxide | 0.03 g |
| Third Layer: | |
| Binder: Acid-Treated Gelatin (isoelectric point: 9.0) | 3.30 g |
| Surfactant W-3 | 0.020 g |
| Potassium Sulfate | 0.30 g |
| Sodium Hydroxide | 0.03 g |
| Fourth Layer: | |
| Binder: Lime-Treated Gelatin (isoelectric point: 5.4) | 3.10 g |
| 1:9 Copolymer of Methacrylic Acid and Methyl Methacrylate (average grain size: 2.0 μm) | 0.040 g |
| 6:4 Copolymer of Methacrylic Acid and Methyl Methacrylate (average grain size: 2.0 μm) | 0.030 g |
| Surfactant W-3 | 0.060 g |
| Surfactant W-2 | 7.0 mg |
| Hardener H-1 | 0.23 g |

(4) Coating of Light-Sensitive Emulsion Layers

The following light-sensitive emulsion layers were provided on the side opposite to the back layers to prepare sample 501. The numerals indicate the amount added per $m^2$. The effects of compounds added are not limited to the uses described.

| | | |
|---|---|---|
| First Layer: (Antihalation Layer) | | |
| Black Colloidal Silver | | 0.25 g |
| Gelatin | | 2.40 g |
| Ultraviolet Absorber U-1 | | 0.15 g |
| Ultraviolet Absorber U-3 | | 0.15 g |
| Ultraviolet Absorber U-4 | | 0.10 g |
| Ultraviolet Absorber U-5 | | 0.10 g |
| High Boiling Organic Solvent Oil-1 | | 0.10 g |
| High Boiling Organic Solvent Oil-2 | | 0.10 g |
| High Boiling Organic Solvent Oil-5 | | 0.010 g |
| Dye D-4 | | 1.0 mg |
| Dye D-8 | | 2.5 mg |
| Fine Crystal Solid Dispersion of Dye E-1 | | 0.05 g |
| Second Layer: (Intermediate Layer) | | |
| Gelatin | | 0.50 g |
| Compound Cpd-A | | 0.2 mg |
| Compound Cpd-K | | 3.0 mg |
| Compound Cpd-M | | 0.030 g |
| Ultraviolet Absorber U-6 | | 6.0 mg |
| High Boiling Organic Solvent Oil-3 | | 0.010 g |
| High Boiling Organic Solvent Oil-4 | | 0.010 g |
| High Boiling Organic Solvent Oil-7 | | 2.0 mg |
| Dye D-7 | | 4.0 mg |
| Third Layer: (Intermediate Layer) | | |
| Yellow Colloidal Silver | | 0.020 g |
| Emulsion of Silver Iodobromide Whose Surface and Inside Have Previously Been Fogged (cubic, average silver iodide content: 1%, average equivalent sphere diameter: 0.06 μm) | silver amount | 0.010 g |
| Gelatin | | 0.60 g |
| Compound Cpd-D | | 0.020 g |
| High Boiling Organic Solvent Oil-3 | | 0.010 g |
| High Boiling Organic Solvent Oil-8 | | 0.010 g |
| Fourth Layer: Low - speed Red - Sensitive Emulsion Layer | | |
| Emulsion A | silver amount | 0.10 g |
| Emulsion B | silver amount | 0.15 g |
| Emulsion C | silver amount | 0.15 g |
| Gelatin | | 0.80 g |
| Coupler Cp-1 | | 0.15 g |
| Coupler Cp-2 | | 7.0 mg |
| Coupler Cp-10 | | 3.0 mg |
| Coupler Cp-11 | | 2.0 mg |
| Ultraviolet Absorber U-3 | | 0.010 g |
| Compound Cpd-I | | 0.020 g |
| Compound Cpd-D | | 3.0 mg |
| Compound Cpd-J | | 2.0 mg |
| High Boiling Organic Solvent Oil-10 | | 0.030 g |
| Additive P-1 | | 5.0 mg |
| Fifth Layer: (Medium - speed Red - Sensitive Emulsion Layer) | | |
| Emulsion C | silver amount | 0.15 g |
| Emulsion D | silver amount | 0.15 g |
| Gelatin | | 0.70 g |
| Coupler Cp-1 | | 0.15 g |
| Coupler Cp-2 | | 7.0 mg |
| Coupler Cp-10 | | 3.0 mg |
| Compound Cpd-D | | 3.0 mg |
| Ultraviolet Absorber U-3 | | 0.010 g |
| High Boiling Organic Solvent Oil-10 | | 0.030 g |
| Additive P-1 | | 7.0 mg |
| Sixth Layer: (High - speed Red - Sensitive Emulsion Layer) | | |
| Emulsion E | silver amount | 0.15 g |
| Emulsion F | silver amount | 0.20 g |
| Gelatin | | 1.50 g |
| Coupler Cp-1 | | 0.60 g |
| Coupler Cp-2 | | 0.015 g |
| Coupler Cp-3 | | 0.030 g |
| Coupler Cp-10 | | 5.0 mg |
| Ultraviolet Absorber U-1 | | 0.010 g |
| Ultraviolet Absorber U-2 | | 0.010 g |

-continued

| | | |
|---|---|---|
| High Boiling Organic Solvent Oil-6 | | 0.030 g |
| High Boiling Organic Solvent Oil-9 | | 0.020 g |
| High Boiling Organic Solvent Oil-10 | | 0.050 g |
| Compound Cpd-D | | 5.0 mg |
| Compound Cpd-K | | 1.0 mg |
| Compound Cpd-F | | 0.030 g |
| Compound Cpd-L | | 1.0 mg |
| Additive P-1 | | 0.010 g |
| Additive P-4 | | 0.030 g |
| Seventh Layer: (Intermediate Layer) | | |
| Gelatin | | 0.70 g |
| Additive P-2 | | 0.10 g |
| Dye D-5 | | 0.020 g |
| Dye D-9 | | 6.0 mg |
| Compound Cpd-I | | 0.010 g |
| Compound Cpd-M | | 0.040 g |
| Compound Cpd-O | | 3.0 mg |
| Compound Cpd-P | | 5.0 mg |
| High Boiling Organic Solvent Oil-6 | | 0.050 g |
| Eighth Layer: (Intermediate Layer) | | |
| Yellow Colloidal Silver | silver amount | 0.020 g |
| Gelatin | | 1.00 g |
| Additive P-2 | | 0.05 g |
| Ultraviolet Absorber U-1 | | 0.010 g |
| Ultraviolet Absorber U-3 | | 0.010 g |
| Compound Cpd-A | | 0.050 g |
| Compound Cpd-D | | 0.030 g |
| Compound Cpd-M | | 0.050 g |
| High Boiling Organic Solvent Oil-3 | | 0.010 g |
| High Boiling Organic Solvent Oil-6 | | 0.050 g |
| Ninth Layer: (Low - speed Green - Sensitive Emulsion Layer) | | |
| Emulsion G | silver amount | 0.25 g |
| Emulsion H | silver amount | 0.30 g |
| Emulsion I | silver amount | 0.25 g |
| Gelatin | | 1.30 g |
| Coupler Cp-4 | | 0.20 g |
| Coupler Cp-5 | | 0.050 g |
| Coupler Cp-6 | | 0.020 g |
| Compound Cpd-A | | 5.0 mg |
| Compound Cpd-B | | 0.030 g |
| Compound Cpd-D | | 5.0 mg |
| Compound Cpd-G | | 2.5 mg |
| Compound Cpd-F | | 0.010 g |
| Compound Cpd-K | | 2.0 mg |
| Ultraviolet Absorber U-6 | | 5.0 mg |
| High Boiling Organic Solvent Oil-2 | | 0.25 g |
| Additive P-1 | | 5.0 mg |
| Tenth Layer: (Medium - speed Green - Sensitive Emulsion Layer) | | |
| Emulsion I | silver amount | 0.30 g |
| Emulsion J | silver amount | 0.30 g |
| Emulsion of Silver Bromide Whose Inside Has Been Fogged (cubic, average equivalent sphere diameter: 0.11 μm) | silver amount | 3.0 mg |
| Gelatin | | 0.70 g |
| Coupler Cp-4 | | 0.25 g |
| Coupler Cp-5 | | 0.050 g |
| Coupler Cp-6 | | 0.020 g |
| Compound Cpd-A | | 5.0 mg |
| Compound Cpd-B | | 0.030 g |
| Compound Cpd-F | | 0.010 g |
| Compound Cpd-G | | 2.0 mg |
| High Boiling Organic Solvent Oil-2 | | 0.20 g |
| High Boiling Organic Solvent Oil-9 | | 0.050 g |
| Eleventh Layer: (High - speed Green - Sensitive Emulsion Layer) | | |
| Emulsion K | silver amount | 0.40 g |
| Gelatin | | 0.80 g |
| Coupler Cp-4 | | 0.30 g |
| Coupler Cp-5 | | 0.080 g |
| Coupler Cp-7 | | 0.050 g |
| Compound Cpd-A | | 5.0 mg |
| Compound Cpd-B | | 0.030 g |

-continued

| | | |
|---|---|---|
| Compound Cpd-F | | 0.010 g |
| High Boiling Organic Solvent Oil-2 | | 0.20 g |
| High Boiling Organic Solvent Oil-9 | | 0.050 g |
| Twelfth Layer: (Yellow Filter Layer) | | |
| Yellow Colloidal Silver | silver amount | 0.010 g |
| Gelatin | | 1.0 g |
| Compound Cpd-C | | 0.010 g |
| Compound Cpd-M | | 0.10 g |
| High Boiling Organic Solvent Oil-1 | | 0.020 g |
| High Boiling Organic Solvent Oil-6 | | 0.10 g |
| Fine Crystal Solid Dispersion of Dye E-2 | | 0.20 g |
| Thirteenth Layer: (Intermediate Laye) | | |
| Gelatin | | 0.40 g |
| Compound Cpd-Q | | 0.20 g |
| Dye D-6 | | 3.0 mg |
| Fourteenth Layer: (Low - speed Blue - Sensitive Emulsion Layer) | | |
| Emulsion L | silver amount | 0.15 g |
| Emulsion M | silver amount | 0.20 g |
| Emulsion N | silver amount | 0.10 g |
| Gelatin | | 0.80 g |
| Coupler Cp-8 | | 0.020 g |
| Coupler Cp-9 | | 0.30 g |
| Coupler Cp-10 | | 5.0 mg |
| Compound Cpd-B | | 0.10 g |
| Compound Cpd-I | | 8.0 mg |
| Compound Cpd-K | | 1.0 mg |
| Compound Cpd-M | | 0.010 g |
| Ultraviolet Absorber U-6 | | 0.010 g |
| High Boiling Organic Solvent Oil-2 | | 0.010 g |
| Fifteenth Layer: (Medium - speed Blue - Sensitive Emulsion Layer) | | |
| Emulsion N | silver amount | 0.20 g |
| Emulsion O | silver amount | 0.20 g |
| Emulsion of Silver Bromide Whose Inside Has Been Fogged (cubic, average equivalent sphere diameter: 0.11 μm) | silver amount | 3.0 mg |
| Gelatin | | 0.80 g |
| Coupler Cp-8 | | 0.020 g |
| Coupler Cp-9 | | 0.25 g |
| Coupler Cp-10 | | 0.010 g |
| Compound Cpd-B | | 0.10 g |
| Compound Cpd-E | | 0.030 g |
| Compound Cpd-N | | 2.0 mg |
| High Boiling Organic Solvent Oil-2 | | 0.010 g |
| Sixteenth Layer: (High - speed Blue - Sensitive Emulsion Layer) | | |
| Emulsion P | silver amount | 0.20 g |
| Emulsion Q | silver amount | 0.25 g |
| Gelatin | | 2.00 g |
| Coupler Cp-3 | | 5.0 mg |
| Coupler Cp-8 | | 0.10 g |
| Coupler Cp-9 | | 1.00 g |
| Coupler Cp-10 | | 0.020 g |
| High Boiling Organic Solvent Oil-2 | | 0.10 g |
| High Boiling Organic Solvent Oil-3 | | 0.020 g |
| Ultraviolet Absorber U-6 | | 0.10 g |
| Compound Cpd-B | | 0.20 g |
| Compound Cpd-N | | 5.0 mg |
| Seventeenth Layer: (First Protective Layer) | | |
| Gelatin | | 1.00 g |
| Ultraviolet Absorber U-1 | | 0.15 g |
| Ultraviolet Absorber U-2 | | 0.050 g |
| Ultraviolet Absorber U-5 | | 0.20 g |
| Compound Cpd-O | | 5.0 mg |
| Compound Cpd-A | | 0.030 g |
| Compound Cpd-H | | 0.20 g |
| Dye D-1 | | 8.0 mg |
| Dye D-2 | | 0.010 g |
| Dye D-3 | | 0.010 g |

-continued

| | | |
|---|---|---|
| High Boiling Organic Solvent Oil-3 | | 0.10 g |
| Eighteenth Layer: (Second Protective Layer) | | |
| Colloidal Silver | silver amount | 0.020 g |
| Fine Grain Silver Bromide Emulsion (average grain size: 0.06 μm, AgI content: 1 mol %) | silver amount | 0.10 g |
| Gelatin | | 0.80 g |
| Ultraviolet Absorber U-1 | | 0.030 g |
| Ultraviolet Absorber U-6 | | 0.030 g |
| High Boiling Organic Solvent Oil-3 | | 0.010 g |
| Nineteenth Layer: Third Protective Layer | | |
| Gelatin | | 1.00 g |
| Polymethyl Methacrylate (average grain size: 1.5 μm) | | 0.10 g |
| 6:4 Copolymer of Methyl Methacrylate and Methacrylic Acid(average grain size: 1.5 μm) | | 0.15 g |
| Silicone Oil SO-1 | | 0.20 g |
| Surfactant W-1 | | 3.0 mg |
| Surfactant W-2 | | 8.0 mg |
| Surfactant W-3 | | 0.040 g |
| Surfactant W-7 | | 0.015 g |

In addition to the above-mentioned compositions, additives F-1 to F-9 were added to all emulsion layers. Further, in addition to the above-mentioned compositions, gelatin hardener H-1 and surfactants for coating and emulsification W-3, W-4, W-5 and W-6 were added to the respective layers. Furthermore, phenol, 1,2-benzisothiazoline-3-one, 2-phenoxyethanol, phenethyl alcohol and butyl p-benzoate were added as preservatives and antifungal agents.

TABLE 2

(Silver Iodobromide Emulsions Used in Sample 501)

| Emulsion | Grain Shape | Average Aspect Ratio | Average Equivalent sphere diameter (μm) | Coefficient of Variation (%) | Average AgI Content (%) | Halogen Composition Structure of Silver Halide Grain | AgI Content of Grain Surface (%) | Other Features (1) | (2) | (3) | (4) | (5) |
|---|---|---|---|---|---|---|---|---|---|---|---|---|
| A | Monodisperse tetradecahedral grain | — | 0.24 | 9 | 3.5 | Triple structure | 1.5 | | ○ | | | |
| B | Monodisperse (111) tabular grain | 2.0 | 0.25 | 10 | 3.5 | Quadruple structure | 1.5 | ○ | | ○ | ○ | ○ |
| C | Monodisperse (111) tabular grain | 2.0 | 0.30 | 19 | 3.0 | Triple structure | 0.1 | ○ | ○ | | ○ | ○ |
| D | Monodisperse (111) tabular grain | 3.0 | 0.35 | 21 | 4.8 | Triple structure | 2.0 | ○ | ○ | | ○ | ○ |
| E | Monodisperse (111) tabular grain | 3.0 | 0.40 | 10 | 2.0 | Quadruple structure | 1.5 | | ○ | | | |
| F | Monodisperse (111) tabular grain | 4.5 | 0.55 | 12 | 1.6 | Triple structure | 0.6 | ○ | ○ | | | ○ |
| G | Monodisperse cubic grain | — | 0.15 | 9 | 3.5 | Quadruple structure | 2.0 | | | ○ | | |
| H | Monodisperse cubic grain | — | 0.24 | 12 | 4.9 | Quadruple structure | 0.1 | ○ | ○ | | ○ | |
| I | Monodisperse (111) tabular grain | 4.0 | 0.30 | 12 | 3.5 | Quintuple structure | 4.5 | ○ | ○ | | ○ | ○ |
| J | Monodisperse (111) tabular grain | 5.0 | 0.45 | 21 | 3.0 | Quadruple structure | 0.2 | ○ | ○ | | ○ | ○ |
| K | Monodisperse (111) tabular grain | 5.5 | 0.60 | 13 | 2.7 | Triple structure | 1.3 | ○ | ○ | | | ○ |
| L | Monodisperse tetradecahedral grain | — | 0.31 | 9 | 7.5 | Triple structure | 7.0 | | | ○ | | ○ |
| M | Monodisperse tetradecahedral grain | — | 0.31 | 9 | 7.5 | Triple structure | 5.0 | ○ | ○ | | ○ | ○ |
| N | Monodisperse (111) tabular grain | 3.0 | 0.33 | 13 | 2.1 | Quadruple structure | 4.0 | ○ | ○ | ○ | | |
| O | Monodisperse (111) tabular grain | 3.0 | 0.43 | 9 | 2.5 | Quadtruple structure | 1.0 | ○ | ○ | | ○ | ○ |

TABLE 2-continued (Silver Iodobromide Emulsions Used in Sample 501)

| Emulsion | Grain Shape | Average Aspect Ratio | Average Equivalent sphere diameter (μm) | Coefficient of Variation (%) | Average AgI Content (%) | Halogen Composition Structure of Silver Halide Grain | AgI Content of Grain Surface (%) | Other Features (1) | (2) | (3) | (4) | (5) |
|---|---|---|---|---|---|---|---|---|---|---|---|---|
| P | Monodisperse (111) tabular grain | 6.0 | 0.75 | 21 | 2.8 | Triple structure | 0.5 | ○ | ○ | | | ○ |
| Q | Monodisperse (111) tabular grain | 6.0 | 0.90 | 8 | 1.0 | Quintuple structure | 0.5 | ○ | ○ | | | ○ |

(Other Features)
(1) A reduction sensitizer was added during grain formation.
(2) A selenium sensitizer was used as a post-ripening agent.
(3) A rhodium salt was added during grain formation.
(4) After post-ripening, 10% of silver nitrate by silver molar ratio and equimolar potassium bromide were added to emulsion grains at that time to form shells.
(5) The presence of 10 or more dislocation lines per grain was observed under a transmission electron microscope.

All light-sensitive emulsions were post ripened using sodium thiosulfate, potassium thiocyanate and sodium chloroaurate.

Further, chemically modified gelatin in which amino groups of gelatin was partially modified to phthalamide was added to emulsions B, C, E, H, J, N and Q in preparing the emulsions.

TABLE 3

(Spectral Sensitization of Emulsions A to Q)

| Emulsion | Sensitizing Dye Added | Amount Added per Mol of Silver Halide (g) | Addition Time of Sensitizing Dye |
|---|---|---|---|
| A | Sen-1 | 0.01 | After post-ripening |
| | Sen-2 | 0.35 | Before post-ripening |
| | Sen-3 | 0.02 | Before post-ripening |
| | Sen-8 | 0.03 | Before post-ripening |
| | Sen-13 | 0.015 | Before post-ripening |
| | Sen-14 | 0.01 | Before post-ripening |
| B | Sen-2 | 0.35 | Before post-ripening |
| | Sen-3 | 0.02 | Before post-ripening |
| | Sen-8 | 0.03 | Before post-ripening |
| | Sen-13 | 0.015 | Before post-ripening |
| | Sen-14 | 0.01 | Before post-ripening |
| C | Sen-2 | 0.45 | Before post-ripening |
| | Sen-8 | 0.04 | Before post-ripening |
| | Sen-13 | 0.02 | Before post-ripening |
| D | Sen-2 | 0.5 | After post-ripening |
| | Sen-3 | 0.05 | After post-ripening |
| | Sen-8 | 0.05 | Before post-ripening |
| | Sen-13 | 0.015 | Before post-ripening |
| E | Sen-1 | 0.01 | Before post-ripening |
| | Sen-2 | 0.45 | Before post-ripening |
| | Sen-8 | 0.05 | Before post-ripening |
| | Sen-13 | 0.01 | After post-ripening |
| F | Sen-2 | 0.4 | Before post-ripening |
| | Sen-3 | 0.04 | Before post-ripening |
| | Sen-8 | 0.04 | Before post-ripening |
| G | Sen-4 | 0.3 | After post-ripening |
| | Sen-5 | 0.05 | After post-ripening |
| | Sen-12 | 0.1 | After post-ripening |

TABLE 4

(continued from TABLE 3)

| Emulsion | Sensitizing Dye Added | Amount Added per Mol of Silver Halide (g) | Additon Time of Sensitizing Dye |
|---|---|---|---|
| H | Sen-4 | 0.02 | Before post-ripening |
| | Sen-5 | 0.05 | After post-ripening |
| | Sen-9 | 0.15 | Before post-ripening |
| | Sen-14 | 0.02 | After post-ripening |
| I | Sen-4 | 0.3 | Before post-ripening |
| | Sen-9 | 0.2 | Before post-ripening |
| | Sen-12 | 0.1 | Before post-ripening |
| J | Sen-4 | 0.35 | Before post-ripening |
| | Sen-5 | 0.05 | After post-ripening |
| | Sen-12 | 0.01 | Before post-ripening |
| K | Sen-4 | 0.3 | Before post-ripening |
| | Sen-9 | 0.05 | Before post-ripening |
| | Sen-12 | 0.1 | Before post-ripening |
| | Sen-14 | 0.02 | Before post-ripening |
| L, M | Sen-6 | 0.1 | After post-ripening |
| | Sen-10 | 0.2 | After post-ripening |
| | Sen-11 | 0.05 | After post-ripening |
| N | Sen-6 | 0.05 | After post-ripening |
| | Sen-7 | 0.05 | After post-ripening |
| | Sen-10 | 0.25 | After post-ripening |
| | Sen-11 | 0.05 | After post-ripening |
| O | Sen-10 | 0.4 | After post-ripening |
| | Sen-11 | 0.15 | After post-ripening |
| P | Sen-6 | 0.05 | After post-ripening |
| | Sen-7 | 0.05 | After post-ripening |
| | Sen-10 | 0.3 | Before post-ripening |
| | Sen-11 | 0.1 | Before post-ripening |
| Q | Sen-6 | 0.05 | Before post-ripening |
| | Sen-7 | 0.05 | Before post-ripening |
| | Sen-10 | 0.2 | Before post-ripening |
| | Sen-11 | 0.25 | Before post-ripening |

Cp-1
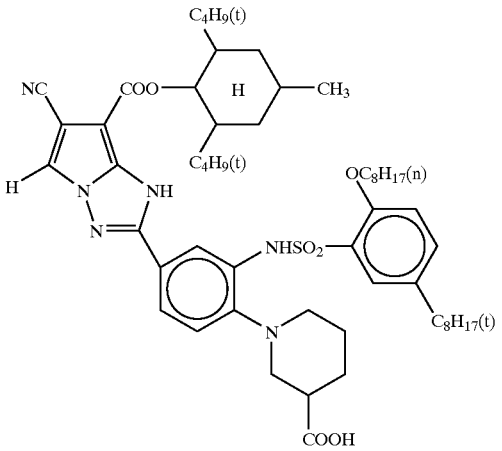
Cp-2
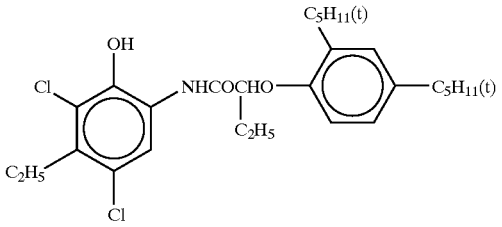
Cp-3
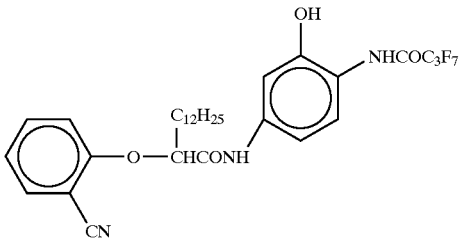
Cp-4
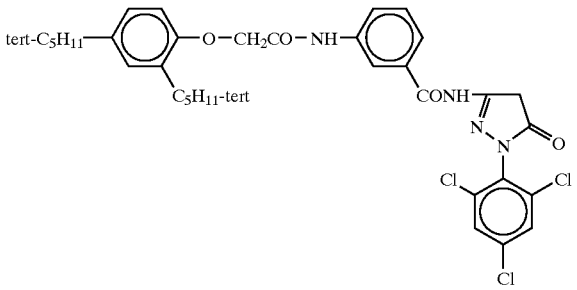
-continued
Cp-5
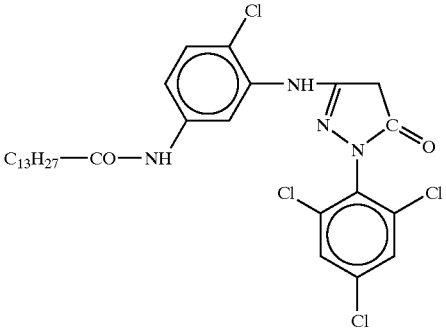
Cp-6
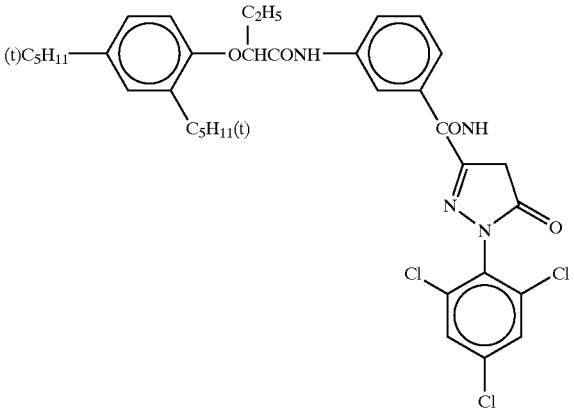
Cp-7
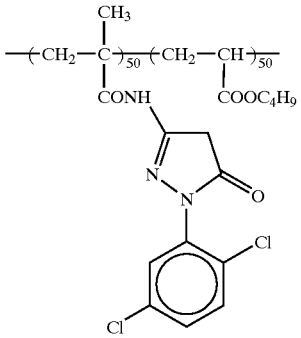
numeral: % by weight
average molecular weight: about 25,000
Cp-8
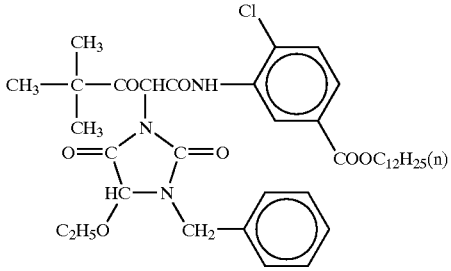

-continued
Cp-9
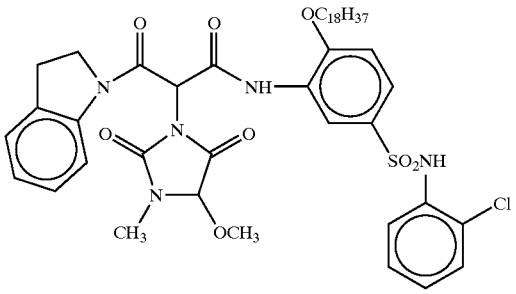
Cp-10
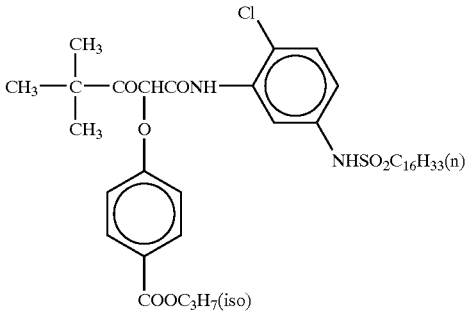
Oil-6
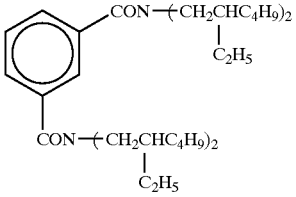
Oil-8
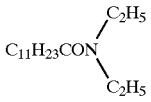
Oil-10
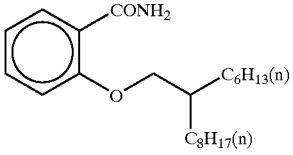
Cpd-B
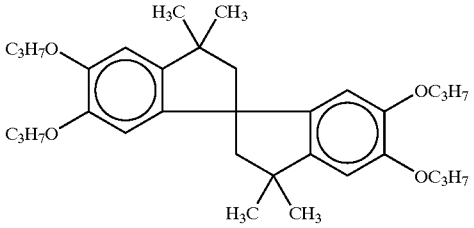
-continued
Cp-11
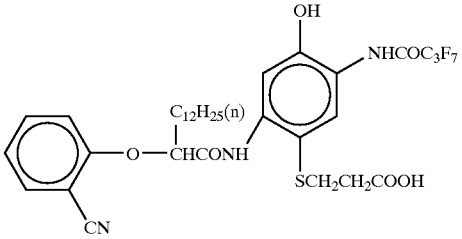
Tri-n-hexyl Phosphate Oil-1
Tricresyl Phosphate Oil-2
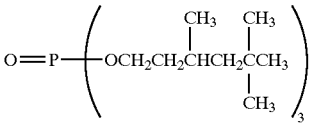
Tricyclohexyl Phosphate Oil-4
Bis(2-ethylhexyl) Succinate Oil-5
Oil-7
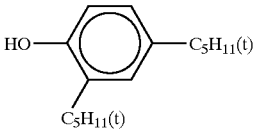
Oil-9
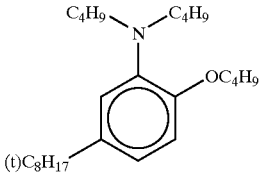
Cpd-A
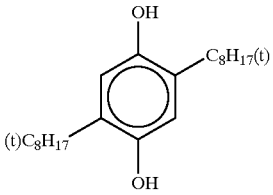
Cpd-C
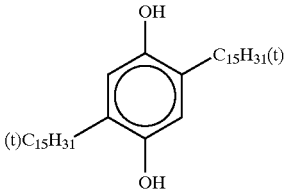

-continued
Cpd-D
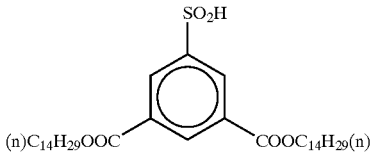
Cpd-E
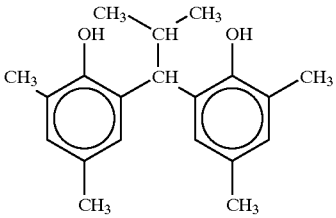
Cpd-F
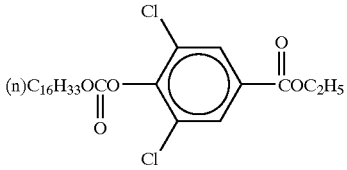
Cpd-G
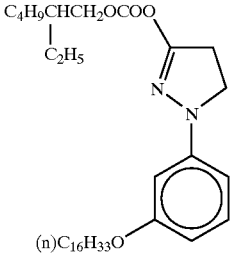
Cpd-H
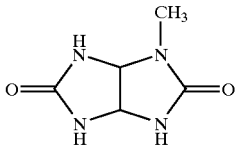
Cpd-I
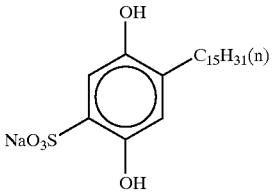
Cpd-J
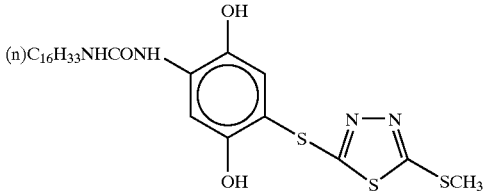
Cpd-K
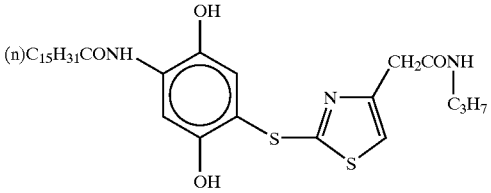
Cpd-L
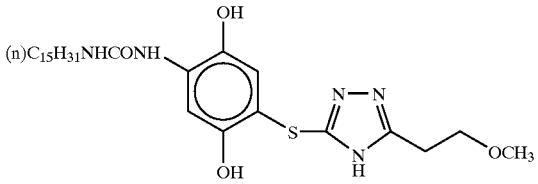
Cpd-M
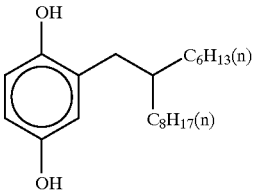
Cpd-N
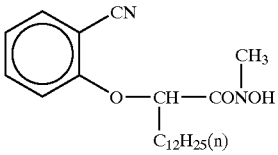
Cpd-O
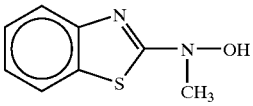
Cpd-P
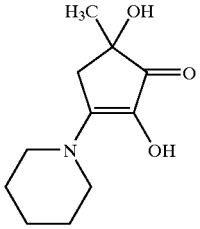
Cpd-Q
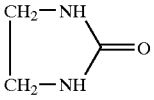

-continued
U-1
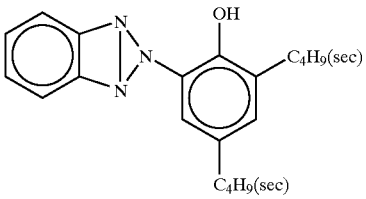
U-2
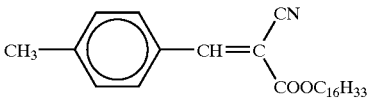
U-3
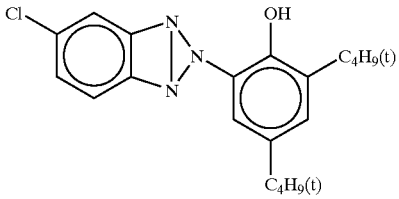
U-4
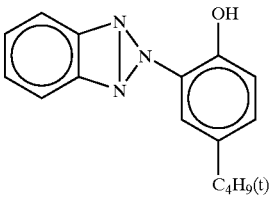
U-5
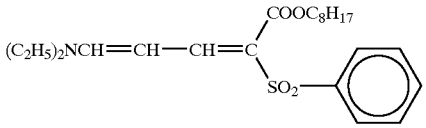
U-6
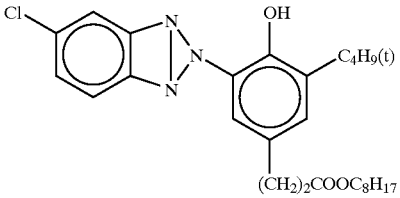
Sen-1
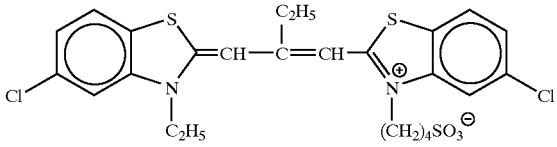
Sen-2
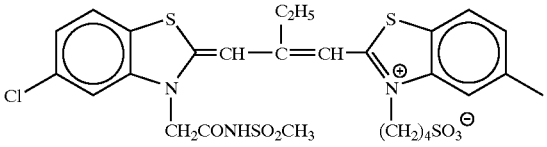
Sen-3
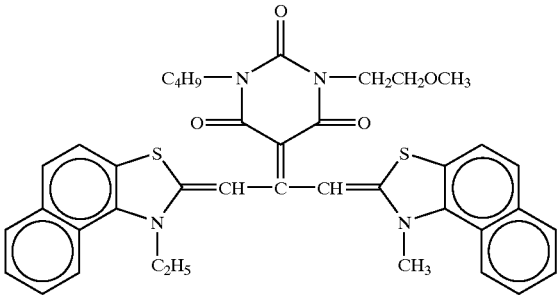
Sen-4
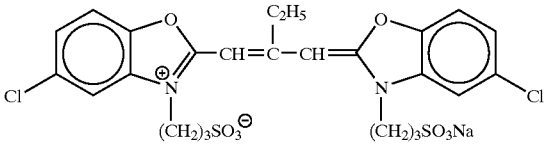
Sen-5
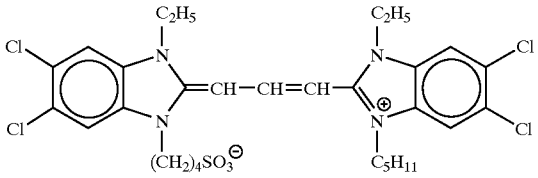
Sen-6
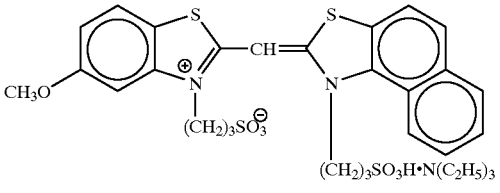
Sen-7
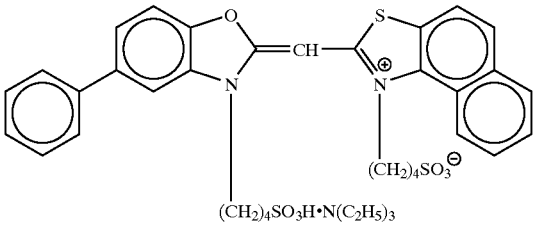
Sen-8
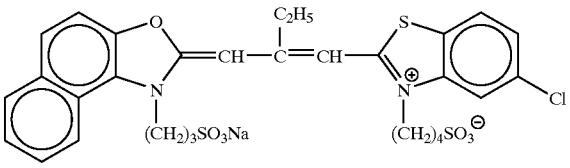

-continued
Sen-9
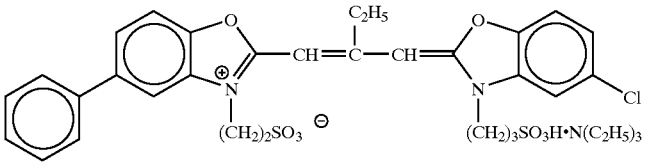
Sen-10
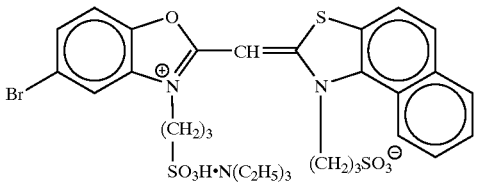
Sen-11
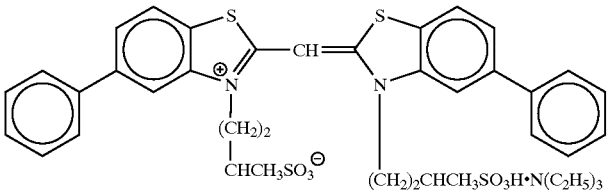
Sen-12
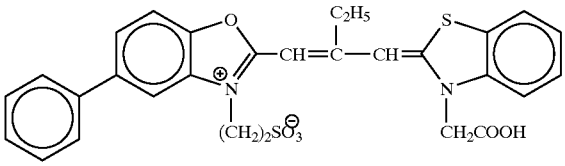
Sen-13
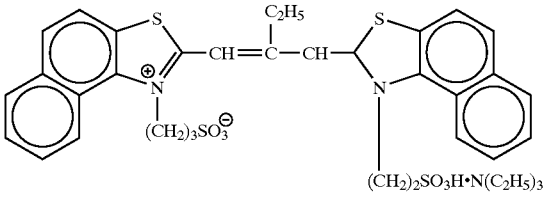
Sen-14
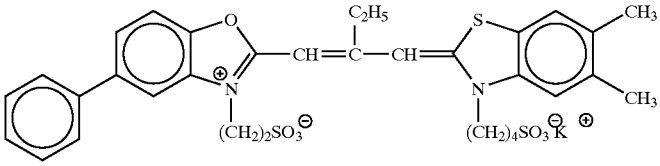
Sen-15
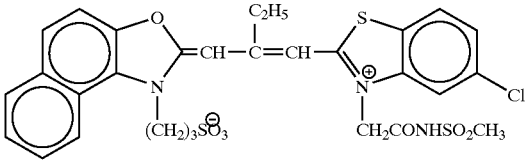
D-1
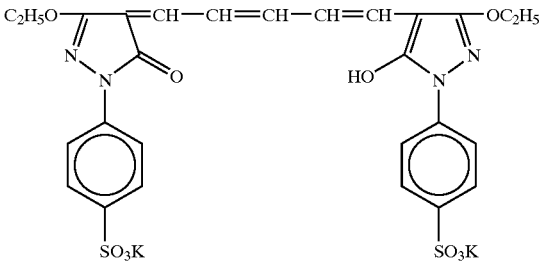

-continued
D-2
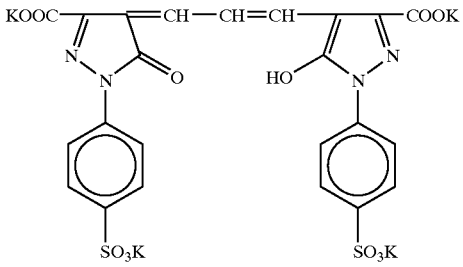
D-3
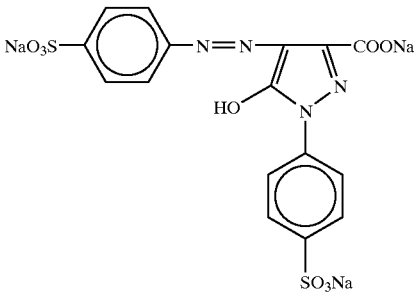
D-4
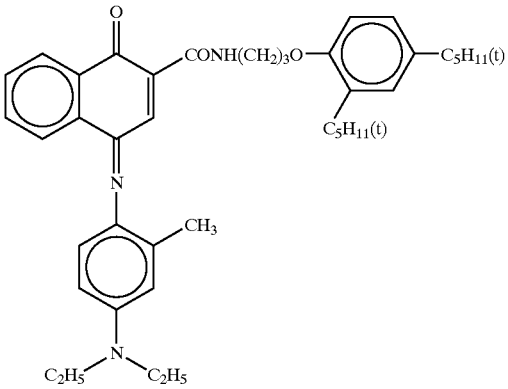
D-5
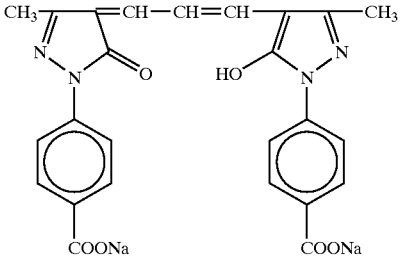
D-6
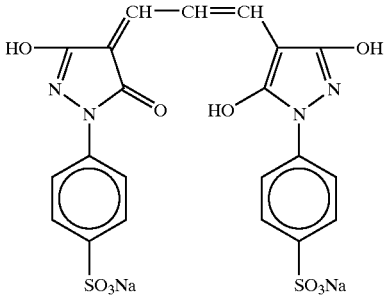
D-7
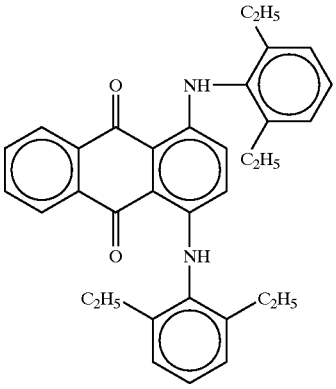
D-8
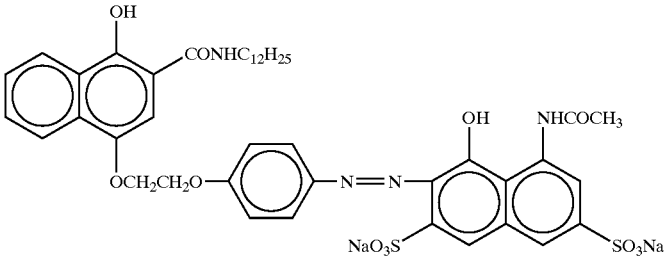

-continued
D-9
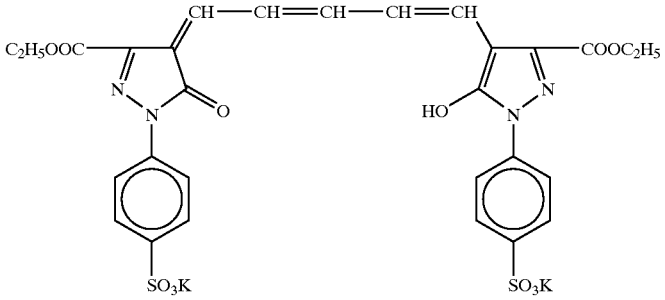
D-10
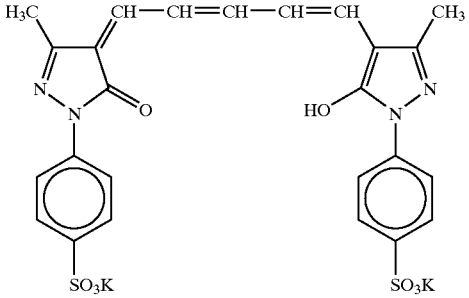
E-1
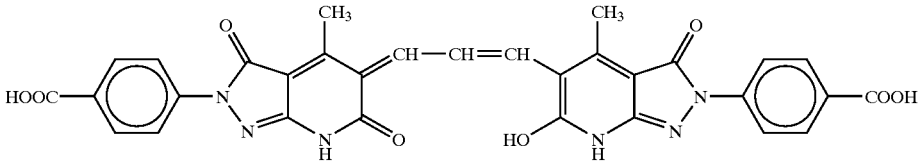
H-1
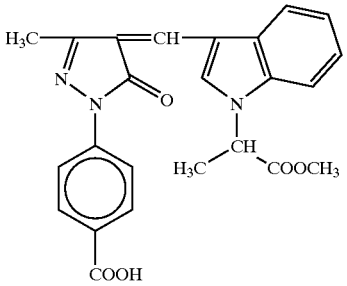
E-2
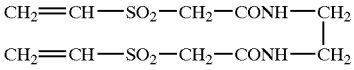
W-1
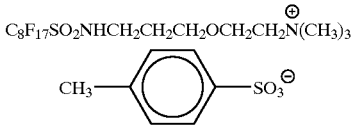
W-2
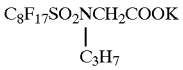
W-3
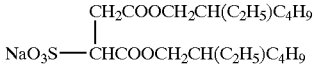
W-4
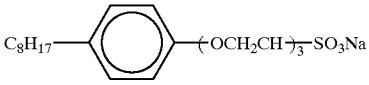
W-5
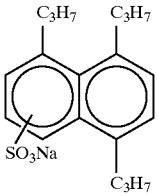
W-6
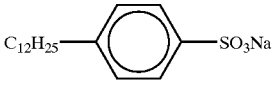
$C_8F_{17}SO_3Li$
W-7
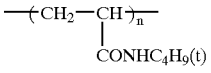
(n = 100~1000)
P-1

-continued
P-2
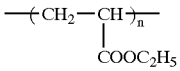
(n = 100~1000)
P-3
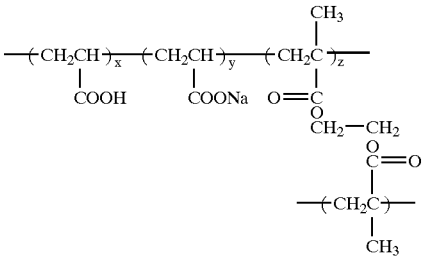
x:y:z = 42.5:7.5:50
P-4
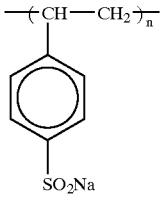
(n = 100~1000)
F-1
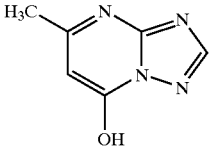
F-2
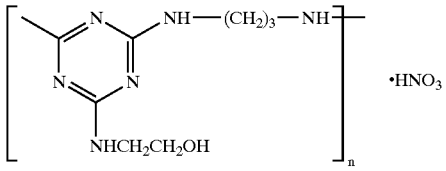
(n = 3 ~ 4)
F-3
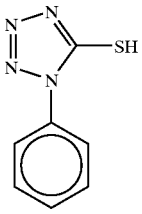
F-4
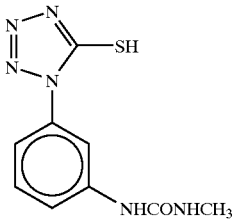
F-5
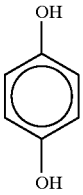
F-6
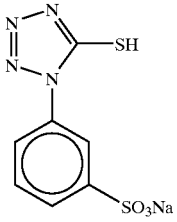
F-7
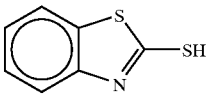
F-8
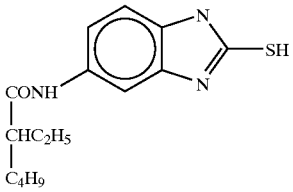
F-9
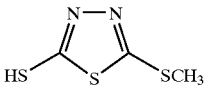
SO-1
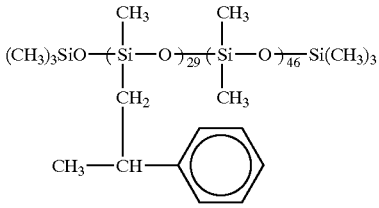

Preparation of Dispersions of Organic Solid Disperse Dyes

Preparation of Dispersion of Dye E-1

To a wet cake (270 g as the net weight of dye E-1) of dye E-1, 100 g of Pluronic F88 (an ethylene oxide-propylene oxide block copolymer) manufactured by BASF and water were added and the resulting mixture was stirred to bring the weight to 4,000 g. Then, a pulverizer (Ultra Viscomill (UVM-2) manufactured by Imex Co., ltd.) was filled with 1700 ml of zirconia beads having an average particle size of 0.5 mm. The resulting slurry was passed through the mill, and pulverized at a peripheral speed of about 10 m/sec at a discharge rate of 0.5 liter/min for 2 hours. The beads were removed by filtration, and the slurry was diluted to a dye concentration of 3% by adding water, followed by heating at 90° C. or 10 hours for stabilization. The average particle size of the resulting fine dye particles was 0.30 μm, and the width of the particle size distribution (particle size standard deviation×100/average particle size) was 20%.

Preparation of Dispersion of Dye E-2

Water and270 g of W-4 were added to 1,400 g of a wet cake containing 30% by weight of water, and the resulting mixture was stirred to prepare a slurry having an E-2 concentration of 40% by weight. The slurry was passed through a pulverizer (Ultra Viscomill (UVM-2) manufactured by Aimex) filled with 1700 ml of zirconia beads having an average particle size of 0.5 mm, and pulverized at a peripheral speed of about 10 m/sec at a discharge rate of 0.5 liter/min for 8 hours to obtain a fine solid particle dispersion of E-2. This was diluted to 20% by weight with ion-exchanged water to obtain a fine solid particle dispersion. The average particle size was 0.15 μm.

Preparation of Samples 500, 502 to 506, 601 to 606, 701 to 706 and 801 to 806

Samples 502 to 506 were prepared by replacing sensitizing dye Sen-8 of emulsions A to F used in sample 501 with equimolar dyes shown in Table 5, and dye blank sample 500 was prepared by removing dye Sen-8 from sample 501. Further, samples 601 to 606, 701 to 706 and 801 to 806 were prepared by replacing magenta couplers Cp-4 and Cp-5 with couplers shown in Table 5 so as to give the same maximum color formation density.

Each sample piece thus obtained was subjected to white light exposure at -an exposure of 20 CMS for an exposure time of 1/100 sec through a gray wedge, and then processed by the following processing steps. Then, the sample piece was subjected to sensitometry.

Further, the residual color was evaluated by subtracting the magenta stain density of dye blank sample 500 from the magenta stain density of the sample piece after processing. The stain density was measured with a densitometer (Status A, manufactured by X-RITE).

In this example, development processing steps shown below were conducted.

In processing, an unexposed sample and a completely exposed sample were subjected to running processing at a ratio of 1:1 until the replenishment rate reached 4 times the tank volume, and then processing for evaluation was conducted.

| Processing Step | Time (min) | Temperature (° C.) | Tank Volume (liter) | Replenishment Rate (ml/m$^2$) |
|---|---|---|---|---|
| First Development | 6 | 38 | 37 | 2200 |
| First Washing | 2 | 38 | 16 | 4000 |
| Reversal | 2 | 38 | 17 | 1100 |
| Color Development | 6 | 38 | 30 | 2200 |
| Pre-Bleaching | 2 | 38 | 19 | 1100 |

-continued

| Processing Step | Time (min) | Temperature (° C.) | Tank Volume (liter) | Replenishment Rate (ml/m$^2$) |
|---|---|---|---|---|
| Bleaching | 6 | 38 | 30 | 220 |
| Fixing | 4 | 38 | 29 | 1100 |
| Second Washing | 4 | 38 | 35 | 4000 |
| Final Rinsing | 1 | 25 | 19 | 1100 |

The composition of each processing solution was as shown below.

| | Tank Solution | Replenisher |
|---|---|---|
| First Developing Solution | | |
| Pentasodium Nitrilo-N,N,N-trimethylenephosphonate | 1.5 g | 1.5 g |
| Pentasodium Diethylene-triaminepentaacetate | 2.0 g | 2.0 g |
| Sodium Sulfite | 30 g | 30 g |
| Hydroquinone.Potassium Monosulfonate | 20 g | 20 g |
| Potassium Bicarbonate | 12 g | 15 g |
| 1-Phenyl-4-methyl-4-hydroxymethyl-3-Pyrazolidone | 2.5 g | 3.0 g |
| Potassium Bromide | 2.5 g | 2.5 g |
| Potassium Thiocyanate | 1.2 g | 1.2 g |
| Potassium Iodide | 2.0 mg | — |
| Diethylene Glycol | 13 g | 15 g |
| Water to make | 1000 ml | 1000 ml |
| pH | 9.60 | 9.60 |
| The pH was adjusted with sulfuric acid or potassium hydroxide. | | |
| Reversal Solution | | |
| Pentasodium Nitrilo-N,N,N-trimethylenephosphonate | 3.0 g | 3.0 g |
| Stannous Chloride.Dihydrate | 1.0 g | 1.0 g |
| p-Aminophenol | 0.1 g | 0.1 g |
| Glacial Acetic Acid | 15 ml | 15 ml |
| Water to make | 1000 ml | 1000 ml |
| pH | 6.00 | 6.00 |
| The pH was adjusted with acetic acid or potassium hydroxide. | | |
| Color Developing Solution | | |
| Pentasodium Nitrilo-N,N,N-trimethylenephosphonate | 2.0 g | 2.0 g |
| Sodium Sulfite | 7.0 g | 7.0 g |
| Trisodium Phosphate.Dodecahydrate | 36 g | 36 g |
| Potassium Bromide | 1.0 g | — |
| Potassium Iodide | 90 mg | — |
| Sodium Hydroxide | 12.0 g | 12.0 g |
| Citrazinic Acid | 0.5 g | 0.5 g |
| N-Ethyl-N-(β-methanesulfonamidoethyl))-1-methyl-4-aminoaniline.3/2 Sulfuric 2-Acid.Monohydrate | 10 g | 10 g |
| 3,6-Dioctane-1,8-diol | 1.0 g | 1.0 g |
| Water to make | 1000 ml | 1000 ml |
| pH | 11.80 | 12.00 |
| The pH was adjusted with sulfuric acid or potassium hydroxide. | | |
| Pre-Bleaching | | |
| Disodium Ethylenediaminetetraacetate . Dihydrate | 8.0 g | 8.0 g |
| Sodium Sulfite | 6.0 g | 8.0 g |
| 1-Thioglycerol | 0.4 g | 0.4 g |
| Formaldehyde - Sodium Bisulfite Adduct | 30 g | 35 g |
| Water to make | 1000 ml | 1000 ml |
| pH | 6.30 | 6.10 |

-continued

| | Tank Solution | Replenisher |
|---|---|---|
| The pH was adjusted with acetic acid or potassium hydroxide. | | |
| Bleaching Solution | | |
| Disodium Ethylenediaminetetraacetate . Dihydrate | 2.0 g | 4.0 g |
| Ammonium Ethylenediaminetetraacetato Ferrate (III).Dihydrate | 120 g | 240 g |
| Potassium Bromide | 100 g | 200 g |
| Ammonium Nitrate | 10 g | 20 g |
| Water to make | 1000 ml | 1000 ml |
| pH | 5.70 | 5.50 |
| The pH was adjusted with nitric acid or potassium hydroxide. | | |
| Fixing Solution | | |
| Ammonium Thiosulfate | 80 g | 80 g |
| Sodium Sulfite | 5.0 g | 5.0 g |
| Sodium Bisulfite | 5.0 g | 5.0 g |
| Water to make | 1000 ml | 1000 ml |
| pH | 6.60 | 6.60 |
| Stabilizing Solution | | |
| 1,2-Benzoisothiazoline-3-one | 0.02 g | 0.03 g |
| Polyoxyethylene-p-mononnyl Phenyl Ether (average degree of polymerization: 10) | 0.3 g | 0.3 g |
| Polymaleic Acid (average molecular weight: 2,000) | 0.1 g | 0.1 g |
| Water to make | 1000 ml | 1000 ml |
| pH | 7.0 | 7.0 |

In each of the above-mentioned development processing steps, a solution of each bath was continuously circulated and stirred. Further, a bubbling pipe having 0.3-mm diameter small openings at 1-cm intervals was disposed on a bottom face of each tank, and nitrogen gas was continuously bubbled through the openings, thereby stirring the solution.

Evaluation of Processing Dependency

For each of samples 501 to 506, 601 to 606, 701 to 706 and 801 to 806 prepared, continuous processing was conducted under the same conditions as those of the residual color evaluation, at a ratio of 1/1 of an unexposed sample/a completely exposed sample, using respective color developing solutions, to obtain each running processing solution.

Before and after the continuous processing, the following sensitometry was conducted using a sample having the same number as the sample used in each continuous processing. Using a sensitometer, each sample was exposed through a color separation filter and a gradation wedge for 1/100 sec. Then, each sample was developed with a fresh developing solution and each corresponding running solution.

At an exposure giving a magenta density of each sample of 2.0 at the time when the sample was processed using a fresh developing solution before the continuous processing, the magenta density (Dm) at the time when the sample was developed using each running processing solution was measured. This change in density (ΔDm=Dm−2.0) was determined. The negatively larger value means the larger change in photographic fluctuation by the continuous processing.

Evaluation results of sensitometry, residual colors and fluctuation of photographic properties are shown in the following Table 5. The relative sensitivity of a red-sensitive layer was compared based on the relative exposure giving a density 1.0 larger than the minimum density.

TABLE 5

(Evaluation of Sensitivity, Residual Color and Fluctuation of Photographic Properties after Continuous Processing)

| Sample No. | Replacement of Sensitizing Dye: Sen-8 of Emulsions A to F | Magenta Coupler: Replacement of Cp-4 | Magenta Coupler: Replacement of Cp-5 | Red-Sensitive Layer: Relative Sensitivity | Magenta Residual: Color Density | Fluctuation of Photographic Properties after Continuous Processing ΔDm = Dm − 2.0 |
|---|---|---|---|---|---|---|
| 500 (Blank) | Not added | Cp-4 | Cp-5 | — | 0 (Standard) | — |
| 501 (Comparison) | Sen-8 | Cp-4 | Cp-5 | 100 (standard) | 0.085 | −0.22 |
| 502 (Comparison) | Sen-15 | Cp-4 | Cp-5 | 96 | 0.064 | −0.18 |
| 503 (Comparison) | S-45 | Cp-4 | Cp-5 | 120 | 0.042 | −0.31 |
| 504 (Comparison) | S-48 | Cp-4 | Cp-5 | 129 | 0.045 | −0.28 |
| 505 (Comparison) | S-50 | Cp-4 | Cp-5 | 127 | 0.040 | −0.27 |
| 506 (Comparison) | S-59 | Cp-4 | Cp-5 | 130 | 0.037 | −0.30 |
| 601 (Comparison) | Sen-8 | M-4 | Cp-5 | 101 | 0.083 | −0.20 |
| 602 (Comparison) | Sen-15 | M-4 | Cp-5 | 98 | 0.060 | −0.19 |
| 603 (Invention) | S-45 | M-4 | Cp-5 | 125 | 0.035 | −0.14 |
| 604 (Invention) | S-48 | M-4 | Cp-5 | 134 | 0.037 | −0.13 |
| 605 (Invention) | S-50 | M-4 | Cp-5 | 131 | 0.033 | −0.11 |
| 606 (Invention) | S-59 | M-4 | Cp-5 | 135 | 0.030 | −0.13 |
| 701 (Comparison) | Sen-8 | M-20 | Cp-5 | 104 | 0.082 | −0.18 |
| 702 (Comparison) | Sen-15 | M-20 | Cp-5 | 99 | 0.058 | −0.18 |
| 703 (Invention) | S-45 | M-20 | Cp-5 | 128 | 0.034 | −0.12 |
| 704 (Invention) | S-48 | M-20 | Cp-5 | 136 | 0.035 | −0.11 |
| 705 (Invention) | S-50 | M-20 | Cp-5 | 133 | 0.038 | −0.09 |
| 706 (Invention) | S-59 | M-20 | Cp-5 | 137 | 0.032 | −0.12 |
| 801 (Comparison) | Sen-8 | M-20 | M-21 | 110 | 0.084 | −0.17 |
| 802 (Comparison) | Sen-15 | M-20 | M-21 | 104 | 0.055 | −0.16 |
| 803 (Invention) | S-45 | M-20 | M-21 | 132 | 0.032 | −0.08 |
| 804 (Invention) | S-48 | M-20 | M-21 | 141 | 0.036 | −0.07 |
| 805 (Invention) | S-50 | M-20 | M-21 | 138 | 0.037 | −0.07 |
| 806 (Invention) | S-59 | M-20 | M-21 | 146 | 0.030 | −0.09 |

As apparent from the results of Table 5, the photographic materials decreased in residual colors and high in sensitivity are obtained by using the methine dyes of general formula (I) of the present invention. In this case, the fluctuation of the magenta color formation density developed after the continuous processing can be restrained by using the magenta couplers of general formula (X).

TABLE 6

(Evaluation of Sensitivity, Residual Color and Fluctuation of Photographic Properties after Continuous Processing)

| Sample No. | First Layer Replacement of Sensitizing Dye A | Fifth Layer Replacement of Cyan Coupler ExC | Blue-Sensitive Layer Relative Sensitivity | Yellow Residual Color Density $Dy - Dy^0$ | Fluctuation of Cyan Density by Continuous Processing $\Delta Dc = Dc - 2.0$ |
|---|---|---|---|---|---|
| 100 (Blank) | Not added | ExC | — | 0 (standard) | — |
| 101 (Comparison) | Sensitizing dye A | ExC | 100 (standard) | 0.075 | −0.15 |
| 102 (Comparison) | Comparative dye J | ExC | 89 | 0.066 | −0.14 |
| 103 (Comparison) | S-8 | ExC | 130 | 0.044 | −0.27 |
| 104 (Comparison) | S-9 | ExC | 128 | 0.046 | −0.28 |
| 105 (Comparison) | S-13 | ExC | 140 | 0.039 | −0.30 |
| 106 (Comparison) | S-15 | ExC | 135 | 0.035 | −0.29 |
| 107 (Comparison) | S-23 | ExC | 138 | 0.055 | −0.22 |
| 108 (Comparison) | S-25 | ExC | 145 | 0.036 | −0.30 |
| 109 (Comparison) | S-74 | ExC | 150 | 0.033 | −0.41 |
| 901 (Comparison) | Sensitizing dye A | C-2 | 103 | 0.072 | −0.14 |
| 902 (Comparison) | Comparative dye J | C-2 | 90 | 0.062 | −0.13 |
| 903 (Invention) | S-8 | C-2 | 133 | 0.041 | −0.14 |
| 904 (Invention) | S-9 | C-2 | 131 | 0.043 | −0.15 |
| 905 (Invention) | S-13 | C-2 | 141 | 0.037 | −0.14 |
| 906 (Invention) | S-15 | C-2 | 136 | 0.033 | −0.13 |
| 907 (Invention) | S-23 | C-2 | 139 | 0.053 | −0.10 |
| 908 (Invention) | S-25 | C-2 | 147 | 0.035 | −0.12 |
| 909 (Invention) | S-74 | C-2 | 153 | 0.030 | −0.23 |
| 1001 (Comparison) | Sensitizing dye A | C-3 | 101 | 0.071 | −0.12 |
| 1002 (Comparison) | Comparative dye J | C-3 | 90 | 0.063 | −0.11 |
| 1003 (Invention) | S-8 | C-3 | 132 | 0.042 | −0.13 |
| 1004 (Invention) | S-9 | C-3 | 129 | 0.045 | −0.12 |
| 1005 (Invention) | S-13 | C-3 | 141 | 0.037 | −0.15 |
| 1006 (Invention) | S-15 | C-3 | 137 | 0.032 | −0.14 |
| 1007 (Invention) | S-23 | C-3 | 139 | 0.052 | −0.10 |
| 1008 (Invention) | S-25 | C-3 | 147 | 0.034 | −0.13 |
| 1009 (Invention) | S-74 | C-3 | 151 | 0.032 | −0.25 |

Example 3

Preparation of Samples

Samples 901 to 909 and 1001 to 1009 were prepared in the same manner as with Example 1 with the exception that cyan coupler ExC of the fifth layers of samples 101 to 109 prepared in Example 1 was replaced with couplers shown Table 6, respectively, so as to give the same maximum color formation density. Each sample was processed to a roll form having a width of 127 mm.

Evaluation of Residual Color of Dye

For samples 100 to 109, 901 to 909 and 1001 to 1009, continuous processing (running test) was conducted by the processing steps described in Example 1 until a replenisher was replenished twice the amount of a color developing tank, at a ratio of 25%/75% of a sample fogged by white light/an unexposed sample, using respective color developing solutions (running processing solutions 100 to 109, 901 to 909 and 1001 to 1009).

Using a sensitometer, samples 100 to 109, 901 to 909 and 1001 to 1009 were exposed through a color separation filter and a gradation wedge for 1/100 sec. Then, each sample was developed with each corresponding running solution and subjected to sensitometry. Further, the yellow density (Dy) of an unexposed area of the resulting sample was measured. The difference in the yellow density from the yellow density ($Dy^0$) of sample 100 is the residual color of the sensitizing dye used. The smaller density difference means that the residual color is more decreased.

As apparent from Table 6, the samples of the present invention in which the methine dyes of general formula (I) are used in combination with the couplers of general formula (X) have high sensitivity. Moreover, the residual colors after processing are restrained to a low level.

Evaluation of Processing Dependency

For each of samples 101 to 109, 901 to 909 and 1001 to 1009 prepared, continuous processing was conducted under the same conditions as those of the residual color evaluation, at a ratio of 25%/75% of a sample fogged by white light/an unexposed sample, using respective color developing solutions, to obtain each running processing solution.

Before and after the continuous processing, the following sensitometry was conducted using a sample having the same number as the sample used in each continuous processing. Using a sensitometer, each sample was exposed through a color separation filter and a gradation wedge for 1/100 sec. Then, each sample was developed with a fresh developing solution and each corresponding running solution.

At an exposure giving a cyan density of each sample of 2.0 at the time when the sample was processed using a fresh developing solution before the continuous processing, the cyan density (Dc) at the time when the sample was developed using each running processing solution was measured. This change in density ($\Delta Dc = Dc - 2.0$) was determined. The negatively larger value means the larger change in photographic fluctuation by the continuous processing.

As apparent from Table 6, the photographic fluctuation of the cyan color formation density after the continuous processing at the time when the methine dyes of general formula (I) of the present invention is used is restrained by the use in combination with the cyan couplers of general formula (XX) of the present invention.

According to the present invention, the silver halide photographic materials having high sensitivity, decreased residual colors and minor fluctuations in photographic characteristics after continuous processing can be obtained.

The entitle disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one methine dye represented by the following general formula (I) and at least one coupler represented by the following general formula (XII):

(I)

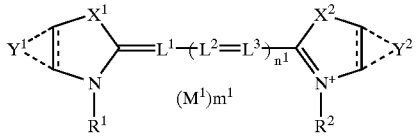

wherein $X^1$ and $X^2$ each represents an oxygen atom, a sulfur atom, a selenium atom, a tellurium atom, a nitrogen atom or a carbon atom; $Y^1$ represents a furan, pyrrole or thiophene ring which may be condense with another 5- or 6-membered carbon ring or heterocycle or may have a substituent group; $Y^2$ represents an atomic group necessary for forming a benzene ring or a 5- or 6-membered unsaturated heterocycle, which may be further condensed with another 5- or 6-membered carbon ring or heterocycle or may have a substituent group; a bond between two carbon atoms by which $Y^1$ and $Y^2$ are each condensed with the carbon ring or the heterocycle may be a single bond or a double bond; $R^1$ and $R^2$ each represents a substituted or unsubstituted alkyl, aryl or heterocyclic group; $L^1$, $L^2$ and $L^3$ each represents a methine group; $n^1$ represents 0 or 1; $M^1$ represents a counter ion; and $m^1$ represents a number of 0 or more necessary for neutralizing a charge in a molecule;

(XII)

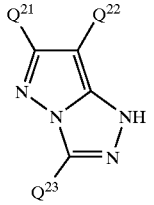

wherein $Q^{21}$ represents an alkyl group, $Q^{22}$ represents a hydrogen atom or a halogen atom, and $Q^{23}$ represents a substituent group containing —$SO_2$—.

2. The silver halide photographic material of claim 1, comprising a support having provided thereon at least one silver halide photographic emulsion layer, which contains said at least one methine dye represented by general formula (I) and at least one coupler represented by the following general formula (XX):

(XX)

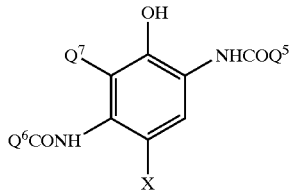

wherein $Q^5$ represents a substituted or unsubstituted aryl group; $Q^6$ represents a substituted or unsubstituted a group; $Q^7$ represents a hydrogen atom, a halogen atom, an alkoxyl group or an alkyl group; an X represents a hydrogen atom or a group to be released by a reaction with an oxidant of a developing agent.

3. The silver halide photographic material as claimed in claim 1, wherein the methine dye represented by general formula (I) is represented by the following general formula (II), (III), (IV) or (V):

(II)

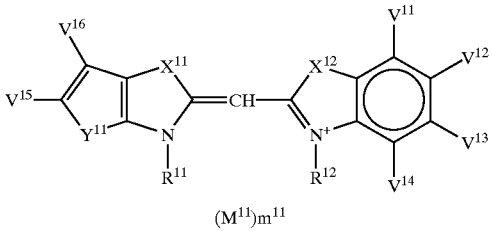

wherein $Y^{11}$ represents an oxygen atom, a sulfur atom or N—$R^{13}$, wherein $R^{13}$ represents a hydrogen atom or alkyl group; $V^{15}$ and $V^{16}$ each represents a hydrogen atom or a monovalent substituent group; $X^{11}$ and $X^{12}$ each represents an oxygen atom or a sulfur atom; $R^{11}$ and $R^{12}$ each represents alkyl group substituted by an acid group; $V^{11}$, $V^{12}$, $V^{13}$ and $V^{14}$ each represents a hydrogen atom or a monovalent substituent group; $M^{11}$ represents a counter ion; and $m^{11}$ represents a number of 0 or more necessary for neutralizing a charge in a molecule;

(III)

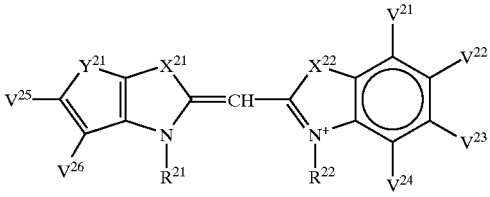

wherein $Y^{21}$ represents an oxygen atom, a sulfur atom or N—$R^{23}$, wherein $R^{23}$ represents a hydrogen atom or alkyl group; $V^{25}$ and $V^{26}$ each represents a hydrogen atom or a monovalent substituent group; $X^{21}$ and $X^{22}$ each represents an oxygen atom or a sulfur atom; $R^{21}$ and $R^{22}$ each represents alkyl group substituted by an acid group; $V^{21}$, $V^{22}$, $V^{23}$ and $V^{24}$ each represents a hydrogen atom or a monovalent substituent group; $M^{21}$ represents a counter ion; and $m^{21}$ represents a number of 0 or more necessary for neutralizing a charge in a molecule;

(IV)

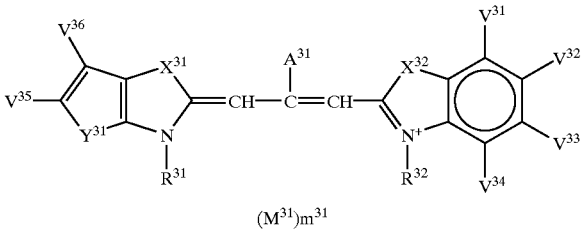

$(M^{31})m^{31}$ wherein $Y^{31}$ represents an oxygen atom, a sulfur atom or N—$R^{33}$, wherein $R^{33}$ represents a hydrogen atom or alkyl group; $V^{35}$ and $V^{36}$ each represents a hydrogen atom or a monovalent substituent group; $X^{31}$ and $X^{32}$ each represents an oxygen atom or a sulfur atom; $R^{31}$ and $R^{32}$ each represents an alkyl group substituted by an acid group; $A^{31}$ represents a methyl group, an ethyl group or a propyl group; $V^{31}$, $V^{32}$, $V^{33}$ and $V^{34}$ each represents a hydrogen atom or a monovalent substituent group; $M^{31}$ represents a counter ion; and $m^{31}$ represents a number of 0 or more necessary for neutralizing a charge in a molecule;

(V)

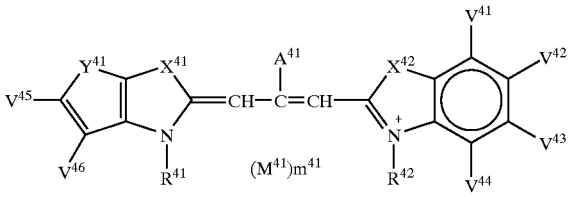

$(M^{41})m^{41}$ wherein $Y^{41}$ represents an oxygen atom, a sulfur atom or N—$R^{43}$, wherein $R^{43}$ represents a hydrogen atom or alkyl group; $V^{45}$ and $V^{46}$ each represents a hydrogen atom or a monovalent substituent group; $X^{41}$ and $X^{42}$ each represents an oxygen atom or a sulfur atom; $R^{41}$ and $R^{42}$ each represents an alkyl group substituted by an acid group; $A^{41}$ represents a methyl group, an ethyl group or a propyl group; $V^{41}$, $V^{42}$, $V^{43}$ and $V^{44}$ each represents a hydrogen atom or a monovalent substituent group; $M^{41}$ represents a counter ion, and $m^{41}$ represents a number of 0 or more necessary for neutralizing a charge in a molecule.

4. The silver halide photographic material as claimed in claim 1, wherein one of $R^1$ and $R^2$ of the methine dye represented by general formula (I) is an alkyl group substituted by a carboxyl group, a —$CONHSO^2$— group, an —$SO^2NHCO$— group, a —CONHCO— group or an —$SO^2NHSO^2$-group, and the other is an alkyl group substituted by a sulfo group.

5. The silver halide photographic material as claimed in claim 1, wherein $Y^1$ represents a thiophene ring.

* * * * *